US007679569B2

(12) United States Patent
Takaki et al.

(10) Patent No.: US 7,679,569 B2
(45) Date of Patent: Mar. 16, 2010

(54) ANTENNA DEVICE AND MULTI-BAND TYPE WIRELESS COMMUNICATION APPARATUS USING SAME

(75) Inventors: Yasunori Takaki, Saitama (JP); Hiroyuki Aoyama, Saitama (JP); Hiroto Ideno, Tottori (JP)

(73) Assignee: Hitachi Metals, Ltd., Tokyo (JP)

( * ) Notice: Subject to any disclaimer, the term of this patent is extended or adjusted under 35 U.S.C. 154(b) by 369 days.

(21) Appl. No.: 11/723,878

(22) Filed: Mar. 22, 2007

(65) Prior Publication Data

US 2007/0290944 A1 Dec. 20, 2007

(30) Foreign Application Priority Data

Apr. 10, 2006 (JP) ..... 2006-107177
Aug. 12, 2006 (JP) ..... 2006-220792

(51) Int. Cl.
*H01Q 1/24* (2006.01)

(52) U.S. Cl. ..... 343/702

(58) Field of Classification Search ..... 373/702, 373/700 MS, 725–726, 729
See application file for complete search history.

(56) References Cited

U.S. PATENT DOCUMENTS 5,644,319 A * 7/1997 Chen et al. ..... 343/702
5,936,583 A * 8/1999 Sekine et al. ..... 343/702
6,031,503 A * 2/2000 Preiss et al. ..... 343/770
6,911,944 B2 * 6/2005 Sekine et al. ..... 343/702
7,286,090 B1 * 10/2007 Rowell ..... 343/702
7,525,488 B2 * 4/2009 Rowell ..... 343/700 MS

FOREIGN PATENT DOCUMENTS

| | | |
|---|---|---|
| JP | 3-502157 | 5/1991 |
| JP | 2004-007803 | 1/2004 |
| JP | 2004-363789 | 12/2004 |
| JP | 2005-229365 | 8/2005 |
| WO | WO 99/28990 | 6/1999 |

* cited by examiner

*Primary Examiner*—Huedung Mancuso
(74) *Attorney, Agent, or Firm*—McGinn IP Law Group PLLC

(57) ABSTRACT

An antenna device is provided which is capable of saving space, of operating in wide bands (in a multi-band) and of achieving an excellent gain and maintaining non-directivity of vertically polarized waves in each band. The antenna device has a conductor antenna. An end portion 111*a* on one end side of the conductor antenna is mounted as a power feeding section and an end portion 112*a* on the other end side of the conductor antenna 110 is mounted as an open end terminal. The antenna device also has a base body made of an insulating material which is coupled to one end and other end of the conductor antenna. The base band is coupled in a place where an electric field strength of the conductor antenna having a folded-back portion is increased, thus achieving the wideband and high-gain antenna device.

29 Claims, 42 Drawing Sheets

| | Length of conductor antenna | Length of base body in longitudinal direction | Relative permittivity of base body | Radiation efficiency | |
|---|---|---|---|---|---|
| | | | | 900MHz | 1800MHz |
| First embodiment (plate-shaped) | 36 | 5.5 | 8 | 95 | 98 |
| | 36 | 1.5 | 21 | 97 | 99 |
| | 31 | 20 | 8 | 98 | 100 |
| | 31 | 7 | 21 | 95 | 100 |
| Second embodiment (plate-shaped) | 36 | 6 | 8 | 98 | 98 |
| | 36 | 1.25 | 21 | 98 | 99 |
| | 33.5 | 4 | 21 | 97 | 99 |
| | 31 | 7 | 21 | 93 | 98 |
| Third embodiment (line-shaped) | 33.5 | 3 | 21 | 92 | 98 |
| | 31 | 5 | 21 | 91 | 99 |
| | 28.5 | 7 | 21 | 90 | 100 |
| Fourth embodiment (line-shaped) | 36 | 3 | 8 | 90 | 97 |
| | 33.5 | 12.5 | 8 | 2 | 98 |
| | 31 | 20 | 8 | 89 | 97 |
| Comparative example (pattern electrode) | 31 | 25 | 8 | 86 | 98 |

Fig. 10

ANTENNA DEVICE AND MULTI-BAND TYPE WIRELESS COMMUNICATION APPARATUS USING SAME

BACKGROUND OF THE INVENTION

1. Field of the Invention

The present invention relates to an antenna device and more particularly to the antenna device that can operate in a plurality of bands (transmitting/receiving bands) and a multi-band wireless communication apparatus using the antenna device.

2. Description of the Related Art

In recent years, a wireless communication apparatus such as a mobile phone or a like has become widespread and various bands are used in communications. In a recently-available mobile phone called a dual-band, triple-band, or quad-band type mobile phone in particular, one mobile phone is made to operate in a plurality of bands (transmitting/receiving bands). In such a circumstance, hurried development of an antenna device making up antenna circuits that can be embedded in a mobile phone or a like being capable of operating in a plurality of bands (transmitting/receiving bands) described above is needed. It is thus necessary that, in order to respond to needs for further miniaturization of a wireless communication apparatus such as a mobile phone and for operations in multi-bands, despite a tendency of an increase in antenna components, the antenna device not only can achieve its miniaturization but also can have high performance.

An example of such a conventional antenna device mounted on one wireless communication apparatus such as a mobile phone which can operate in a plurality of bands is disclosed in, for example, Patent Reference 1 (Japanese Patent Application Laid-open No. 2004-363789) in which a dielectric antenna portion having a radiation electrode pattern and a plate antenna portion make up an inverted F antenna. Also, an antenna device is disclosed in Patent Reference 2 (Japanese Patent Application Laid-open No. 2004-7803) in which a conductive plate-shaped auxiliary element is attached to a dielectric antenna portion with a radiation electrode pattern. Another antenna device is disclosed in Patent Reference 3 (International Publication No. WO 99/28990) in which an inverted F antenna is constructed by arranging a dielectric between a radiation conductor and a grounding conductor. Still another antenna device made up of only a dielectric is disclosed in Patent Reference 4 (Japanese Patent Application Laid-open No. 2005-229365). Yet another antenna device is disclosed in Patent Reference 5 (Japanese Patent Application Laid-open No. Hei 3-502157) in which a dielectric core is mounted in a loop of a loop antenna.

However, the conventional antenna devices disclosed in the Patent References 1 and 2 have a problem in that fine adjustments are not easy since their impedance matching is performed by using the radiation electrode patterns formed on the dielectric antenna portion. The antenna device disclosed in the Patent Reference 3 has also a problem in that a bandwidth is made narrow and radiation efficiency is lowered since the dielectric is placed between the radiation conductor and a grounding conductor. The antenna device disclosed in the Patent Reference 4 has also a problem in that the radiation efficiency and sensitivity are lowered when compared with the antenna devices disclosed in the Patent References 1, 2, and 3. The antenna device disclosed in the Patent Reference 4 has another problem that an antenna needs to be installed for every band and space for the antenna device is greatly occupied by antenna circuits and its antenna gain is reduced due to fluctuations of directivity of the antenna and degradation in VSWR (Voltage Standing Wave Ratio) caused by interactions among the installed antennas for each band. The antenna device disclosed in the Patent Reference 5 has a problem that the antenna used is a single loop antenna in which its line length or electrical length consists of one wavelength and, therefore, space for the antenna is greatly occupied in the antenna device.

SUMMARY OF THE INVENTION

In view of the above, it is an object of the present invention to provide technology capable of realizing an antenna device that can operate in wide bands (in a multi-band) and can achieve an excellent antenna gain and maintain non-directivity of vertically polarized waves in each band in a space-saving manner.

As a result from various studies and researches of smaller-sized antenna devices, the inventor of the present invention has invented the antenna device which can save more space compared with the conventional antenna device and also can perform operation in wide bands (in a plurality of frequency bands) and can achieve excellent antenna gain and maintain non-directivity of vertically polarized waves in each band, that is, in order to solve the above problems, there is provided an antenna device made up of an approximately U-shaped conductor antenna, on one end side of which a power feeding portion is provided and on other end side of which an end portion is provided as an open end terminal and a base body made of an insulating material, wherein one end of the conductor antenna and other end of the conductor antenna are placed so as to come near to each other with the base body interposed between the one end of the conductor and the other end of the conductor antenna and wherein the base body is coupled to at least either of the one end side of the conductor or the other end side of the conductor antenna.

By configuring as above, one end and the other end of the U-shaped conductor antenna are placed so as to come near to each other and the base body made of an insulating material is mounted between the one end and the other end of the U-shaped conductor antenna and is coupled to at least either of the one end or the other end portion. That is, the base body made of a dielectric material or magnetic material both being an insulating material is coupled to a place where an electric field strength of the conductor antenna increases and, as a result, an electromagnetic distance between the one end and the other end of the conductor antenna becomes short to a degree to which electrostatic coupling occurs, which allows a resonant point to be easily obtained and, therefore, the antenna can be miniaturized by a wavelength shortening effect of the dielectric or magnetic material being the insulating material. Therefore, the antenna device is allowed to operate in wide bands (in a multi-band) and to achieve excellent antenna gain and maintain non-directivity of vertically polarized waves and save space. Particularly, the above antenna device has the flexibility of easily achieving wide-band operations in a plurality of frequency bands. It is thus made possible to realize excellent gain and to keep non-directivity of vertically polarized waves in wider bands (in a plurality of bands). Moreover, in each band, excellent antenna gain can be obtained and non-directivity of vertically polarized waves is kept in wider bands.

Also, according to the present invention, an antenna device is provided which includes an approximately U-shaped conductor antenna, on one end side of which a power feeding portion is provided and, on other end side of which an end portion is provided as an open end terminal and a base body made of an insulating material, wherein one end of the conductor antenna and other end of the conductor antenna are placed so as to come near to each other with the base body interposed between the one end of the conductor antenna and the other end of the conductor antenna and wherein the base body is coupled between the one end of the conductor antenna and other end of the conductor antenna.

Moreover, the base body is mounted between conductors making up the conductor antenna both being opposite to each other wherein space is formed at least in a partial portion between conductors making up the conductor antenna both being opposite to each other. For example, the base body may be placed between in a portion near to an end portion on one end side of the conductor antenna and in a portion near to an end portion on the other end side of the conductor antenna or the base body may be placed between in a portion near to a central portion on one end side of the conductor antenna and in a portion near to a central portion on the other end side of the conductor antenna.

Also, the conductor antenna is made of a metal conductive plate or a metal conductive line or the conductor antenna is constructed of a conductor pattern made of metal conductive foil placed on the base body or of a metal conductive film.

By configuring as above, the one end of the conductor antenna is capacitively coupled to the other end of the conductor antenna and the one end of the conductor antenna and the other end of the conductor antenna are electromagnetically and mutually used and, therefore, impedance matching property can be improved and, as a result, wide-band operations in each band and maintaining of non-directivity of vertically polarized waves are made possible. Moreover, by performing a machining process of shaving part of the metal conductive foil or metal conductive film, the adjustment of transmitting and receiving frequencies of the conductor antenna becomes possible.

Also, according to the present invention, the conductor antenna is made of a plate-shaped conductor and a plane portion of the conductor on one end side of the conductor antenna, which is opposite to the other end side, is approximately orthogonal to a plane portion of the conductor on the other end side of the conductor antenna. By configuring as above, height of the conductor antenna can be made small, which allows a thickness of a wireless communication apparatus into which the antenna device is embedded to be thin. In addition, some distance can be kept between the conductor antenna and the conductor portion of the main board, which is attributable to improvement of antenna gain and achievement of wide-band operations. Additionally, by arranging the conductor planes on the one end side and the other end side of the conductor antenna so as to be parallel to each other, further improvement of antenna gain and achievement of wider-band operations are made possible.

Also, according to the present invention, the antenna device is made up of a main board or sub-board on which the base body and the conductor antenna are mounted. Alternatively, the board is the main board or a sub-board connected to the main board. The sub-board is electrically connected to the main board and may be placed far from the main board. Preferably, a mounting hardware is attached which is used to attach the main board and/or the antenna device to an apparatus into which the main board and/or the conductor antenna. Also, each of a portion on one end side of the conductor antenna and a folded-back portion may be coupled to the board. By configuring as above, handling of the antenna device at a time of assembling work is made easy.

Moreover, according to the present invention, there is provided an antenna device made up of an approximately U-shaped conductor antenna, on one end side of which a power feeding portion is provided and on the other end side of which an end portion is provided as an open end terminal and a base body made of an insulating material, wherein one end of the conductor antenna and other end of the conductor antenna are placed so as to come near to each other with the base body interposed between the one end of the conductor and the other end of the conductor antenna and wherein the base body is coupled to at least either of the one end side of the conductor or the other end side of the conductor antenna. By configuring as above, the base body and conductor antenna can be mounted on the sub-board, which functions as a board being different from the main board, and some distance can be kept between the conductor antenna and base body mounted on the sub-board and conductor portions mounted on the main board and, therefore, unwanted capacitive coupling can be reduced, which is contributable to the wide-band and high-gain antenna. Alternatively, either of the sub-board or main board can be used as the above board.

Also, the base body and one portion on one end side of the conductor antenna or one portion on the other end side of the conductor antenna may be mounted on a main face of the board and another portion on one end side of the conductor antenna or another portion on the other end of the conductor antenna is formed on a rear of the main face of the board. By configuring as above, the rear of the board can be effectively used, which enables miniaturization of the antenna device.

Also, at least either of a portion on one end side of the conductor antenna or a portion on the other end side of the conductor antenna can be made of a metal conductive plate or a metal conductive line. In the above configuration, by using the metal plate or metal line material, assembling of the antenna device is made easy and a degree of freedom of designing its shape is increased, which can provide the antenna having a mechanical strength.

Also, either of a portion on one end side of the conductor antenna or a portion on the other end side of the conductor antenna is made up of a conductor pattern made of metal conductive foil or a metal conductive film placed to the board. By configuring as above, the conductor antenna can be easily fabricated by using a screen printing method, deposition method, or a like and, therefore, any one of line-shaped, meandering shaped, and crank-shaped, and helical shaped profiles for the antenna device can be selected as appropriate.

Also, in the conductor antenna in which another portion on one end side of the conductor antenna or another portion on the other end of the conductor antenna is formed on a rear of the main face of the board and, preferably, a conductor on one end side of the conductor antenna is coupled to a conductor on the other end side of the conductor antenna in an approximately U-shaped folded-back portion via a through-hole formed on the board or a side electrode formed on the board. By configuring as above, since the conductor on the one end side and the conductor on the other end side of the conductor antenna is made of a metal conductive plate or metal conductive line, if a portion on the other end side is made of the metal conductive foil or metal conductive line mounted on the rear of the board, both can be coupled easily and reliability in the mechanical strength and electrical connection is increased.

Also, preferably, a plane on one end side of the conductor antenna is approximately vertical to a plane on the other end side, which is opposite to the one end side, of the conductor antenna. By configuring as above, the height of the conductor antenna is allowed to be made small while a radiation area of the conductor antenna remains maintained and the antenna device or a wireless communication apparatus in which the antenna device is embedded is allowed to be made thin.

Additionally, some distance can be kept between the conductor antenna and conducting portions on the main board and the occurrence of capacitive coupling is reduced by formation of a face being orthogonal to the ground of the base body, which is contributable to reduction of unwanted capacitive coupling and improvement of antenna gain and operations in wide band.

Also, a portion on the other end side of the conductor antenna may be made to bypass to form an L-shaped route or ⊃-shaped route on a rear of the board. By configuring as above, frequencies can be adjusted by changing a length of the conductor. Moreover, the conductor antenna can be configured so as to bypass an obstacle or other components existing in narrow space.

Furthermore, according to the present invention, the antenna device is provided which is made up of an approximately U-shaped conductor antenna, in an approximately central portion on one end side of which a power feeding portion is provided and on other end side of which an end portion is provided as an open end terminal, a base body made of an insulating material, and a board on which the base body and the conductor antenna are mounted, wherein one end of the conductor antenna and other end of the conductor antenna are placed so as to come near to each other with the base body interposed between the one end of the conductor and the other end of the conductor antenna and wherein the base body is coupled to at least either of the one end side of the conductor or the other end side of said conductor antenna.

Also, the conductor antenna and the base body are mounted on a main face of the board.

Also, portions on one end side or on the other end side of the conductor antenna is made of a metal conductive plate or metal conductive line.

Also, a portion on one end side of the conductor antenna may be coupled to an upper face of the base body and a portion on the other end side of the conductor antenna is coupled to a side face of the base body and a portion on one end of the conductor antenna may be coupled to a side face of the base body and a portion on other end side of the conductor antenna may be coupled to another side facing the side face of the conductor antenna. By configuring as above, the conductor is configured so as to be sandwiched between the conductor antennas, thereby achieving the antenna having a high mechanical strength.

Also, a portion on one side of the conductor antenna may be coupled to an upper face of the base body and a portion on the other side of the conductor antenna may be coupled to a rear of the board.

Moreover, in the antenna device having the above configurations, to the base body may be connected a portion on one end of the conductor antenna and a conductor pattern that enables adjustment of transmitting and receiving frequencies. In the above configuration, by performing a machining process of shaving part of the conductor pattern, a degree of capacitive coupling to the conductor antenna can be changed, thus enabling the adjustment of transmitting/receiving frequencies of the antenna device.

Furthermore, according to the present invention, the antenna device having the above configurations is embedded into a wireless communication apparatus, which can provide the multi-band type wireless communication device. The antenna device enables the achievement of the space-saving profile of the antenna device to be embedded and an increase in a degree of freedom of layout for the antenna device in a case of the wireless communication apparatus and miniaturization of the wireless communication apparatus.

With the above configurations, it is made possible to realize a small-sized antenna device that can operate in wide bands (in a multi-band) and to achieve an excellent gain and to maintain non-directivity of vertically polarized waves in each band. Therefore, when this antenna device is applied to a multi-band wireless communication apparatus such as a mobile phone or a like, antenna circuits embedded in the antenna device can be configured so as to save space, which enables an increase in a degree of freedom of designing placement (layout) of the antenna device in a case of the wireless communication apparatus and easy miniaturization of the communication apparatus.

BRIEF DESCRIPTION OF THE DRAWINGS

The above and other objects, advantages, and features of the present invention will be more apparent from the following description taken in conjunction with the accompanying drawings in which:

FIG. 10 is a table showing a length of each conductor antenna, a length of each base body in a longitudinal direction and radiation efficiency obtained by changing a permittivity of the base body in the first to third embodiments of the present invention;

DETAILED DESCRIPTION OF THE PREFERRED EMBODIMENTS

Figure 1:
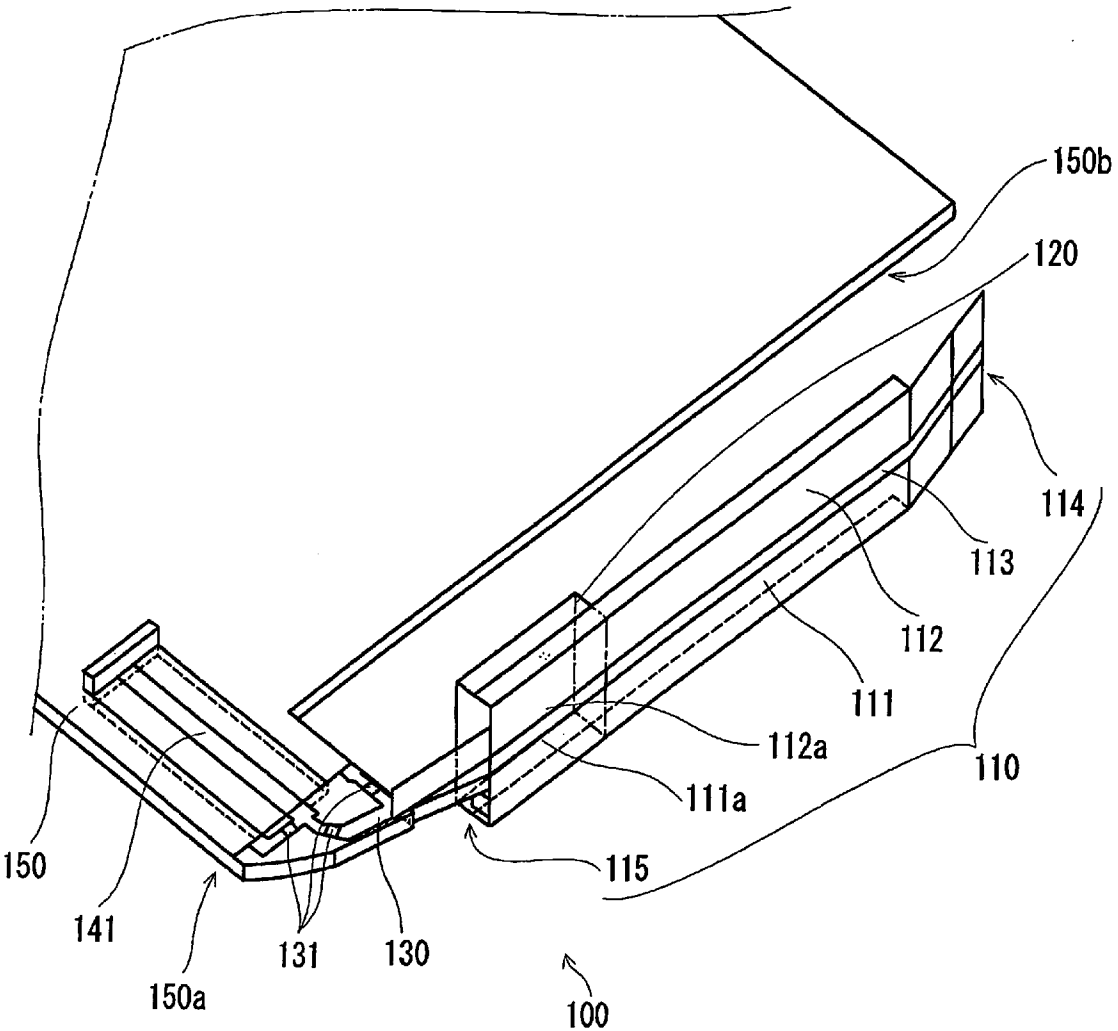
FIG. 1 is a diagram showing basic configurations of an antenna device according to the first embodiment of the present invention.
Figure 2:
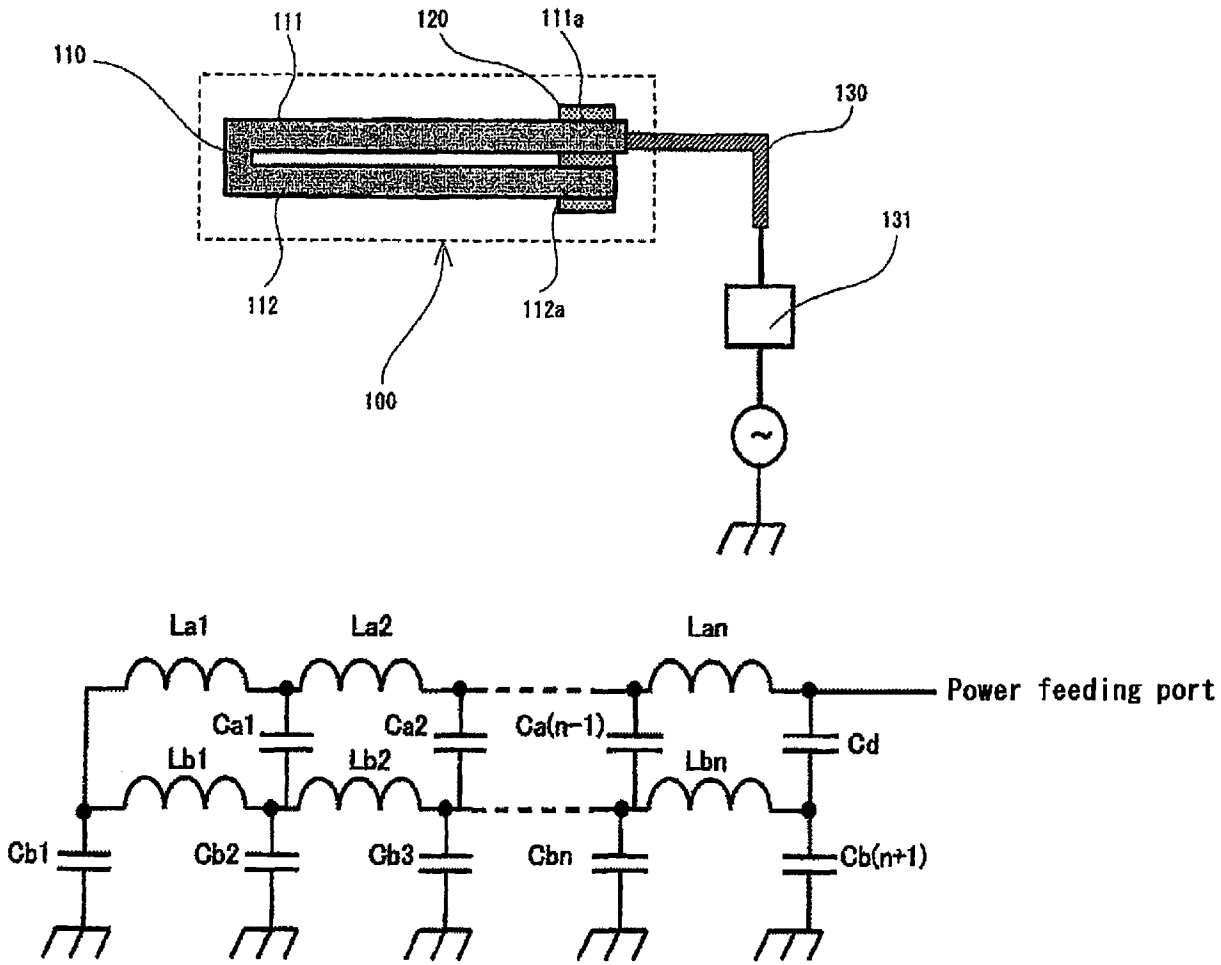
FIG. 2 is a diagram illustrating an equivalent circuit of the antenna device shown in FIG. 1.

Best modes of carrying out the present invention will be described in further detail using various embodiments with reference to the accompanying drawings. An antenna device of the first embodiment of the present invention is explained by referring to FIG. 1 to FIG. 4. FIG. 1 is a diagram showing basic configurations of an antenna device of the first embodiment of the present invention. FIG. 2 is a diagram illustrating an equivalent circuit of the antenna device of FIG. 1. The antenna device 100, as shown in FIG. 1, includes a conductor antenna 110 and a base body 120.

The conductor antenna 110 is made up of a metal plate (metal conductive plate) so as to be approximately U-shaped in which a power feeding portion is located at an end portion 111*a* of a conductor 111 on one end side in a lower portion in FIG. 1 to which the conductor antenna 110 is connected and an end portion 112*a* of a conductor 112 on the other end side in an upper portion in FIG. 1 is formed as an open end terminal. That is, the conductors 111 and 112 are placed far from each other and band-shaped space and a folded-back portion 114 are interposed between the conductors 111 and 112. Also, the coupling between the base body 120 and conductor antenna 110 is sufficiently achieved only if the base body 120 is coupled to at least either of the end portion 111*a* of the conductor 111 or to the end portion 112*a* of the conductor 112. The conductor 111 is capacitively coupled to the conductor 112 with the space 113 being interposed between the conductor 111 and conductor 112. Moreover, the plane of the conductor 111 on the one end side of the conductor antenna 110 and the plane of the conductor 112 on the other end side of the conductor antenna 110 are arranged so as to be in parallel to each other. As shown in FIG. 2, between inductances La1 and Lb1, between La2 and Lb2, . . . , between Lan and Lbn, capacitances Ca1, Ca2, . . . , Ca(n−1) exist respectively. Therefore, the space 113 provides an interval with the level at which at least capacitive coupling is assumed. Moreover, between the conductors 111 and 112 and a ground, capacitances Cb1, Cb2, Cb3, . . . , Cbn, Cb(n+1) exist respectively. The conductor antenna 110 is fabricated using a metal plate made of, for example, bronze phosphate, copper, $^{42}$Ni (nickel) or a lie and, in order to reduce a resistance value to obtain a high antenna gain and to minimize a loss, the conductor antenna 110 is given gold plating or silver plating on its surface.

The base body 120 is made of an insulating material being a dielectric material or a magnetic material (hereinafter, a dielectric material or a magnetic material is used in the descriptions) and is configured so as to have a cuboid shape and is coupled between the end portion 111*a* of the conductor 111 on one end side of the conductor antenna 110 and the end portion 112*a* of the conductor 112 on the other end side of the conductor antenna 110, that is, to the end portion 111*a* and the end portion 112*a* of the conductors 111 and 112 both facing each other. Here, the plane of the conductor 111 on the one end side of the conductor antenna 110 and the plane of the conductor 112 on the other end side are arranged so as to be in parallel to each other. Moreover, the coupling between the base body 120 and conductor antenna 110 is sufficiently achieved only if the base body 120 is coupled to at least either of the end portion 111*a* of the conductor 111 or to the end portion 112*a* of the conductor 112. The end portion 111*a* of the conductor 111 is capacitively connected to the end portion 112*a* of the conductor 112 with the base body 120 being interposed between the conductors 111 and 112 both facing each other, that is, between inductances Lan and Lbn exists a capacitance Cd. The base body 120 is made of ceramic that provides a low loss in a high frequency, such as alumina, silica, magnesium, or a like. In the case of the base body 120 made of the magnetic material, the base body is made of hexagonal ferrite of a Z-type or Y-type or a like called "planar" and composite materials containing the ferrite materials. In the case of the base body 120 made of the dielectric material, a permittivity and dielectric loss exert an influence on antenna properties.

The antenna device 100 operates in transmitting/receiving frequency bands each being different from one another. More specifically, a portion corresponding to all length (quarter length of GSM band) of the conductor antenna 110 including a folded-back portion operates in a GSM band (900 MHz band), a portion corresponding a half length (quarter length of DCS/PCS band) of the conductor antenna 110 operates in a DCS band (1700 MHz band) and PCS band (1800 MHz band), in a UMTS band (2200 MHz band). By operating as above, the antenna device 100 of a quadband type is achieved. Thus, the portion corresponding to all length (λ/4) of the conductor antenna 110 operates in the GSM band which is a frequency band being lower than the DCS and PCS bands in which the portion corresponding to a half length (λ/4) of the conductor antenna 110 operates and lower than the UMTS band in which the base body 120 containing the end portion 111*a* of the conductor 111 on the one end side of the conductor antenna 110 and the open end portion 112*a* of the conductor 112 on the other end of the conductor antenna 110 operates. Moreover, the portion corresponding to a half length (λ/4) of the conductor antenna 110 operates in both the DCS and PCS bands each being different from each other but being near to each other in terms of frequencies.

The end portion 111*a* of the conductor 111 on the one side of the conductor antenna 110 is connected through the conductor line 130 to a power feeding line 141. Between the power feeding line 141 and the conductor line 130 is mounted an impedance matching circuit made up of chip elements or a like. A main board 150 is made of a glass epoxy resin or a like and serves as a PCB (Printed Circuit Board) to be embedded in a mobile phone being one of the multi-band wireless communication apparatuses of the embodiment of the present invention described later.

In such configurations as above, power is fed to the conductor antenna 110 through the power feeding line 141 from a transmitting/receiving circuit section (not shown) mounted in the main board 150. The antenna device 100, since being formed so as to be small-sized and thin, is allowed to be mounted ahead on the edge portion 150*a* of the main board 150, not on the main board 150. Generally, if an antenna, battery, transmitting/receiving circuits, microphone, speaker, or a like are mounted in narrow space, since the antenna is made to be placed in a close vicinity of conductor portions such as the transmitting/receiving circuits, a mirror-image current of opposite phase to cancel a resonant current occurring in an antenna flows, which leads to reduction of the antenna gain. In order to suppress the influence by the mirror-image current, the antenna needs to be placed apart from the conductor portions such as transmitting/receiving circuits, or the like. Also, if a radiation electrode is placed near to the conductor portions, a capacitive component not attributable to radiation increases, which also leads to reduction of the antenna gain and a decrease in bandwidth. By configuring the antenna device 100 as above, some distance can be kept between the conductor antenna 110 and conductor portions such as a battery, transmitting/receiving circuit, microphone, speaker on which mounted the main board 150, or the like, thus enabling to realize the antenna device 100 that can operate in wide bands and achieve high-gain antenna.

Figure 3:
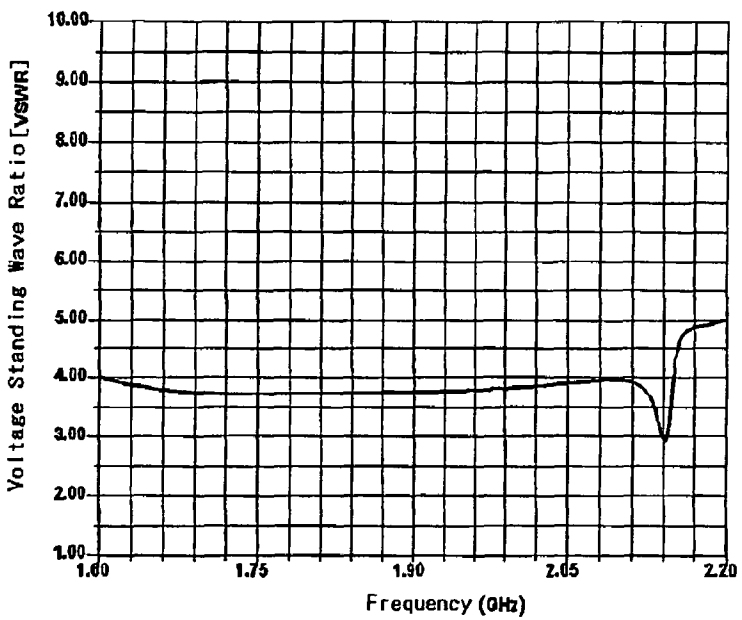
FIG. 3 is a graph showing a relation between VSWR Voltage Standing Wave Ratio) and frequency in the antenna device according to the first embodiment of the present invention.
Figure 3:
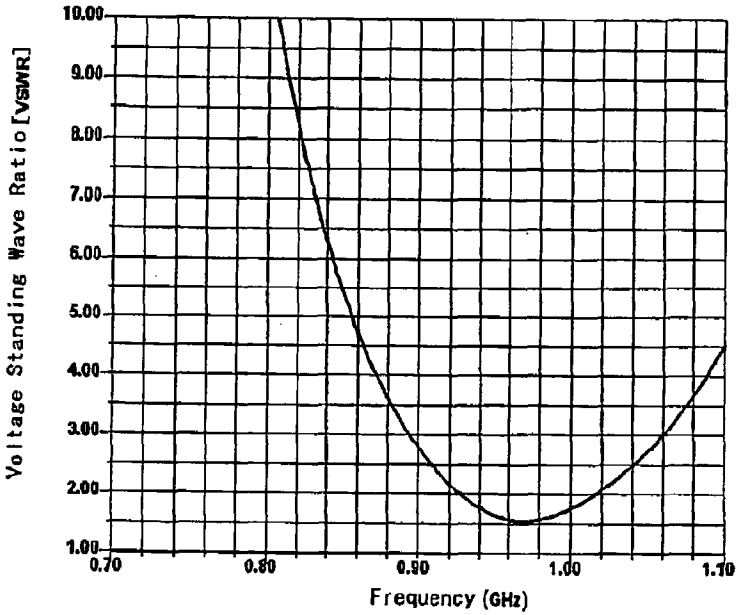

FIG. 3 is a graph showing a relation between VSWR (Voltage Standing Wave Ratio) and frequency in the antenna device 100 of the first embodiment. The VSWR is a value expressing a degree of reflection of power transmitted to the antenna device 100. The smaller the value is (the nearer to 1), the better and the effective the transmission of applied power to the antenna device 100 is and the less the reflection of the power is. The smaller value represents that the antenna property is excellent. Preferably, the VSWR is 5.00 or less in a frequency band to be used. FIG. 3 shows apparently that satisfactory antenna properties were obtained in a frequency band (860 MHz to 1100 MHz) being near to the GSM band (900 MHz band), and in a frequency band (1600 MHz to 1900 MHz) being near to the DCS (1700 MHz band) and the PCS (1800 MHz band) band and in a frequency band (2050 MHz to 2200 MHz) being near to the UMTS.

Figure 4:
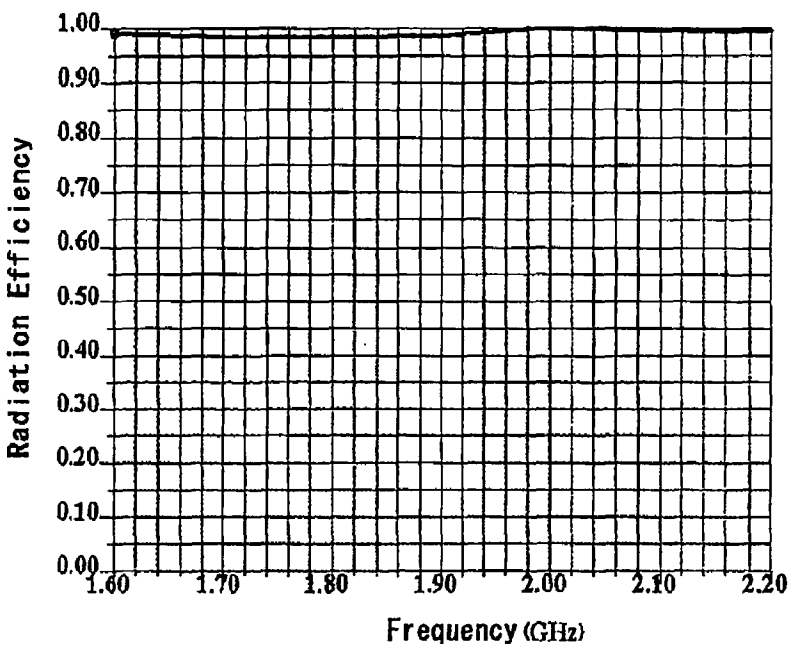
FIG. 4 is a graph showing a relation between radiation efficiency and frequency in the antenna device according to the first embodiment of the present invention.
Figure 4:
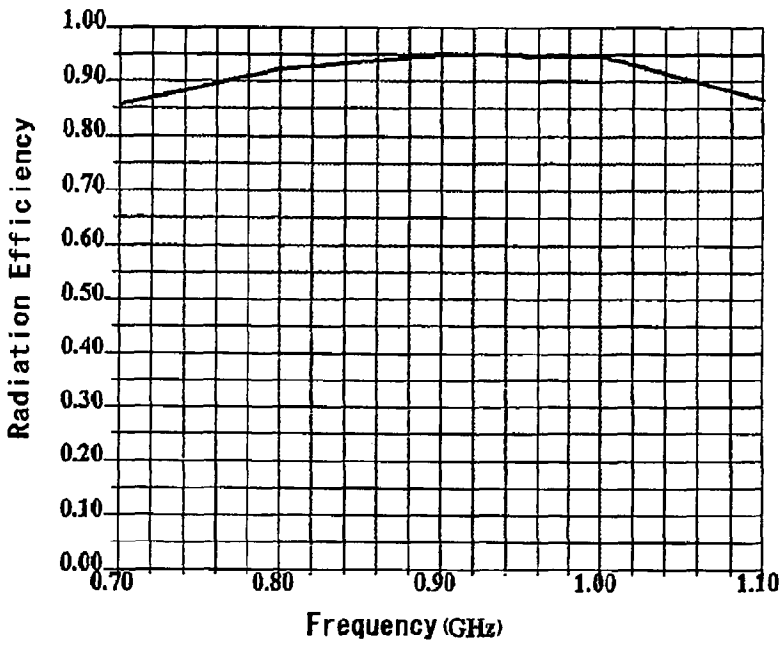

FIG. 4 is a graph showing a relation between radiation efficiency and frequency in the antenna device 100 of the first embodiment. The radiation efficiency represents how effectively power applied to the antenna device 100 is radiated into space. The larger the radiation efficiency (the nearer to 1 [100%]) is, the better the radiation efficiency is. The larger value of the radiation efficiency represents that the antenna property is excellent. Preferably, the radiation efficiency is 0.90 (90%) in a frequency band to be used. As is apparent from FIG. 4, the satisfactory radiation frequency of 0.95 (95%) or more was obtained in the GSM (900 MHz) band, of 0.98 (98%) or more in the DCS (1700 MHz) and PCS (1800 MHz) bands, and of 0.99 (99%) or more in the UMTS (2200 MHz) band.

Figure 5:
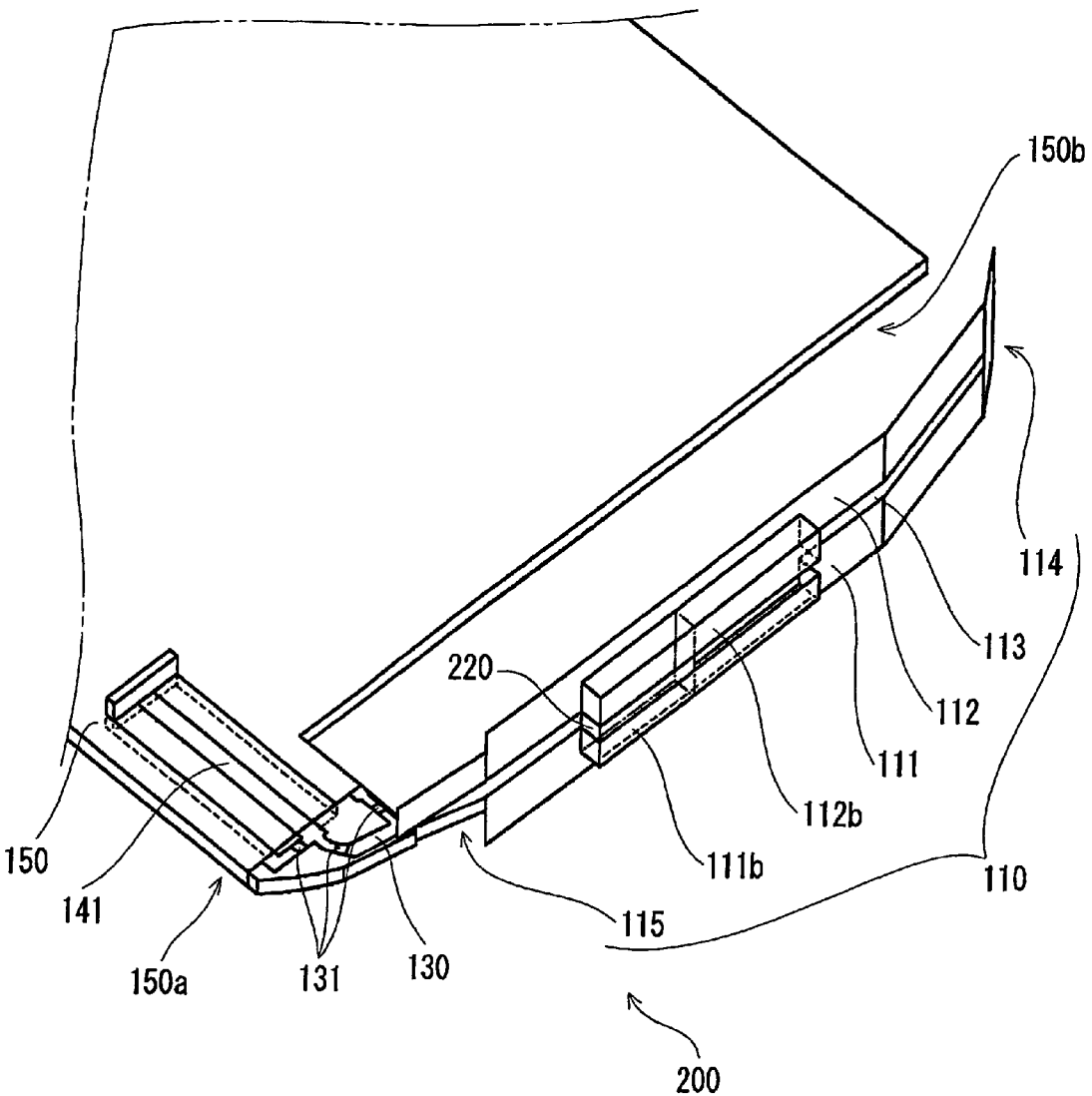
FIG. 5 is a diagram showing basic configurations of an antenna device according to the second embodiment of the present invention.
Figure 6:
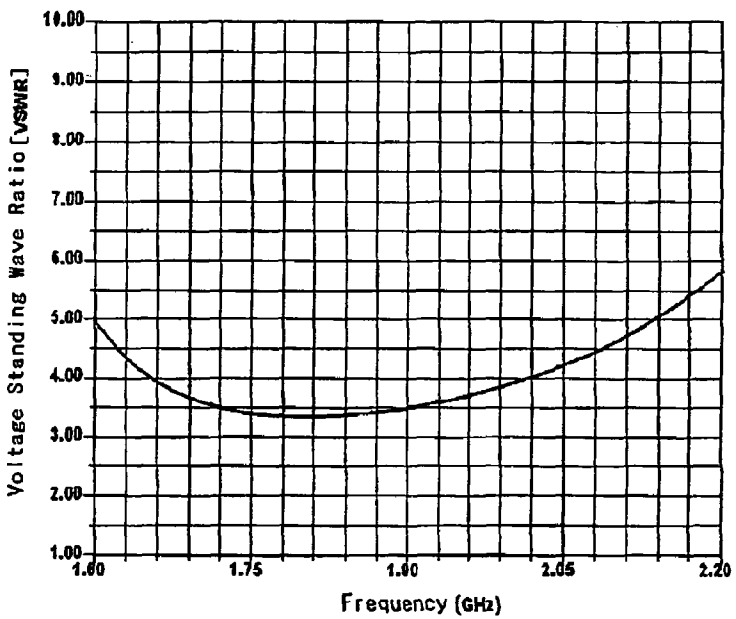
FIG. 6 is a graph showing a relation between VSWR and frequency in the antenna device shown in FIG. 5 according to the first embodiment of the present invention.
Figure 6:
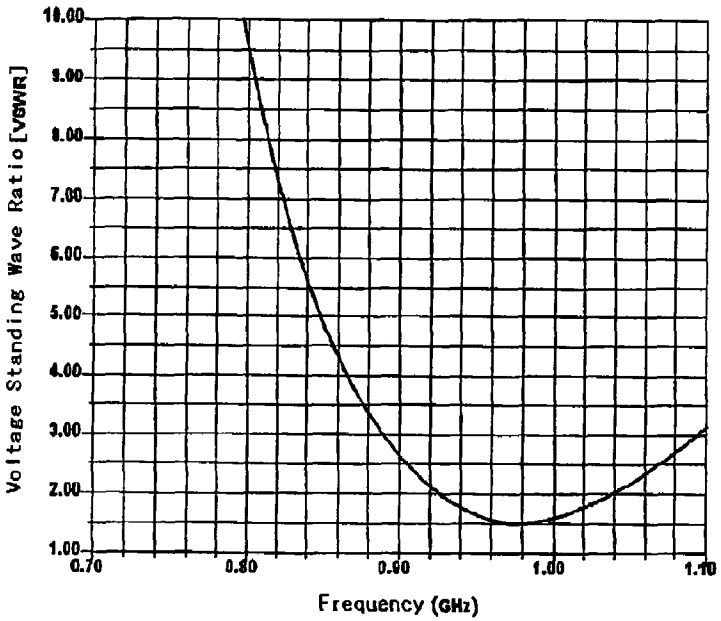

Next, an antenna device of the second embodiment of the present invention is described by referring to FIGS. 5 and 6. FIG. 5 is the diagram showing basic configurations of the antenna device 200 according to the second embodiment of the present invention, which is shown in a manner corresponding to those shown FIG. 1. In FIG. 5, same reference numbers are assigned to components corresponding to those in FIG. 1 and their descriptions are omitted accordingly. In the antenna device 200 of the second embodiment, its base body 220 has configurations being different from those in the antenna device 100 of the first embodiment. That is, the base body 220 is made of a dielectric material and is formed to have a cuboid shape and is further coupled to a central portion 111*b* of the conductor 111 on the one end side of the conductor antenna 110 and to a central portion 112*b* of the conductor 112 on the other end side of the conductor antenna 110, that is, to the central portion 111*a* and central portion 112*a* of the conductors 111 and 112 both facing each other. Moreover, the coupling between the base body 220 and the conductors 111 and 112 is sufficiently achieved only if the base body 220 is coupled to at least either of the central portion 111*b* of the conductor 111 or to the central portion 112*b* of the conductor 112. By configuring as above, the same actions and effects as obtained in the first embodiment can also be achieved in the second embodiment.

FIG. 6 is a graph showing a relation between VSWR and frequency in the antenna device 200 shown in FIG. 5 according to the second embodiment. Preferably, the VSWR is 5. 00 in a frequency band to be used. As is apparent from FIG. 6, satisfactory antenna properties were obtained in a frequency band (860 MHz to 1100 MHz) being near to the GSM (900 MHz) band, and in a frequency band (1600 MHz to 1900 MHz) being near to the DCS (1700 MHz) and the PCS (1800 MHz) bands and in a frequency band (2050 MHz to 2200 MHz) being near to the UMTS (2200 MHz) band.

Figure 7:
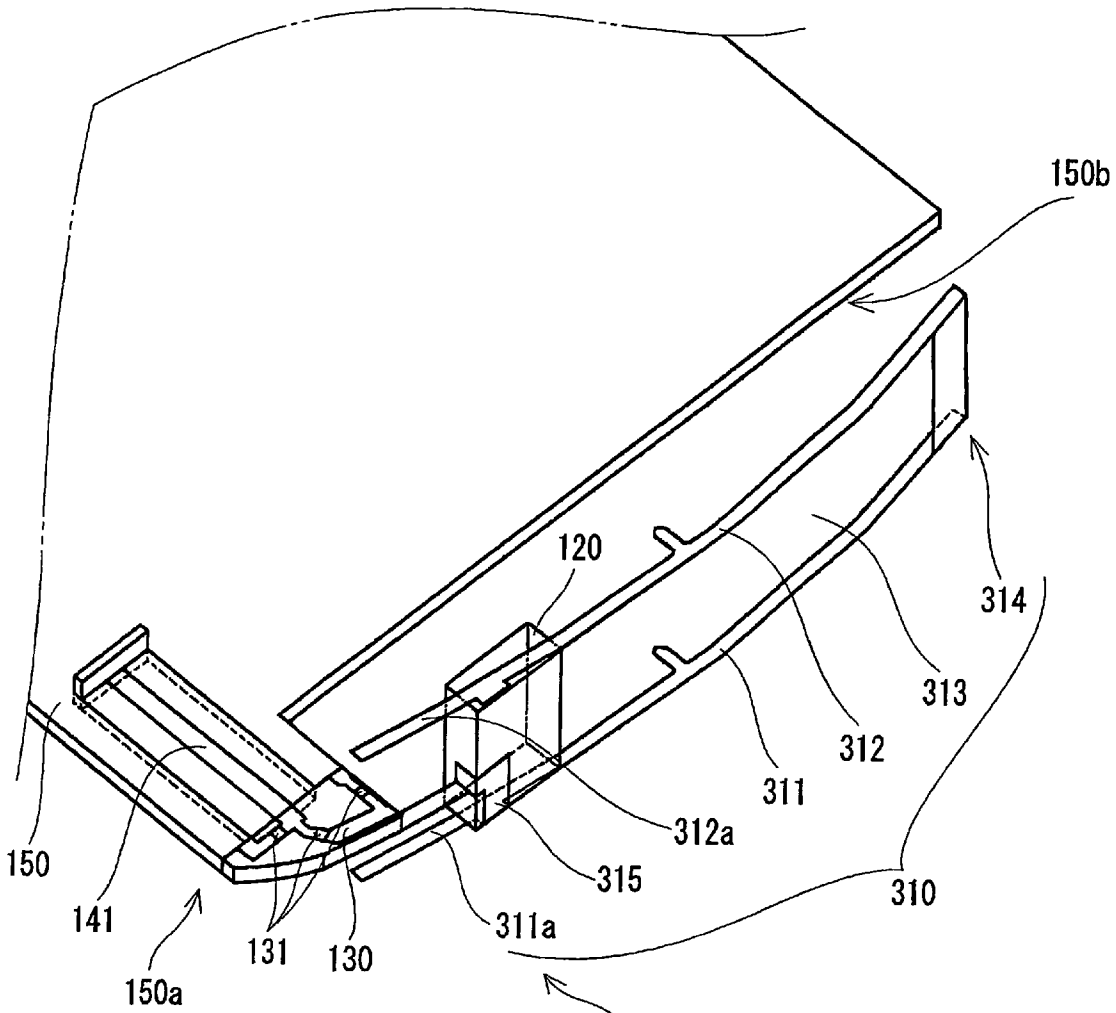
FIG. 7 is a diagram showing basic configurations of an antenna device according to the third embodiment of the present invention.
Figure 8:
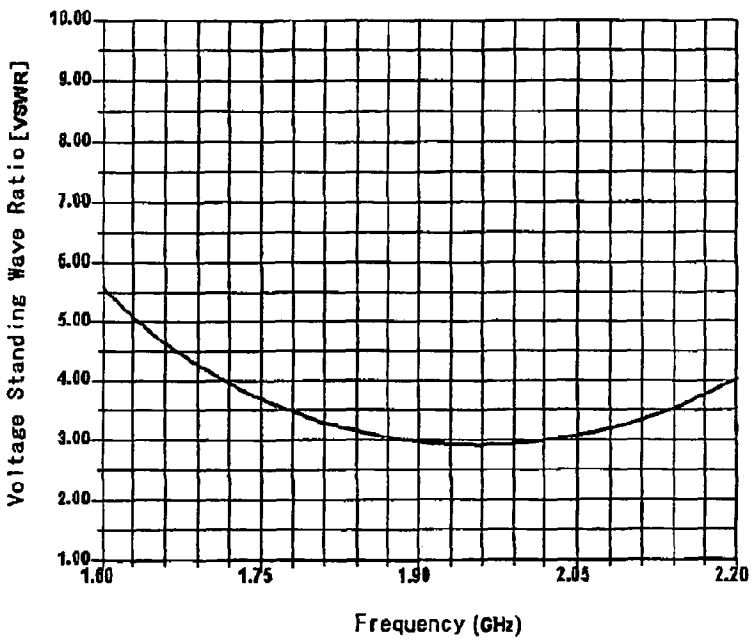
FIG. 8 is a graph showing a relation between VSWR and frequency in the antenna device shown in FIG. 7 according to the second embodiment.
Figure 8:
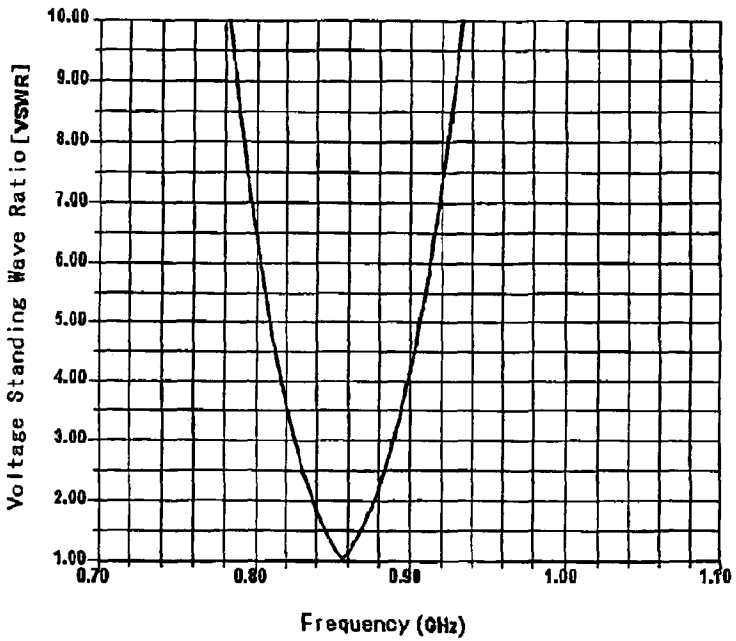

Next, an antenna device of the third embodiment of the present invention is described by referring to FIGS. 7 and 8. FIG. 7 is a diagram showing basic configurations of the antenna device 300 of the third embodiment of the present invention, which is shown in a manner to correspond to FIG. 1. In FIG. 7, same reference numbers are assigned to components corresponding to those in FIG. 1 and their descriptions are omitted accordingly. In the antenna device 300 of the third embodiment, a conductor antenna 310 has configurations being different from those of the antenna device 100 of the first embodiment. That is, the conductor antenna 310 is made up of a line material (metal conductive line) so as to be approximately U-shaped in which a power feeding portion 315, which branches from an end portion 311*a* side of the conductor 311 on one end side of the conductor antenna 310 shown in a lower portion of FIG. 7, is formed on a surface of a base body 120 and an end portion 312*a* of the conductor 312 on the other end side of the conductor antenna 310 shown in an upper portion of FIG. 7 is formed as an open end terminal. In other words, the conductors 311 and 312 are placed far from each other and between the conductors 311 and 312 are formed band-shaped space 313 and a folded-back portion 314. Also, the base body 120 is made of a dielectric material so as to have a cuboid shape and is coupled to the end portion 311*a* of the conductor 311, which faces the conductor 312, of the conductor antenna 310 and to an open end portion 312*a* of the conductor 312, which faces the conductor 311, of the conductor antenna 310 in a manner in which the base body 120 is sandwiched between the end portion 311*a* and the open end portion 312*a*. The power feeding portion 315 is formed on a side of a power feeding portion of the base body 120 in a manner being routed in and then is separated from the base body 120 and extends, in parallel to the end portion 311*a*, to be connected to a conductor line 130. Moreover, the coupling between the base body 120 and the conductors 311 and 312 is sufficiently achieved only if the base body 120 is coupled to at least either of the end portion 311*a* of the conductor 311 or to the end portion 312*a* of the conductor 312. The conductor antenna 310 is constructed by using a line material made of, for example, bronze phosphate, copper, $^{42}$Ni (nickel) or a like and, in order to reduce a resistance value to achieve a high antenna gain and to minimize a loss, the conductor antenna 310 is given gold plating or silver plating on its surface. By configuring as above, the same actions and effects as obtained by the antenna device 100 in the first embodiment can also be achieved in the third embodiment.

FIG. 8 is a graph showing a relation between VSWR and frequency in the above antenna device 300. Preferably, the VSWR is 6.00 or less. As is apparent from FIG. 8, satisfactory antenna properties were obtained in a frequency band (810 MHz to 910 MHz) being near to the GSM band (900 MHz band), and in a frequency band (1630 MHz to 1900 MHz) being near to the DCS (1700 MHz band) and the PCS (1800 MHz band) bands and in a frequency band (2050 MHz to 2200 MHz) being near to the UMTS band (2200 MHz band).

Figure 9:
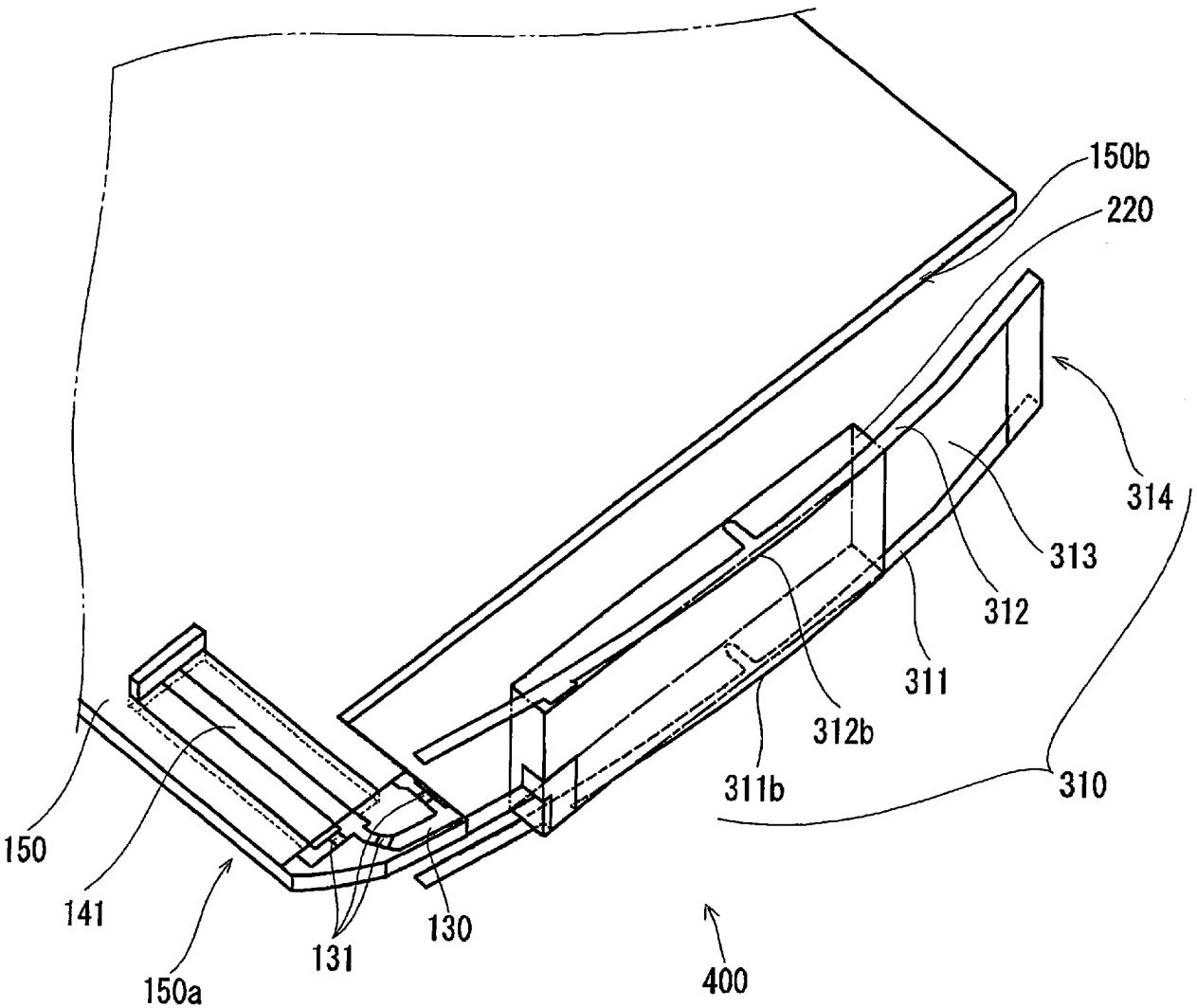
FIG. 9 is a diagram showing basic configurations of an antenna device according to the fourth embodiment of the present invention.

Next, an antenna device of the fourth embodiment of the present invention is described by referring to FIG. 9. FIG. 9 is a diagram showing basic configurations of the antenna device 400 of the fourth embodiment of the present invention, which is shown in a manner to correspond to FIGS. 5 and 7. In FIG. 9, same reference numbers are assigned to components corresponding to those in FIGS. 5 and 7 and their descriptions are omitted accordingly. The antenna device 400 of the fourth embodiment is configured by combining the conductor antenna 310 of the antenna device 300 of the third embodiment with the base body 220 of the antenna device 200 of the second embodiment. That is, the base body 220 is made of a dielectric material so as to have a cuboid shape and is coupled to a central portion 311*b* of the conductor 311 on one side of the conductor antenna 310 and to a central portion 312*b* of the conductor 312 on the other side of the conductor antenna 310 in which the conductor 311 faces the conductor 312 in a manner in which the base body is sandwiched between the central portions 311*b* and 312*b*. Moreover, the coupling between the base body 220 and the conductors 311 and 312 is sufficiently achieved only if the base body 220 is coupled to at least either of the central portion 311*b* of the conductor 311 or the central portion 312*b* of the conductor 312. By configuring as above, the same actions and effects as obtained by the antenna devices 200 and 300 in the second and third embodiment can be achieved in the fourth embodiment as well.

Figure 11:
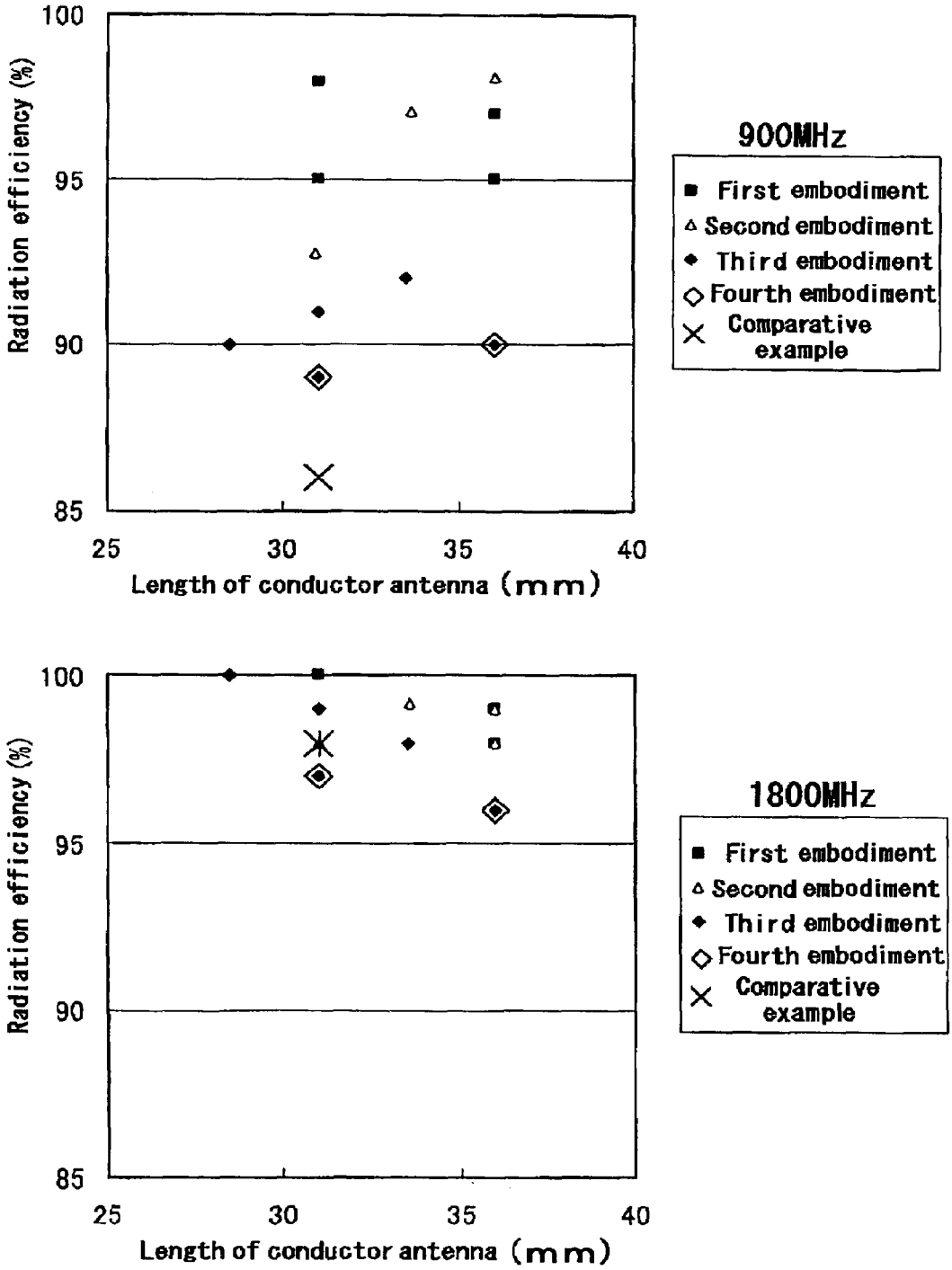
FIG. 11 is a diagram showing a relation between the radiation efficiency shown in FIG. 10 and a length of each conductor antenna according to the fourth embodiment of the present invention.

FIG. 10 is a table showing a length of each of the conductor antennas 110 to 310, a length of each of base bodies 120 and 220 in a longitudinal direction (its width and height are the same) and radiation efficiency obtained by changing a permittivity of the base body 220 obtained by changing a permittivity of the base bodies 120 and 220 in the antenna devices 100 to 400 in the first to fourth embodiments. FIG. 11 is a diagram showing a relation between the radiation efficiency shown in FIG. 10 and the length of each conductor antenna. Moreover, as a comparative example, lengths, radiation efficiency and the like of the conventional chip antenna having a radiation electrode pattern are shown on the above same table. As is apparent from FIGS. 10 and 11, the radiation efficiency of each of the antenna devices 100 to 300 and of the chip antenna of the comparative example is approximately 0.90 (90%) or more in the PCS (1800 MHz) band, however, the radiation efficiency of each of the antenna devices 100 to 300 of the embodiment of the present invention is about 0.89 (89%) or more in the GSM (900 MHz) band, whereas the radiation efficiency of the conventional chip antenna of the comparative example is 0.86 (86%). This shows that, in the PCS and GSM bands, irrespective of the length and a cross-sectional profile (of a plate-shaped conductor antenna in the first and second embodiments and of a line-shaped conductor antenna in the third and fourth embodiments) of each of the conductor antennas, length of each of the base bodies in a longitudinal direction, relative permittivity of each of the base bodies, satisfactory radiation characteristics can be obtained.

Figure 12:
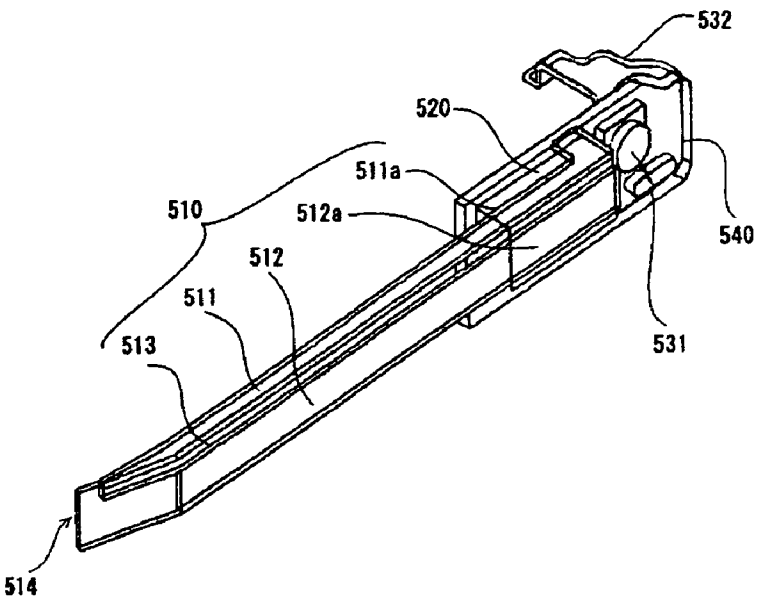
FIG. 12 is a perspective view of examples embodying the antenna device according to the first embodiment of the present invention.
Figure 12:
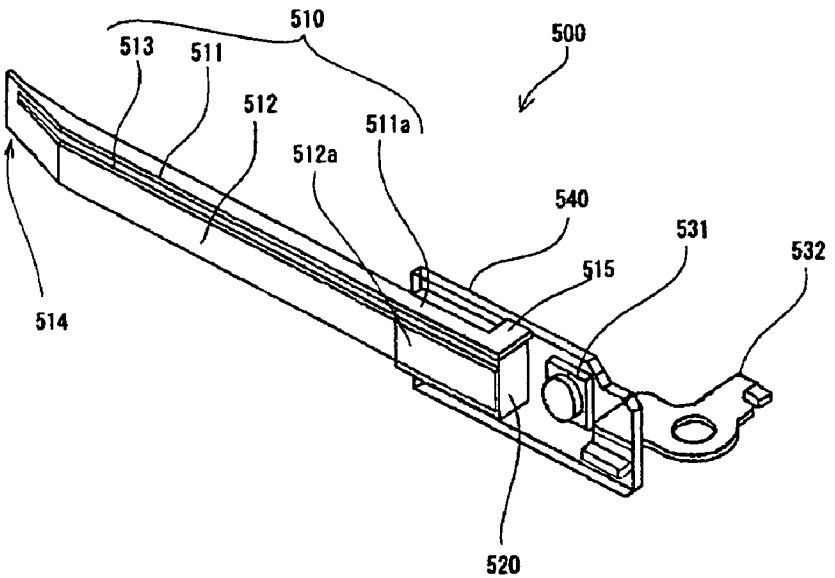
Figure 13:
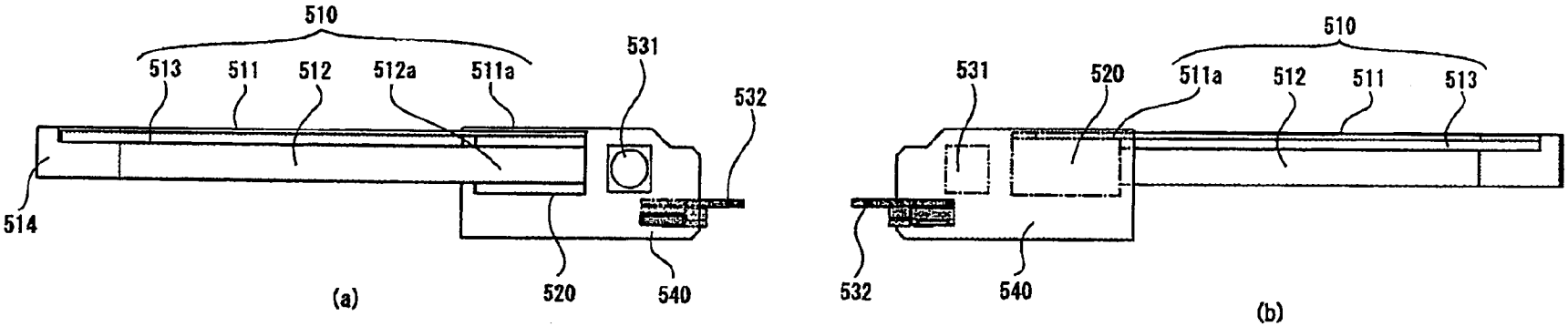
FIG. 13 is a plan view of the antenna device shown in FIG. 12.
Figure 14:
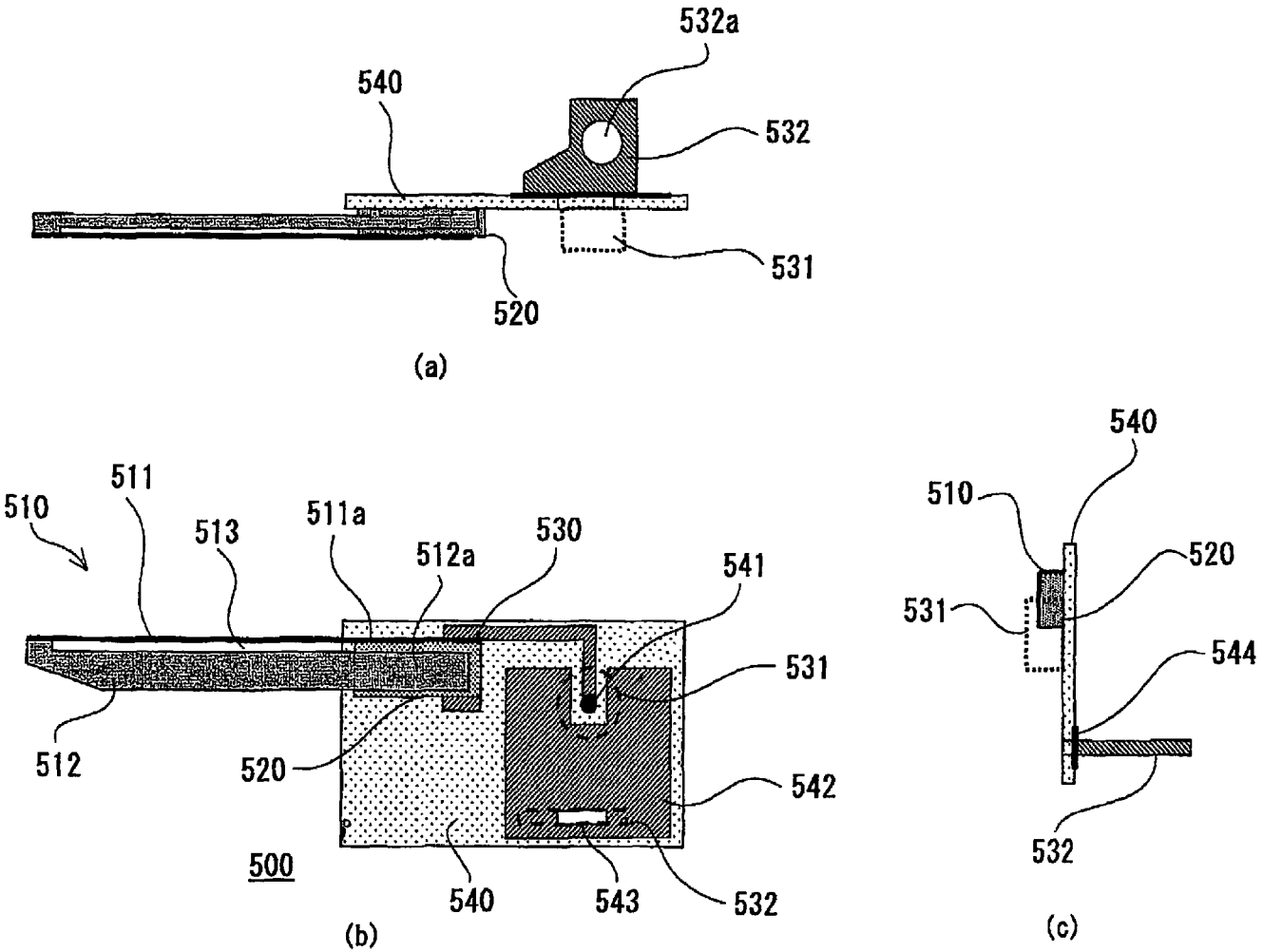
FIG. 14 is a three-view drawing showing the antenna device shown in FIG. 12.

FIGS. 12(*a*) and 12(*b*) are perspective views of examples embodying the antenna device 100 of the first embodiment. FIGS. 13(*a*) and 13(*b*) are plan views of the examples embodying the antenna device 100 of the first embodiment. FIGS. 14 (including 14[*a*], 14[*b*], and 14[*c*]) is a three-view drawing illustrating main portions of the antenna device of FIG. 12. The antenna device 500 of the fourth embodiment includes a conductor antenna 510, a base body 520, a conductor line 530 (see FIG. 14[*b*]), a power feeding connector 531, and a mounting hardware 532, all of which are mounted on a sub-board 540. The antenna device 500 is formed so as to be small-sized and to be thin and, therefore, besides a main board (not shown), the sub-board 540 can be provided. By configuring as above, some distance can be kept between the conductor antenna 510 and base body 520 and conducting portions such as an edge portion 550*b* (see FIG. 16), which serves as a grounding terminal, of the main board, the antenna made up of the conductor antenna 510 and base body 520 can operate in wide bands with high antenna gain obtained.

The conductor antenna 510 is made up of a metal plate so as to be approximately U-shaped in which the conductor antenna 510 is folded so that a plane portion of a conductor 511 on one end side of the conductor antenna 510 shown in an upper portion of FIG. 12(*b*) is vertical with respect to a plane portion of a conductor 512 on the other end side of the conductor antenna 510 and a power feeding section 515 is formed in an end portion 511*a* of the conductor 511 on the one end side and an end portion 512*a* of the conductor 512 on the other end side is formed as an open end terminal. That is, the conductors 511 and 512 are placed far from each other, and between the conductors 511 and 512 are interposed a band-shaped space 513 and a folded-back portion 514. The conductor antenna 510 is made up of a metal plate with a thickness of 0.3 mm so as to be 32.5 mm in length and, in order to reduce a resistance value to achieve high antenna gain and to minimize a loss, gold plating is given to its surface. The antenna device 510 is configured so that a width of the conductor 511 on its one end side is narrower than that of the conductor 512 on its other end side. The reason for this is that, by making narrow a width (see FIG. 17) of the conductor 511 of the conductor antenna 510 placed nearer to a grounding portion (see FIG. 16), portions being parallel to the edge portion 550*b* of the main board 550 serving as the grounding terminal or to a case-side metal section 11 are decreased and portions being vertical with respect to the edge portion 550*b* and the metal portion 550 are increased, which enables the conductor antenna 510 to be positioned far from the grounding portion and capacitive coupling components between the conductor antenna 510 and the grounding terminal are reduced and, as a result, a bandwidth providing a gain exceeding a specified level can be widened. This enables a lower band such as a GSM (900 MHz) band to provide high gain. Therefore, in order to achieve a high antenna gain in wide bands such as DCS (1700 MHz), PCS (1800 MHz), and UMTS (2200 MHz) bands, a width of the conductor 511 on the one end side needs to be wider than that of the conductor 512 on the other end side of the conductor antenna 510.

The base body 520 is made of a dielectric material or magnetic material so as to have a cuboid shape and is coupled between the end portion 511*a* of the conductor 511 on the one end side of the conductor antenna 510 and the open end portion 512*a* of the conductor 512 on the other end of the conductor antenna 510, that is, to the end portion 511*a* of the conductor 511 facing the conductor 512 and the end portion 512*a* of the conductor 512 facing the conductor 511, by using an adhesive, in a manner in which the base body 520 is sandwiched between the end portions 511*a* and 512*a*. Moreover, to achieve this coupling, alternatively, an electrode may be formed by doing screen printing on a face where the base body 520 is coupled to the conductor antenna 510 and the electrode may be coupled to the conductor antenna 510 by soldering. The base body 520 is made of ceramic, that provides a low loss in high frequencies, such as alumina, silica, magnesium, or a like so as to be 5.5 mm×3 mm×2 mm in size.

On one surface of the sub-board 540 are mounted the end portion 511*a* of the conductor 511, the base body 520, and the power feeding connector 531 on one end side of the conductor antenna 510 and, on the other surface of the sub-board 540 is mounted a mounting hardware 632. The power feeding connector 531, as shown in FIG. 14(*b*), is connected to a power feeding point 541 and a grounding portion 542, both being printed on the sub-board 540. The power feeding point 541 is connected to the end portion 511*a* of the conductor 511 on the one end side of the conductor antenna 510 through the conductor line 530 and the grounding portion 542 is connected to the mounting hardware 532 and soldered portion 544 via a through-hole formed in the sub-board 540. A mounting hole 532*a* is formed in the mounting hardware 532, which is used for connection to the ground in a shared manner. Moreover, alternatively, between the power feeding point 541 and the conductor antenna 510 may be mounted a matching circuit.

Figure 15:
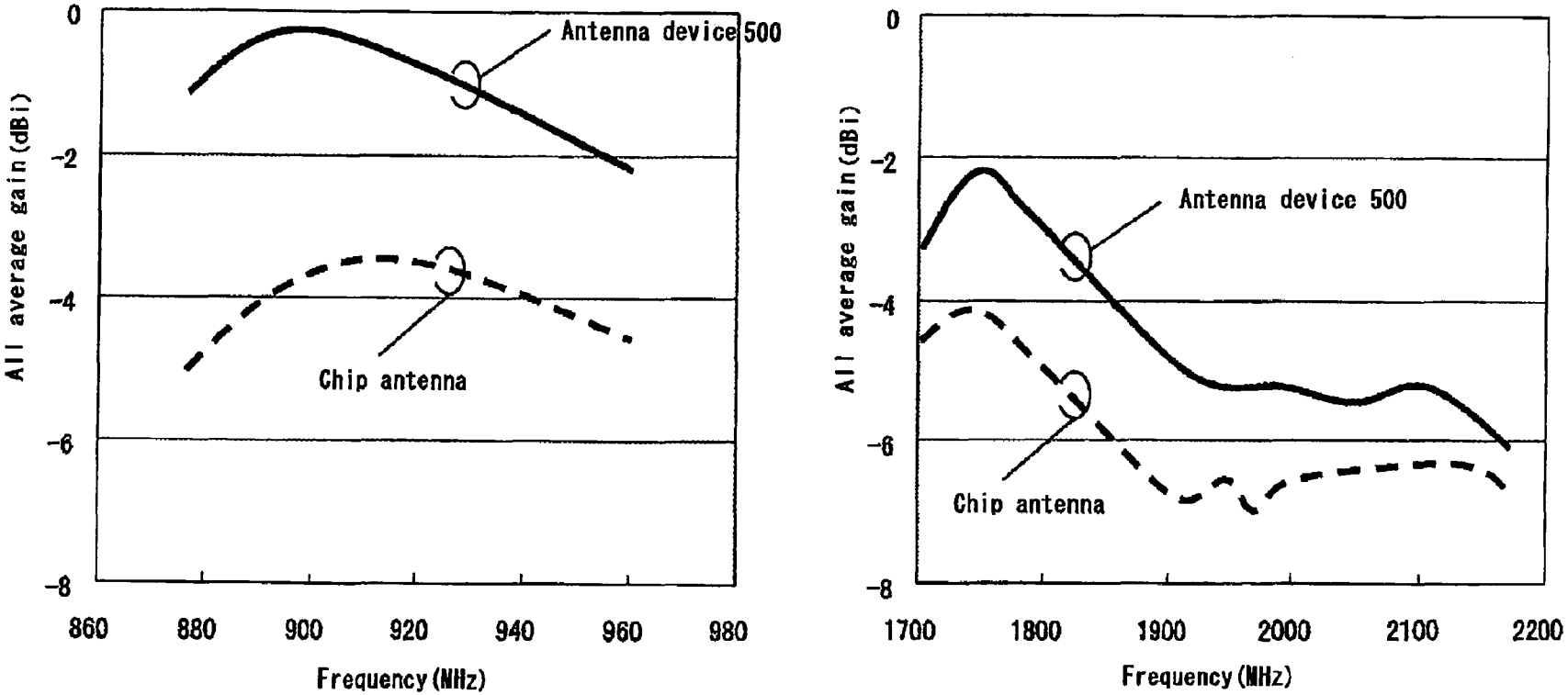
FIG. 15 is a diagram showing a relation between all average gain and frequency of the antenna device shown in FIG. 12 and of a conventional chip antenna.

FIG. 15 is a diagram showing a relation between all average gain and frequency of the antenna device 500 described above and of the conventional chip antenna. As is apparent from FIG. 15, all average gain of the antenna device 500 is by 3 dBi higher than that of the chip antenna in the GSM (900 MHz) band, by 2 dBi higher than that of the chip antenna in the DCS (1700 MHz) and PCS (1800 MHz) bands and by 0.5 dBi higher than that of chip antenna in the UMTS (2200 MHz) band. This shows that satisfactory properties were obtained in the bands to be used.

Figure 16:
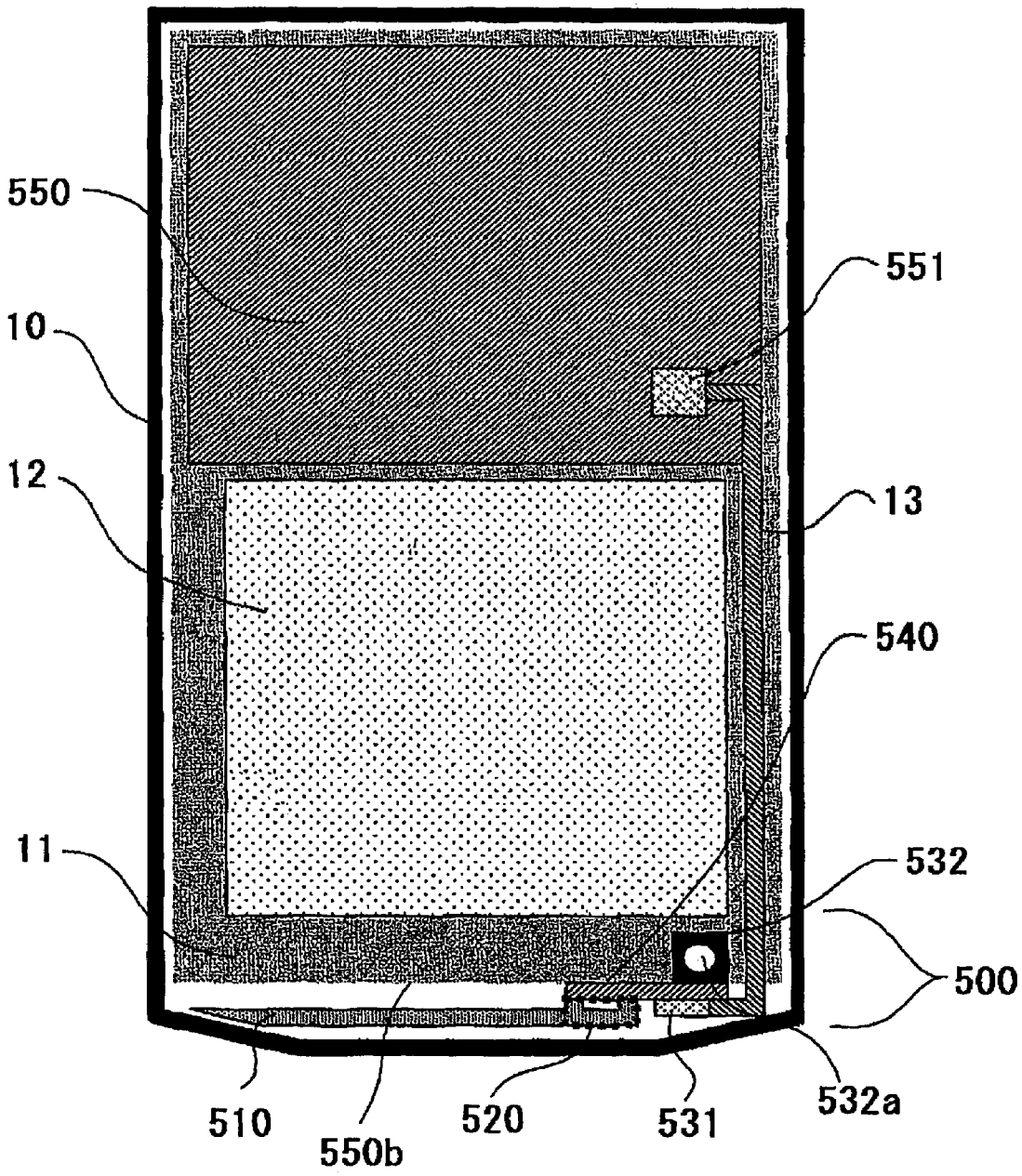
FIG. 16 is a diagram showing an example in which the antenna device shown in FIG. 12 is applied to a mobile phone being one of multi-band wireless communication apparatuses.

Next, other mode of the present invention is described in which the antenna device 500 having the above configurations is embedded in a multi-band wireless communication apparatus. FIG. 16 is a diagram showing an example in which the above antenna device 500 is applied to a mobile phone being one of multi-band wireless communication apparatuses. In the case 10 of the mobile phone is housed the case-side metal section 11 being some smaller than the case 10. In a region corresponding to an upper half shown in FIG. 16 in the case-side metal section 11 is arranged a main board 550 and in a region corresponding to a lower half shown in FIG. 16 is arranged a battery 12, and in a region corresponding to an end portion shown in FIG. 16 is arranged the antenna device 500, in which the main board 550, battery 12, and antenna device 500 mounted and the case 11 are fastened with a screw fitted into the mounting hole 532*a* of the mounting hardware 532 in a fixed manner. A connector 551 mounted on the main board 550 is connected to a power-feeding connector 531 mounted on the sub-board 540 of the antenna device 500 via a power-feeding coaxial cable 13. By configuring as above, power is fed from a transmitting/receiving circuit (not shown) mounted on the main board 550 to each of the conductor antenna 510 and base body 520. Since some distance is kept between the conductor antenna 510 and base body 520 and the conductor portions including the edge portion 550*b* of the mail board 550 serving as a grounding terminal, the conductor antenna 510 and base body 520 operate as a wide-band and high-gain antenna.

Figure 17:
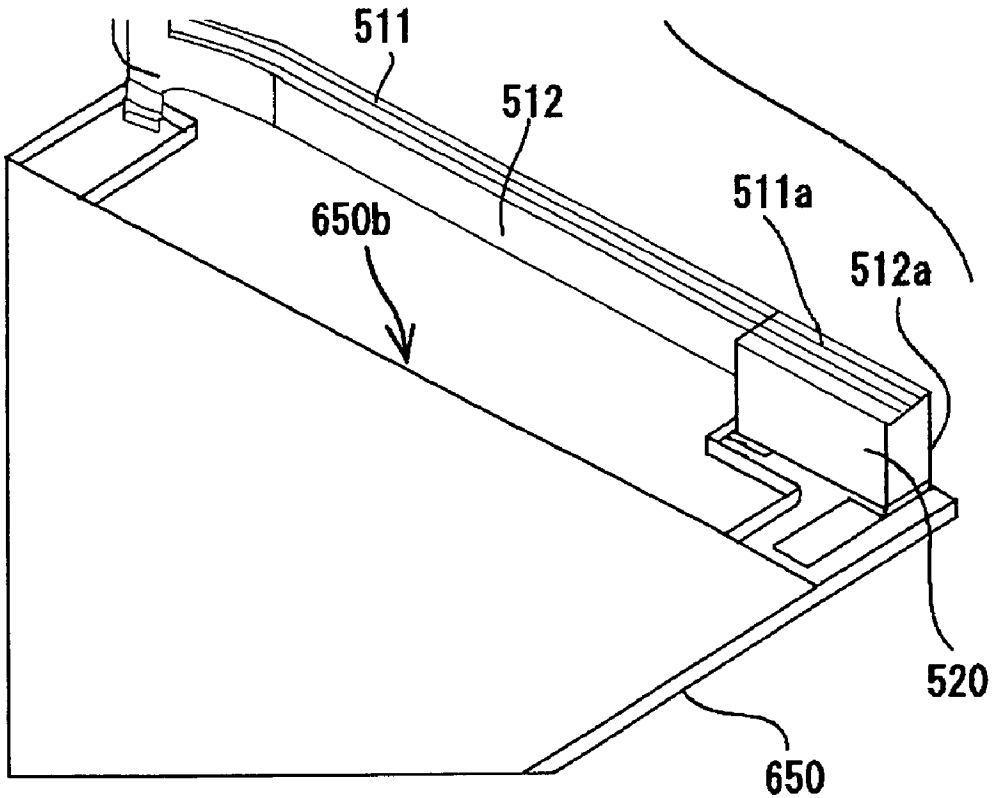
FIG. 17 is a diagram showing a modified example of the antenna device according to the first embodiment of the present invention.

FIG. 17 is a perspective view of a modified example of the antenna device 100 of the first embodiment and, in FIG. 17, same reference numbers are assigned to components corresponding to those in the first embodiment and their descriptions are omitted accordingly. The antenna device 600 of the modified example has no sub-board 540 on which a mounting hardware 532 is mounted. In the antenna device 600, an end portion 511*a* of a conductor 511 on one end side of a conductor antenna 510 and a base body 520 are mounted directly on a main board 650 and the conductor 511 on the one end side of the conductor antenna 510 and a folded-back portion 514 of the conductor 512 on the other end of the conductor antenna 510 are also mounted directly on the main board 650. By configuring as above, the same actions and effects as obtained by the above antenna device 500 can be achieved by the antenna device 600 of the modified example and, therefore, its handling is made easy at a time of assembling the antenna device 600 and the mobile phone having the antenna device 600 can maintain its strength even when receiving external force. Moreover, in the modified example shown in FIG. 12, by making the sub-board 540 wider enough to house the entire conductor antenna 510 and by fixing the folded-back portion 514 to the sub-board 540, the conductor antenna 510 can be secured stably to the sub-board 540. In the case where the entire conductor antenna 510 is housed totally on the sub-board 540, by mounting a plurality of pieces of the mounting hardware 532 for example, on both sides of the sub-board 540), the antenna device can be stably and reliably secured in a multi-band wireless communication apparatus.

Figure 18:
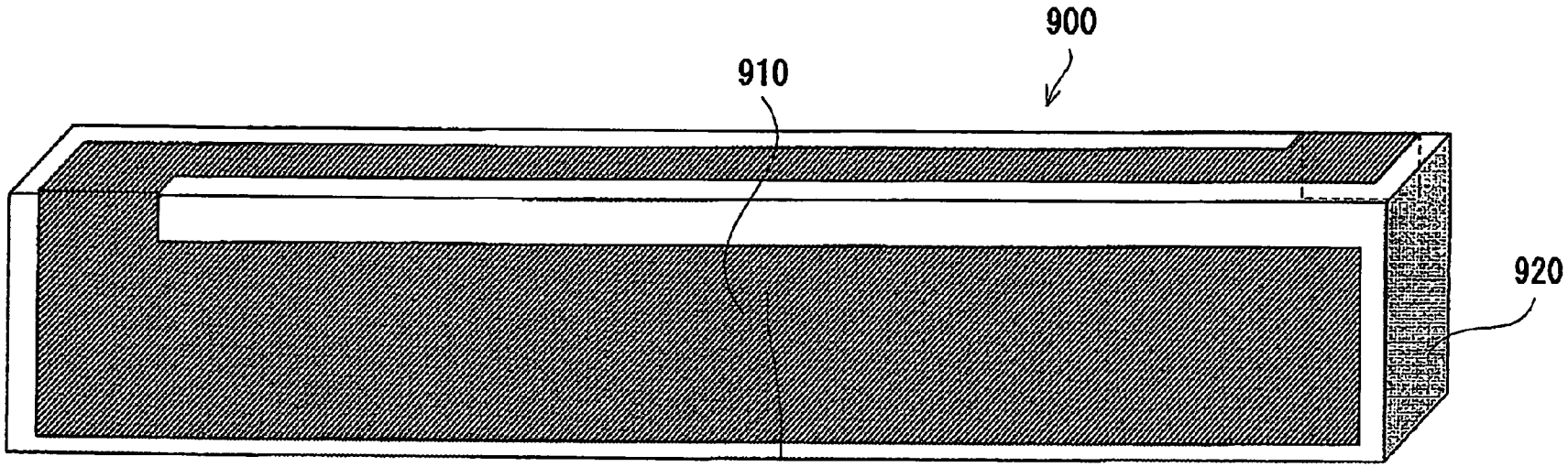
FIG. 18 is a perspective view of an antenna device according to the fifth embodiment of the present invention.
Figure 19:
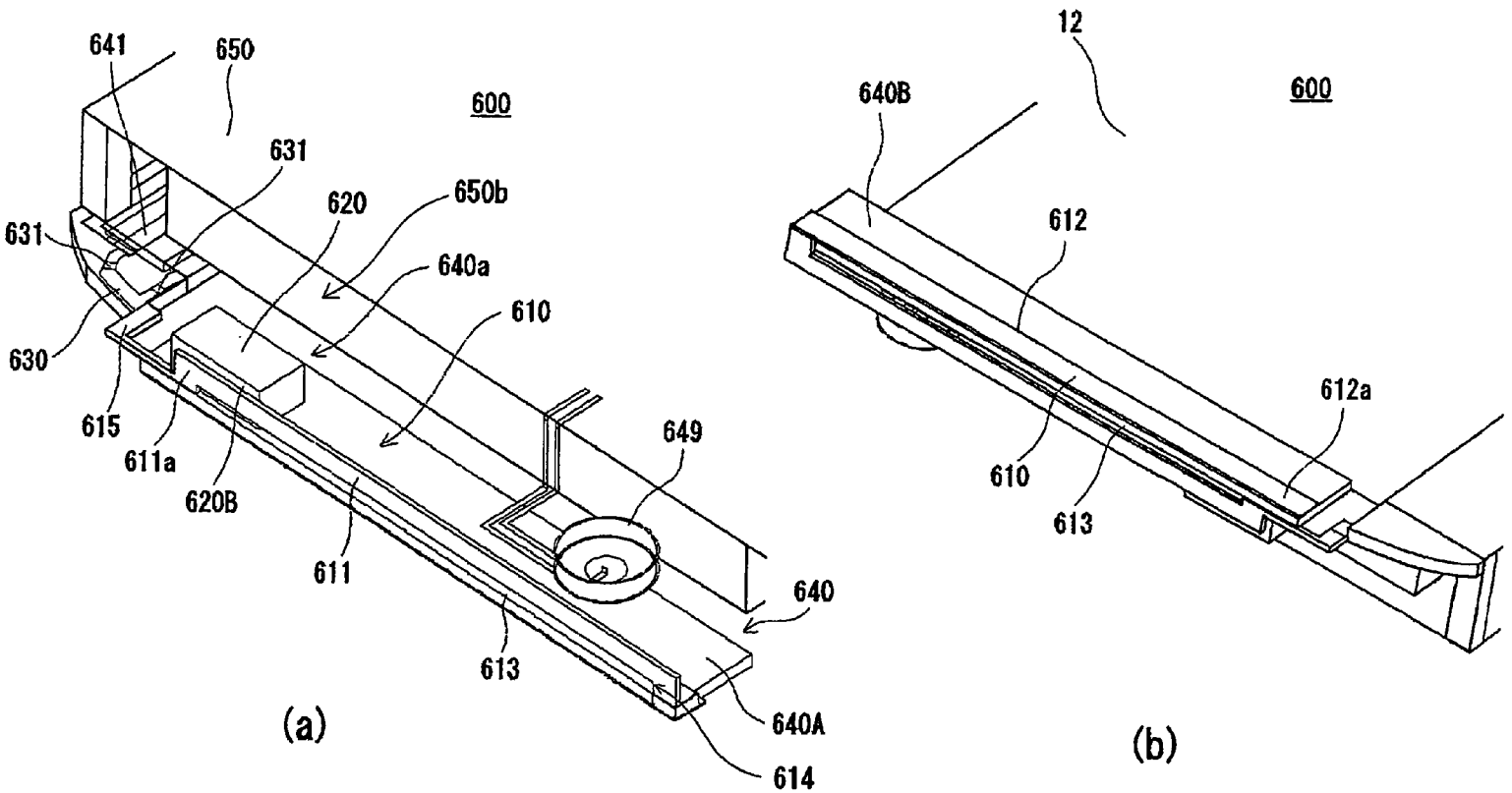
FIG. 19 is a diagram showing basic configurations of an antenna device according to the sixth embodiment and FIG. 19(*a*) is a perspective view of the antenna device mounted on a sub-board together with part of the sub-board is seen from a surface of a main board and FIG. 19(*b*) is a perspective view of the antenna device mounted on the sub-board seen from a rear of part of the main board and the sub-board.

FIG. 18 is a perspective view of an antenna device of the sixth embodiment of the present invention, which is similar to an antenna device used in the sixth embodiment shown in FIG. 19 that is configured by lengthening a base body 620 and by printing all portions of conductors 611 and 612 on the base body 620 as a conductive film. The antenna device 900 of the sixth embodiment is so configured that its base body is made longer and a metal conductive film is printed on a surface of the base body 620 by using a screen printing method, deposition method, or a like and its conductor antenna 910 is formed so as to be approximately U-shaped. A shape of the metal conductive film can be selected, as appropriate, from a line shape, crank shape, meandering shape, helical shape, or a like. By configuring as above, the same actions and effects as obtained by the antenna devices 100 to 600 can be achieved by the antenna device 900 of the sixth embodiment. Also, alternately, the antenna device 900 may be constructed by sticking metal conductive foil of a specified shape to the base body 920. In the case of application of the antenna device 900 to a mobile phone (operating in the GSM, DCS, PCS, and UMTS bands), when ceramic being 25 mm to 30 mm in length, 2 mm to 4 mm in width, 2 mm to 4 mm in height, 5 to 10 in permittivity is used as its base body, the gain, sensitivity, and bandwidth of the antenna device 900 proved to be the best.

Figure 20:
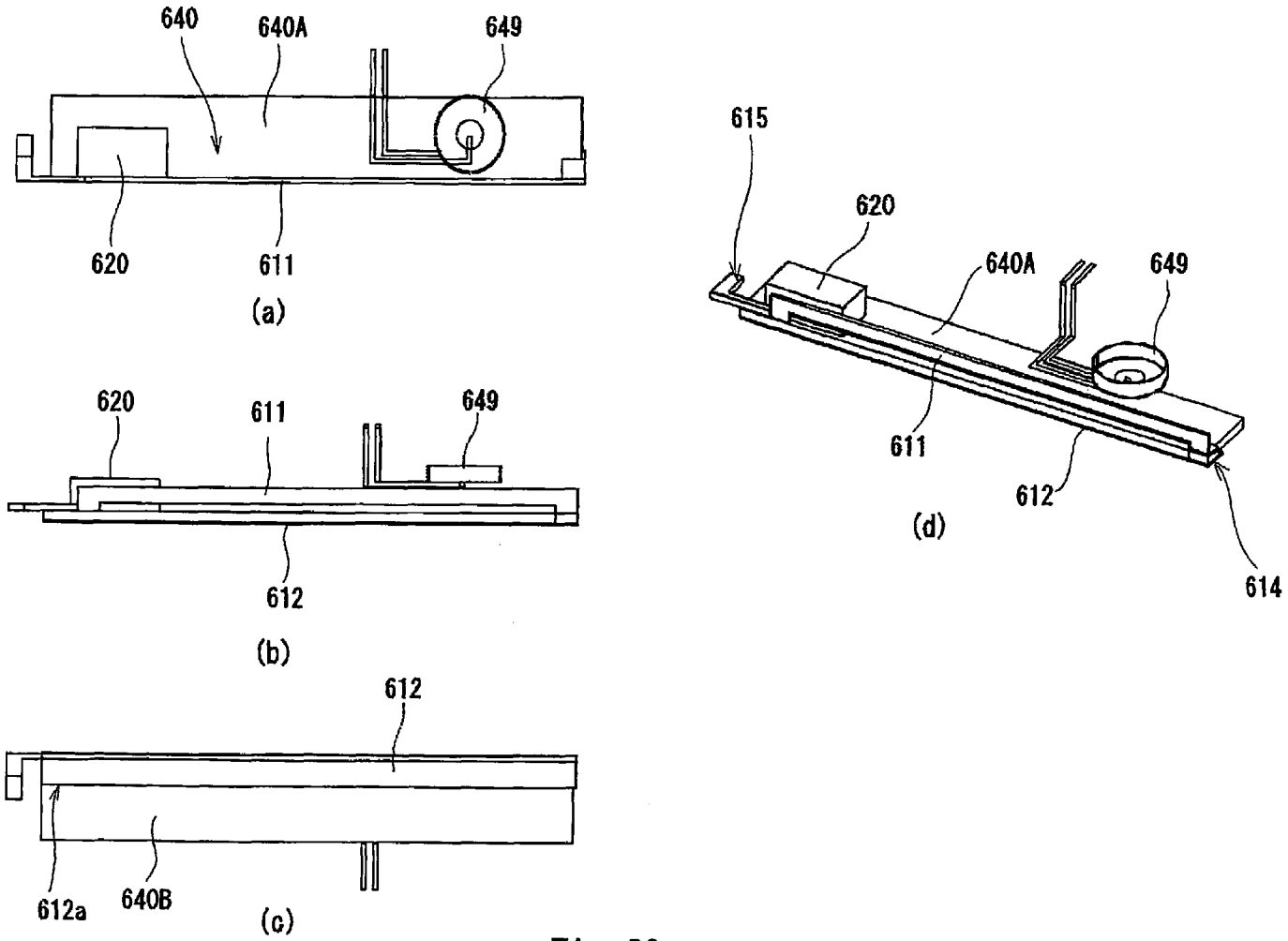
FIG. 20 is a diagram illustrating the antenna device according to the sixth embodiment of the present invention and FIG. 20(*a*) is its plan view, FIG. 20(*b*) is its side view, and FIG. 20(*c*) is its bottom plan view.

Next, an antenna device of the sixth embodiment of the present invention is described by referring to FIGS. 19 and 20. FIG. 19 is a diagram showing basic configurations of the antenna device of the sixth embodiment and FIG. 19(*a*) is a perspective view of the antenna device mounted on the sub-board and part of the main board viewed from a board and FIG. 19(*b*) is a perspective view of the antenna device mounted on the sub-board from a rear of part of the main board. FIG. 20 is a diagram illustrating the antenna device 600 of the sixth embodiment and FIG. 20(*a*) is its plan view, FIG. 20(*b*) is its side view, FIG. 20(*c*) is its bottom plan view, FIG. 20(*d*) is its perspective view. The antenna device 600 includes a conductor antenna 610 and a base body 620, both of which are mounted on the sub-board 640.

The conductor antenna 610 is configured so as to be approximately U-shaped in which the conductor antenna 610 is formed so that a plane portion of a conductor 611 on one end side of the conductor antenna 610 shown in an upper portion of FIG. 19(*a*) is vertical with respect to a plane portion of a conductor 612 on the other end side of the conductor antenna 610 and a power feeding section 615 is formed in an end portion 611*a* of the conductor 611 on the one end side and an end portion 612*a* of the conductor 612 on the other end side is formed as an open end terminal. That is, the conductors 611 and 612 are placed far from each other and between the conductors 611 and 612 is formed band-shaped space 613 and a folded-back portion 614. The conductor 611 on the one end side of the conductor antenna 610 is made up of a metal plate with a thickness of 0.3 mm so as to be 32.5 mm in length and, in order to reduce a resistance value to achieve high antenna gain and to minimize a loss, gold plating is given to its surface. More specifically, the conductor 611 is constructed of a plate metal made of bronze phosphate so as to be 32.5 mm in length to form a long-length ⊃-shaped profile and is mounted (in a stood state) so that the ⊃-shaped concave portion forms band-shaped space 613 between the conductor 611 and the main surface 640A of the sub-board 640.

The base body 620 is made of a dielectric material so as to have a cuboid shape and is surface-mounted on an end portion 640*a* of the main surface 640A of the sub-board 640. The base body 620 is made of ceramic, that provides a low loss in high frequencies, such as alumina, silica, magnesium, or a like so as to be 5.5 mm×3 m×2 mm in size.

The base body 620 may be made of not only a dielectric material but also a magnetic material. In the case of using the magnetic material, as the magnetic material substance for the base body 620, Z-type or Y-type hexagonal ferrite called "planar" or composite materials containing these ferrite materials, or a like can be used. Preferably, a sintered body of ferrite is used and, more preferably, Y-type ferrite is employed. The sintered body of ferrite has a high volume resistivity and is advantageous in terms of its insulation effects against a conductor. The use of ferrite having high volume resistivity makes it unnecessary to provide insulating coating against the conductor. Y-type ferrite can maintain its magnetic permeability in a high-frequency up to 1 GHz and a magnetic loss is small in a frequency up to 1 GHz. The sintered body of Y-type ferrite includes not only Y-type ferrite of a single phase but also ferrite of other phase such as Z-type ferrite, W-type ferrite, or a like. The base body 620 made of the magnetic material, as in the case of using the dielectric material, can be formed so as to have a cuboid shape and to be 5.5 mm×3 mm×2 mm in size.

The base body 620 is placed between the conductor 611 on one end side of the conductor antenna 610 and the conductor 612 on the other end side and its side surface 620B is coupled to the conductor 611 on the one end side of the conductor antenna 610. That is, on an end portion 640*a* of the main surface 640A on the sub-board 640 is surface-mounted the base body 620 and to its side surface 620B is coupled an end portion 611*a* of the conductor 611 on the one end side of the conductor antenna 610 by using an adhesive. Moreover, though not shown, alternatively, an electrode may be formed by screen printing on a coupled face between the side surface 620B of the base body 620 and the end portion 611*a* of the conductor 611 on the one end side of the conductor antenna 610 and the electrode may be coupled to the end portion 611*a* by a soldering method.

The conductor 612 on the other end side of the conductor antenna 610 is surface-mounted in a portion which faces the conductor 611 on a rear surface 640B on the sub-board 640 along a direction of a length of the sub-board 640. More specifically, the conductor 612 is made up of foil having a specified width and is formed on the rear surface 640B of the sub-board along the direction of a length of the sub-board 640. A ⊃-shaped end portion molded-back portion 614) placed on an opposite side to the end portion 611*a*, which has the long-length ⊃-shaped profile, of the conductor 611 on the one end side of the conductor antenna 610 is extended up to the rear surface 640B of the sub-board 640 and is then bent and, on the bent end portion is formed the conductor 612 on the other end side of the conductor antenna 610, which causes the conductor 611 to be electrically connected to the conductor 612. Moreover, alternatively, the ⊃-shaped end portion (folded-back portion 614) of the conductor 611 on the one side of the conductor antenna 610 may be folded on the main surface 640A, without being extended to the rear surface 640B side of the sub-board 640, and the folded portion may be connected to the foil conductor 612 on the other end side by using a through-hole electrode (not shown) formed in the sub-board 640. Preferably, either of one end portion or the other end portion of the conductor antenna 610 is constructed of a metal plate made of a metal conductive plate. In this case, an end portion opposite to the one end portion or to the other end portion of the conductor antenna 610 may be made of metal conductive foil such as copper foil as formed on the sub-board 640 or may be fabricated by printing a metal conductive film on the sub-board 640 by a screen printing method or deposition method.

Moreover, in the sixth embodiment, the conductor 612 on the other end side of the conductor antenna 610 is formed by sticking foil to the rear surface 640B, however, as in the case of the conductor 611 on the one end side, the conductor 612 may be formed by using a metal plate made of bronze phosphate. In this case, the conductor 612 may be formed by sticking a plane portion of the metal plate on the rear surface 640B. Also, the conductor 612 on the other end side of the conductor antenna 610 is made up of a metal plate and the conductor 611 may be formed by combining other materials, for example, by using a line material (metal conductive line) or a like. In this case, both the conductors 612 and 611 may be coupled via a through-hole electrode or may be electrically connected via a side face electrode formed on a side face of the board serving as a folded-back portion.

Thus, in the antenna device 600 of the sixth embodiment, the end portion 612 of the conductor 612 on the other end side of the conductor antenna 610 is extended toward a bottom portion of the base body 620 on the rear surface 640B on the sub-board 640. As a result, the end portion 612*a* of the conductor 612 on the other end side is coupled to the bottom portion of the base body 620 with a gap corresponding to a thickness of the sub-board 640 interposed between the end portion 612*a* and the bottom portion and the end portion 612*a* of the conductor 612 is capacitively coupled to the end portion 611*a* of the conductor 611 on the one end side.

Moreover, preferably, the conductor 612 on the other end side is so configured that its width is narrower than that of the conductor 611 on the one end side. The reason for this is that, by decreasing portions of a conductor in which a plate-shaped face is parallel to the edge 650*b* of the main board 650 and by increasing portions of the conductor being vertical with respect to the edge 650*b* and, as a result, an edge of the conductor 611 existing in a longitudinal direction which is nearest to the edge 650*b* of the main board 650, that is, nearest to the ground is placed far from the edge 650*b* of the main board 650 and, therefore, effective distance can be kept between the conductor antenna 610 and the ground, which causes reduction of a capacitive component between the conductor 610 and the ground, thus enabling gain exceeding a specified level to be achieved and bandwidth to be widened. This allows high-gain and wide-band operations of the antenna device 600 in such a low band as GSM (900 MHz) band.

The end portion 611*a* of the conductor 611 on the one end side of the conductor antenna 610 is connected to a power feeding line 641 via a conductor line 630. Between the power feeding line 641 and the conductor line 630 is mounted impedance matching circuit made up of a chip element 631 or a like. The main board 650 is made of a glass epoxy resin or a like and serves as a PCB to be embedded in a mobile phone being one of multi band type wireless communication apparatuses of the embodiment of the present invention.

By configuring as above, power is fed through the power feeding line 641 to the conductor antenna 610 from a transmitting/receiving circuit (not shown) mounted on the main board 650. The antenna device 600 is configured so as to be small-sized and thin and, therefore, can be mounted on the sub-board 640 being very small compared with the main board 650. By configuring as above, some distance can be kept between the conductor antenna 610 and base body 620 and the conductor portions and the edge portion 650*b* of the main board 650 serving as a grounding terminal and electrostatic capacity between the conductor antenna 610 and the ground on the main board 660 is reduced, which enables the conductor antenna 610 and base body 620 to operate as a wide-band and high-gain antenna. Additionally, the sub-board 640 may be secured to the case of a mobile phone to be described by using the mounting hardware 532 shown in FIGS. 12 to 14.

Moreover, the antenna device 600 and its sub-board 640 are housed in a lower portion of the case or a like of the mobile phone to be described later. In the lower portion of the case or the like is housed a microphone in many cases. In the sixth embodiment, the microphone 649 is mounted on the sub-board 640 and the conductor 611 on the one end side is formed in a stood manner in an end portion placed in a width direction being opposite to the microphone 649 on the main surface 640A on the sub-board 640 and the conductor 612 on the other end side is formed in an end portion placed opposite to the microphone 649 in a width direction of the sub-board 640. Thus, by configuring so that the conductor 611 on the one end side of the conductor antenna 610 and the conductor 612 on the other end side are placed from the microphone 649 as far as possible, electrostatic capacitive components between the conductors 611 and 612 and the microphone 649 can be reduced, which enables the reduction of influences by the microphone 649 to the conductor antenna 610. Advantageously, the conductor 612 on the other end side of the conductor antenna 610 is made of metal conductive foil or a metal conductive film that can provide a freedom of design for a shape in order to place the conductor apart from the microphone 649 or a like or to bypass an obstacle. Moreover, in the case of using the sub-board, work of mounting an antenna device or a microphone is managed according to a method being different from that used for manufacturing the main board, thus enabling a rationalization of mobile phone production and shortening manufacturing time.

Figure 21:
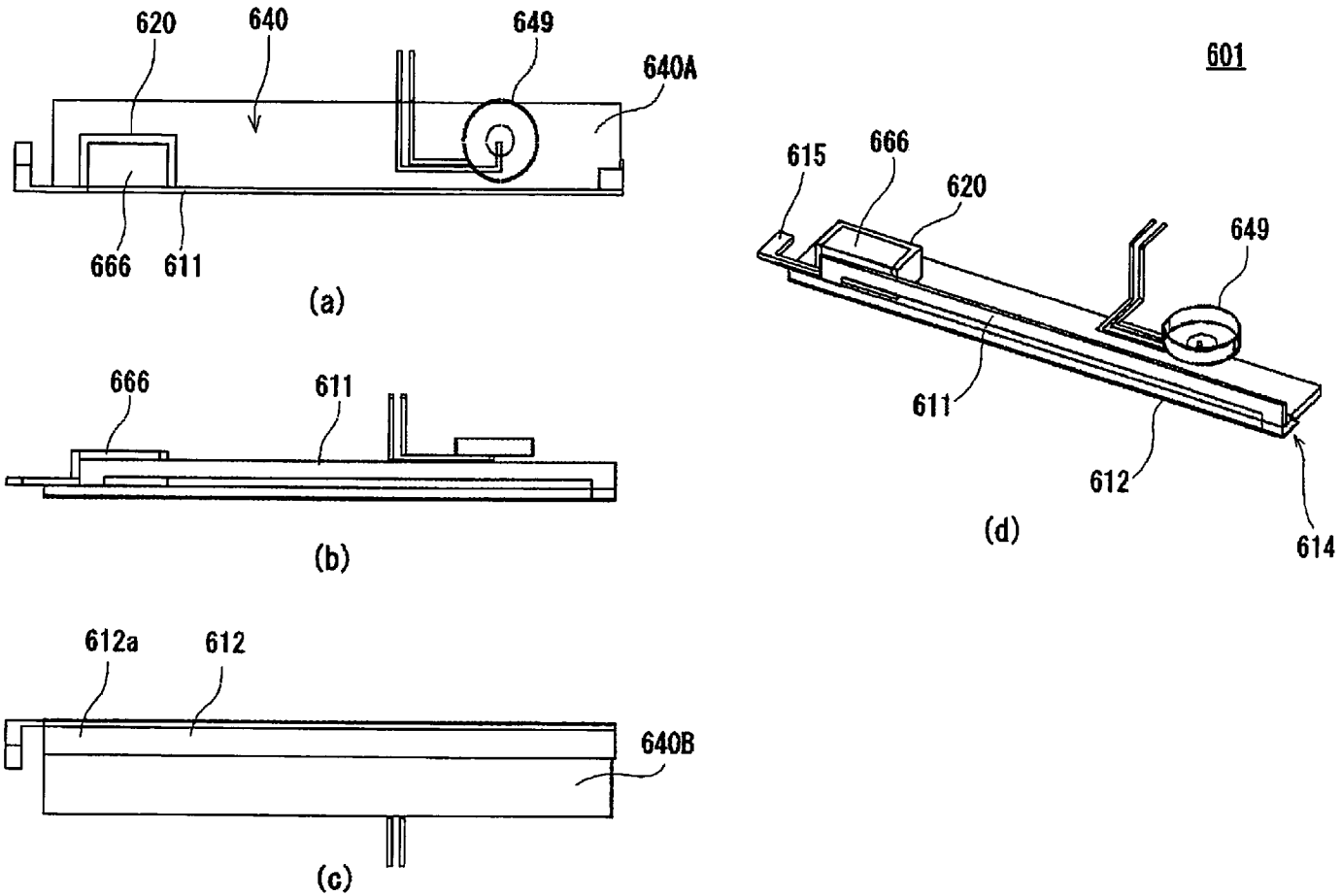
FIG. 21 is a diagram illustrating an antenna device of the first modified example of the antenna device of the sixth embodiment of the present invention and FIG. 21(*a*) is its plan view, FIG. 21(*b*) is its side view, FIG. 21(*c*) is its bottom plan view and FIG. 21(*d*) is its perspective view.

Here, modified examples of the antenna device of the sixth embodiment of the present invention are described by referring to FIGS. 21 to 29. FIG. 21 is a diagram illustrating an antenna device of the first modified example of the antenna device of the sixth embodiment of the present invention. FIG. 21(*a*) is its plan view, FIG. 21(*b*) is its side view, FIG. 21(*c*) is its bottom plan view, and FIG. 21(*d*) is its perspective view.

In the antenna device 601 of the first modified example, to the base body 620 is connected one end portion 611 of a conductor antenna 610 and is formed a conductor pattern 666 which enables the adjustment of a transmitting/receiving frequency. That is, the conductor pattern 666 for adjusting the transmitting/receiving frequency is formed from an upper surface of the base body 620 toward one end side and by performing a machining process such as a process of shaving part of the conductor pattern 666 for adjusting the transmitting/receiving frequency or a like, it is made possible to adjust the transmitting/receiving frequency for the antenna device 601, particularly in the GSM band. By changing a size of the conductor pattern 666 for adjusting the transmitting/receiving frequency, capacity between the conductor 611 and the conductor 612 (that is, an end portion 612*a* of the conductor 612) on the other end side of the conductor antenna 610 mounted on a rear surface 640B on the sub-board 640 can be increased or decreased, which enables easy adjustment of the transmitting/receiving frequency.

Figure 22:
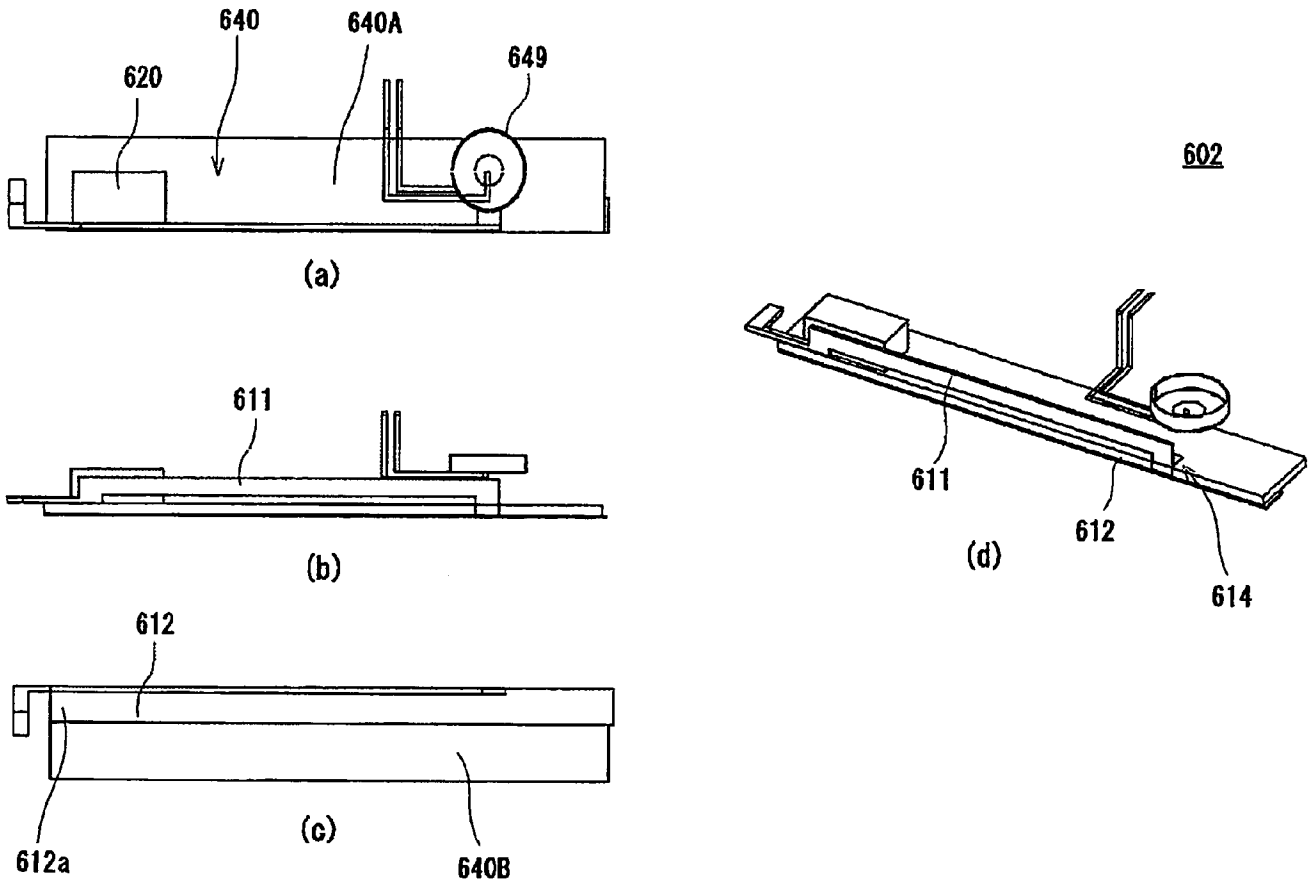
FIG. 22 is a diagram illustrating an antenna device of the second modified example of the antenna device of the sixth embodiment of the present invention and FIG. 22(*a*) is its plan view, FIG. 22(*b*) is its side view, FIG. 22(*c*) is its bottom plan view and FIG. 22(*d*) is its perspective view.

FIG. 22 is a diagram illustrating an antenna device of the second modified example of the antenna device of the sixth embodiment of the present invention. FIG. 22(*a*) is its plan view, FIG. 22(*b*) is its side view, FIG. 22(*c*) is its bottom plan view, and FIG. 22(*d*) is its perspective view. In the antenna device 602 of the second modified example, a position is changed in which the conductor 611 (metal plate) on the one end side of the conductor antenna 610 mounted on one main face (surface) of the sub-board 640 is coupled to the conductor 612 (copper foil) on the other end side of the conductor antenna 610 mounted on the other main face (rear) of the sub-board 640. That is, the conductor 612 (copper foil) on the other end side is formed over all length of the other main face (rear) of the sub-board 640 in a longitudinal direction, however, the conductor 611 (metal plate) on the one end portion of the conductor antenna 610 is formed so as to be shorter than the conductor 612, more specifically, in a length being approximately ¾ from the power feeding side on a surface of the sub-board 640 and a ⊃-shaped end portion is coupled to the conductor 612 (copper foil) on the rear in a position being approximately ¾ in the longitudinal direction. Thus, according to the antenna device 602 of the second modified example, by changing the position in which the conductor 611 (metal plate) on the one end side of the conductor antenna 610 mounted on the surface of the sub-board 640 is coupled to the conductor 612 on the other end side of the conductor antenna 610 formed on the rear of the sub-board 640, easy adjustment of the transmitting/receiving frequency is achieved. Alternatively, the conductor 611 on the one end side of the conductor antenna 610 may be coupled, by folding back the conductor 611 at a mid-point of the length of the sub-board 640 in a longitudinal direction, to the conductor 612 (copper foil) and the coupling is achieved sufficiently only if the conductor 611 on the one end side of the conductor antenna 610 is coupled to the conductor 612 on the other end side at a place where approximately U-shaped folding-back formed. Additionally, changing a height of the conductor 612 on the board side, which extends from a position in which the conductor 611 is coupled to the conductor 612 in a direction opposite to the power feeding side, the resonant frequency in the GSM band can be calibrated.

Figure 23:
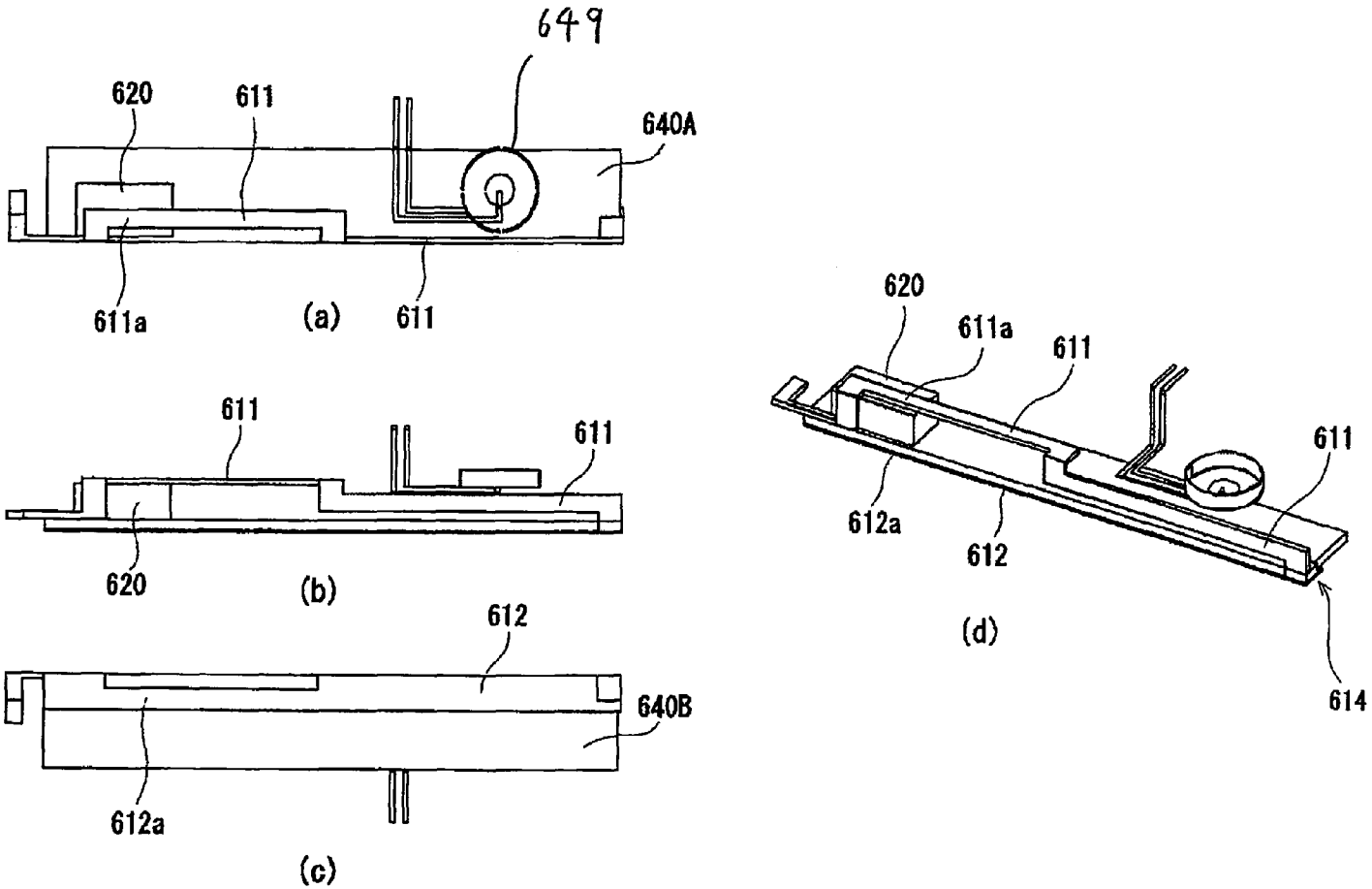
FIG. 23 is a diagram illustrating an antenna device of the third modified example of the antenna device of the sixth embodiment of the present invention and FIG. 23(*a*) is its plan view, FIG. 23(*b*) is its side view, FIG. 23(*c*) is its bottom plan view and FIG. 23(*d*) is its perspective view.

FIG. 23 is a diagram illustrating an antenna device of the third modified example of the antenna device of the sixth embodiment of the present invention and FIG. 23(*a*) is its plan view, FIG. 23(*b*) is its side view, FIG. 23(*c*) is its bottom plan view and FIG. 23(*d*) is its perspective view. In the antenna device of the third modified example, approximately half of a conductor 611 (metal plate) on one end side of a conductor antenna 610 mounted on one main face (surface) of a sub-board 640 and placed on a folded-back side from a conductor 612 on the other end side of the conductor antenna 610 is formed so that its plane portion is orthogonal to a main face of the sub-board 640 and approximately half of the conductor 611 placed on a power feeding side bypasses so that its plane portion is coupled to an upper face of the base body 620. As a result, an end portion 611*a* on the power feeding side faces in parallel to an end portion 612*a* of the conductor 612 on the other side of the conductor antenna 610 with the base body 620 being interposed between the end portion 611*a* and the end portion 612*a* and, therefore, by changing a distance between surfaces being in parallel to each other, a capacity between the end portion 611*a* and end portion 612*a* can be increased or decreased. This allows easy adjustment of transmittance/receiving frequencies. Thus, alternatively, the conductor antenna 610 may be so configured to bypass so that part of the conductor 611 on the one end side of the conductor antenna 610 runs over an upper surface of the base body 620, which enables separation of part of the conductor 611 on the one end of the conductor antenna 610 from a position of the microphone 649 shown in FIG. 23, thus preventing a decrease in antenna gain and narrow bands caused by coming-near between the microphone 649 and conductor antenna 610 and which also enables the adjustment of the transmitting/receiving frequencies.

Figure 24:
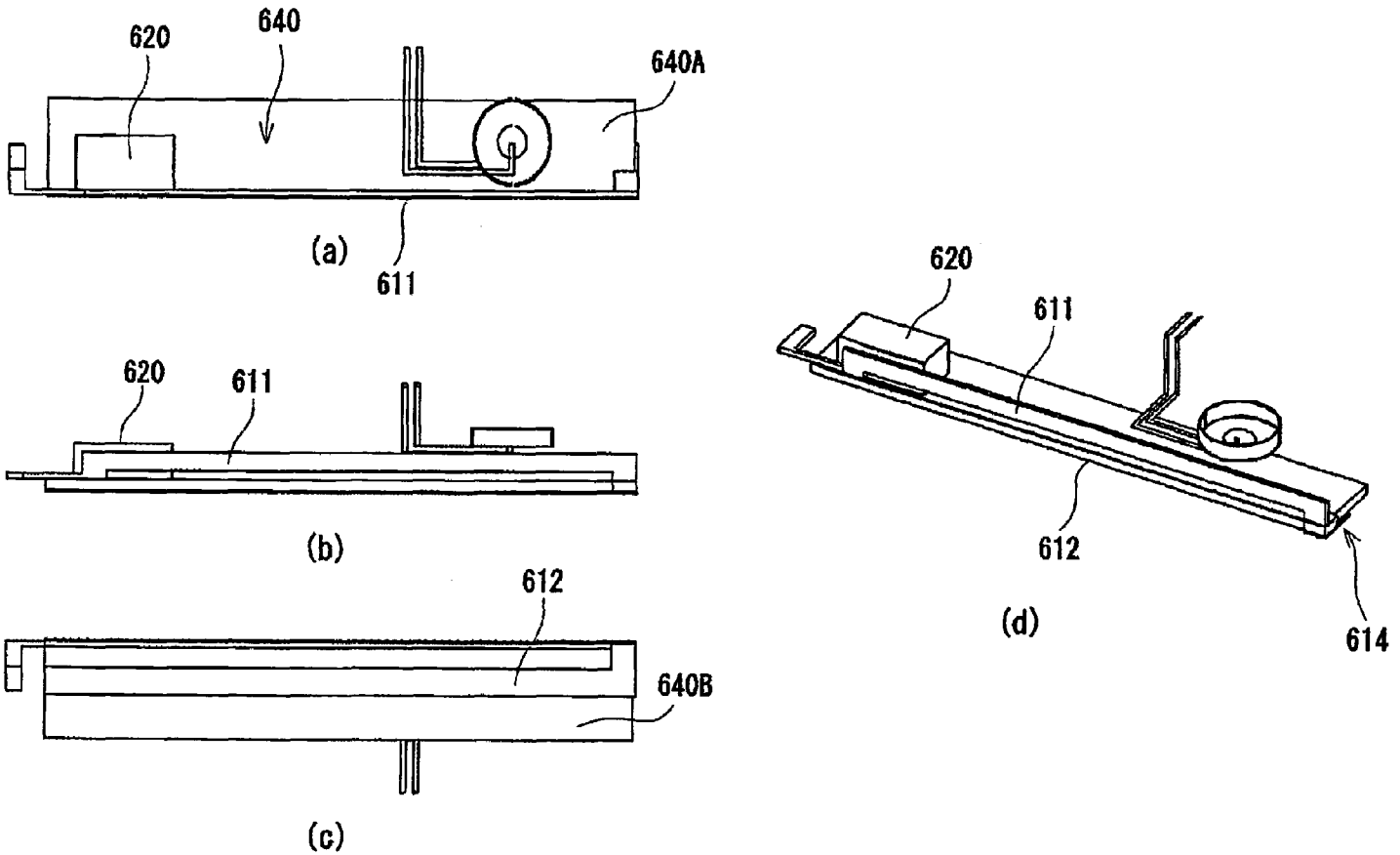
FIG. 24 is a diagram illustrating an antenna device of the fourth modified example of the antenna device of the sixth embodiment of the present invention and FIG. 24(*a*) is its plan view, FIG. 24(*b*) is its side view, FIG. 24(*c*) is its bottom plan view and FIG. 24(*d*) is its perspective view.

FIG. 24 is a diagram illustrating an antenna device of the fourth modified example of the antenna device of the sixth embodiment of the present invention and FIG. 24(*a*) is its plan view, FIG. 24(*b*) is its side view, FIG. 24(*c*) is its bottom plan view and FIG. 24(*d*) is its perspective view. In the antenna device of the fourth modified example, the conductor 612 on the other end side of the conductor antenna 610 is formed so as to be L-shaped or ⊃-shaped on a rear of the sub-board 640 and, as a result, some distance is kept between an end portion of the rear of the sub-board 640 in a width direction and the conductor 612. This causes an increase in length of the conductor 612 on the other end side of the conductor antenna 610 and addition of its inductance and, therefore, the transmitting/receiving frequency can be easily adjusted.

Figure 25:
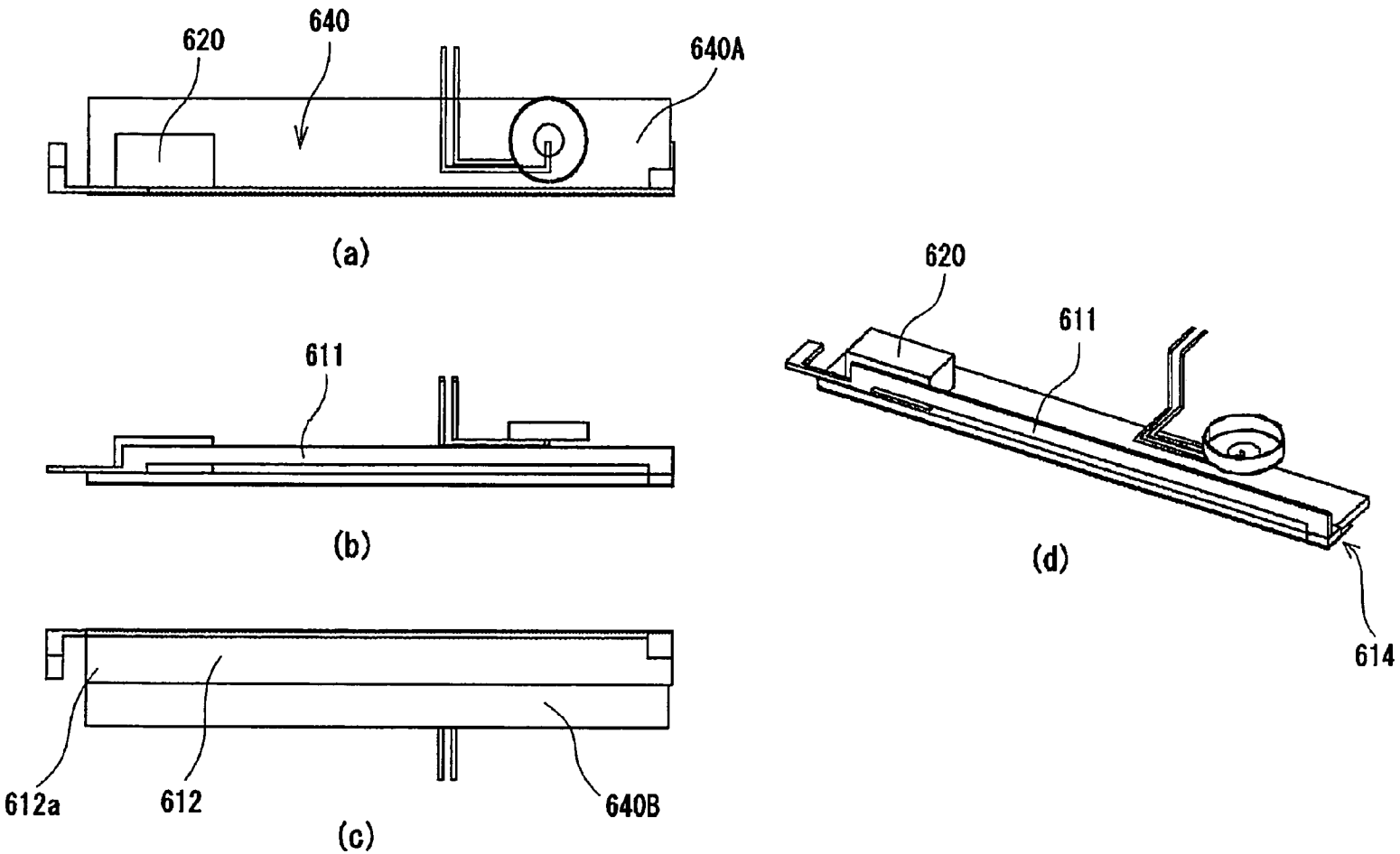
FIG. 25 is a diagram illustrating an antenna device of the fifth modified example of the antenna device of the sixth embodiment of the present invention and FIG. 25(*a*) is its plan view, FIG. 25(*b*) is its side view, FIG. 25(*c*) is its bottom plan view and FIG. 25(*d*) is its perspective view.

FIG. 25 is a diagram illustrating an antenna device of the fifth modified example of the antenna device of the sixth embodiment of the present invention and FIG. 25(*a*) is its plan view, FIG. 25(*b*) is its side view, FIG. 25(*c*) is its bottom plan view and FIG. 25(*d*) is its perspective view. In the antenna device of the fifth modified example, the conductor 612 on the other end side of the conductor antenna 610 is formed so as to have a width being approximately equal to that of the base body 620 on the sub-board 640. This causes an increase in area of the conductor 612 on the other end side of the conductor antenna 610 and addition of its capacitive component, which enables easy adjustment of the transmitting/receiving frequency.

Figure 26:
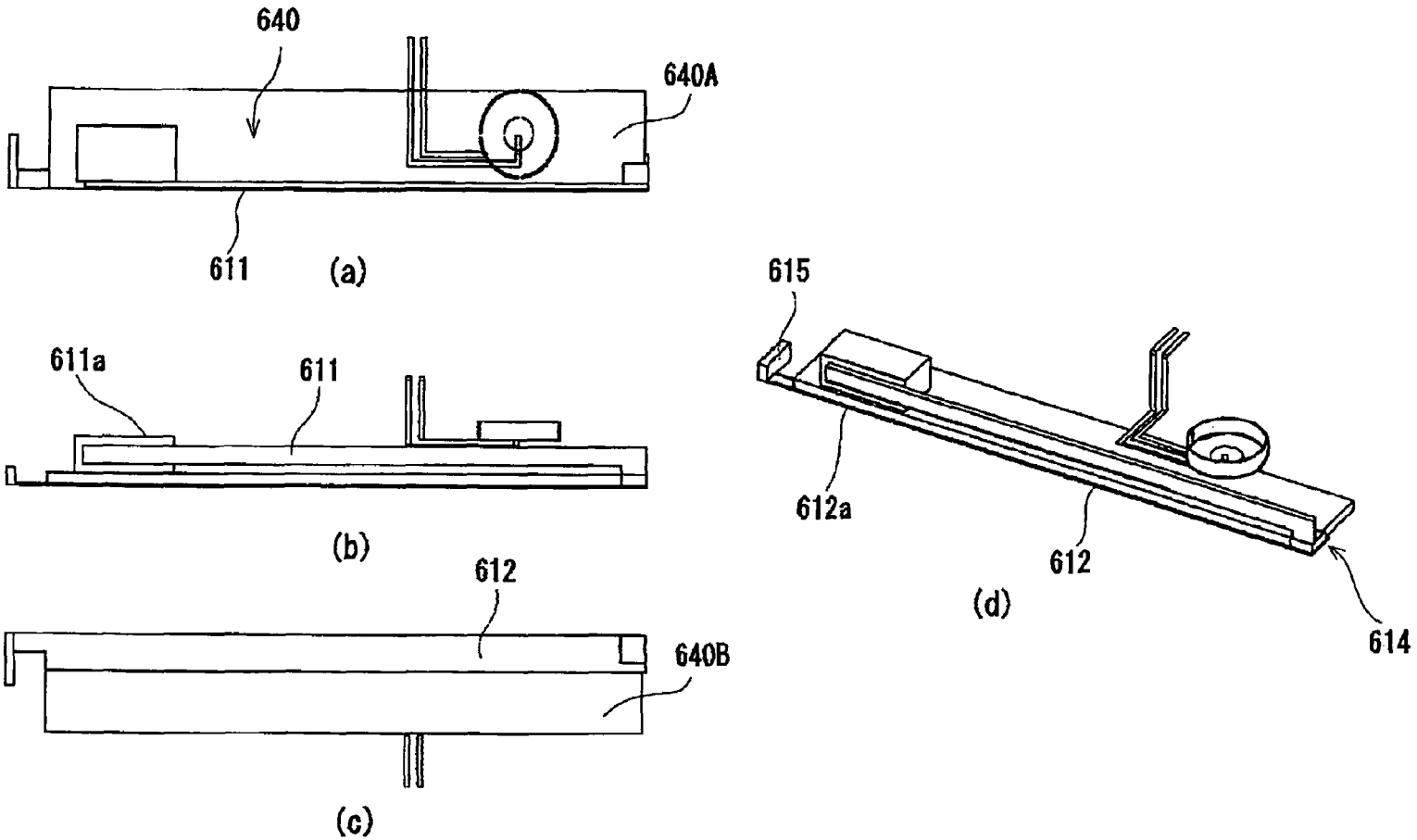
FIG. 26 is a diagram illustrating an antenna device of the sixth modified example of the antenna device of the sixth embodiment of the present invention and FIG. 26(*a*) is its plan view, FIG. 26(*b*) is its side view, FIG. 26(*c*) is its bottom plan view and FIG. 26(*d*) is its perspective view.

FIG. 26 is a diagram illustrating an antenna device of the sixth modified example of the antenna device of the sixth embodiment of the present invention and FIG. 26(*a*) is its plan view, FIG. 26(*b*) is its side view, FIG. 26(*c*) is its bottom plan view and FIG. 26(*d*) is its perspective view. In the antenna device of the sixth modified example, power is fed from a rear face 640B of the sub-board 640 to the conductor 612 of the conductor antenna 610. The end portion 612*a* of the conductor 612 of the conductor antenna 610 is connected through a power feeding portion 615 to the conductor line 630. In the configuration as above, power is supplied from a transmitting/receiving section (not shown) mounted on the main board 650 through the power feeding line 641 and the conductor line 630 to the power feeding portion 615 from which power is then fed to the conductor antenna 610. Though not shown, an impedance matching circuit made up of chip elements or a like is mounted between the power feeding line 641 and the conductor line 630. Thus, alternatively, power may be fed to the conductor 612 of the conductor antenna 610 formed on a rear of the sub board 640. In the antenna device of the fifth modified example of the sixth embodiment shown in FIG. 25, the conductor 611 to which the power feeding section is connected makes up a conductor on one end side of the conductor antenna 610 and the conductor 612 whose another end portion forms an open end terminal makes up the conductor on the other end side. However, in the antenna device of the sixth modified example shown in FIG. 26, the conductor 612 to which the power feeding section is connected makes up the conductor on the one end side and the conductor 611 whose end portion forms an open end terminal makes up the conductor on the other end side. Therefore, the end portion 611*a* of the conductor 611 connected to a side face 620B of the base body 620 makes up the open end terminal.

Figure 27:
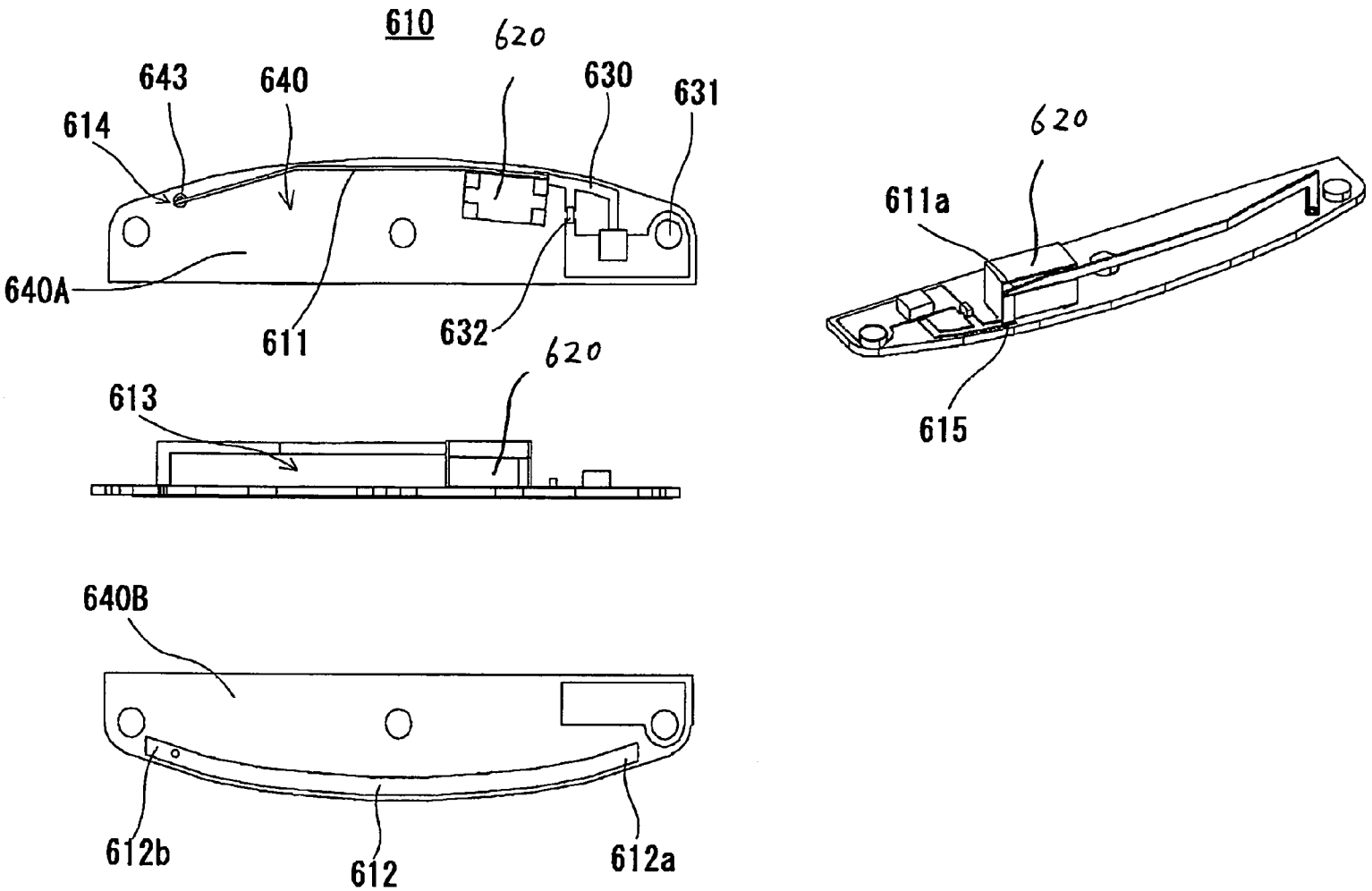
FIG. 27 is a diagram illustrating an antenna device of the seventh modified example of the antenna device of the sixth embodiment of the present invention.

FIG. 27 is a diagram illustrating an antenna device of the seventh modified example of the antenna device of the sixth embodiment of the present invention. In the antenna device of the seventh modified example, a conductor antenna 610 includes a conductor 611 on one end side of the conductor antenna 610, a conductor 612 on the other end side of the conductor antenna 610, a base body 620, a power feeding connector 531, an impedance matching circuit 632 made up of chip elements, and a conductor line 630, all of which are mounted on a sub-board 640. An end portion 611*a* on the one end of the conductor 611 is connected to a power feeding electrode 615' formed on the base body 620 by a printing method and makes up a power feeding portion 615. An end portion 611*a* of the conductor 611 on the one end side is connected to a folded-back portion 614 and to the conductor 612 on the other end side via a through hole conductor to the sub-board 640. The conductor 612 on the other end side of the conductor antenna 610 is printed, as a conductive film, on a rear 640B of the sub-board 640 and end portions 612*a* and 612*b* of the conductor 612 on the other end side of the conductor antenna 610 operates as open end terminals. An entire profile of the electrode of the conductor antenna 610 is approximately U-shaped, which is formed by the conductor 611 on the one end side, folded-back portion 614, and conductor 612 on the other end side, with the sub-board 640 being interposed among these components wherein the end portion 612*b* of the conductor 612 on the other end side of the conductor antenna 610 extends from the folded-back portion 614 slightly up to the outside. That is, the conductors 611 and 612 are placed apart from each other with the sub-board 640 being interposed between the conductors 611 and 612. Also, the conductor 610, when viewed from the sub-board 640, is placed, in an arc-shaped form, in a position on a case side in an upper portion of the sub-board 640 and is connected via a through-hole 643 passing through a main face 640A of the sub-board 640 to the conductor 612 on the other end side formed on a rear 640B and is placed (in a stood manner). Power is fed from the power feeding connector 631 via a conductor line on the sub-board 640 and matching circuit 632 to the power feeding section 615 from which power is further fed to the conductor antenna 610.

Figure 28:
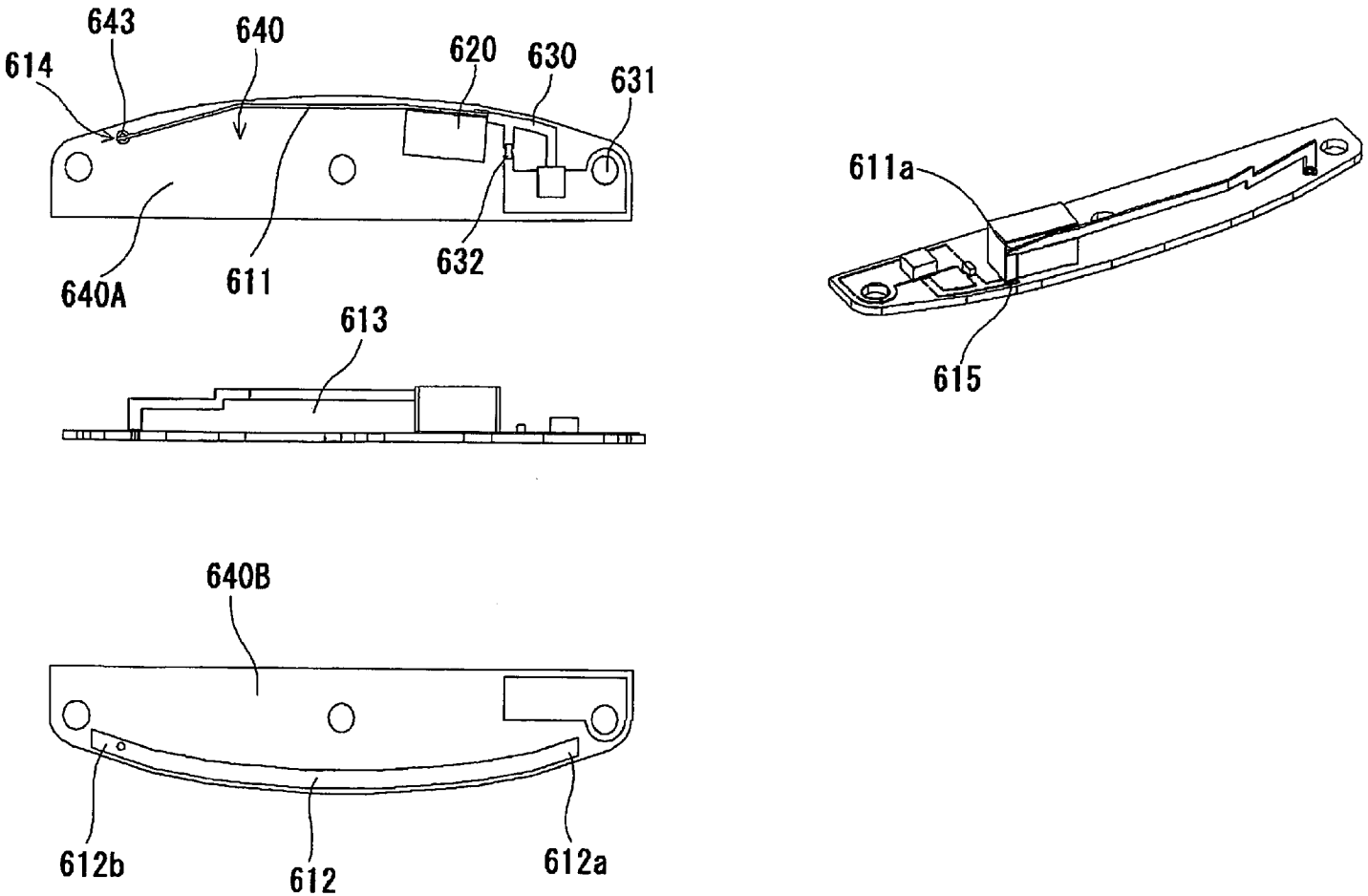
FIG. 28 is a diagram illustrating an antenna device of the eighth modified example of the antenna device of the sixth embodiment of the present invention.

FIG. 28 is a diagram illustrating an antenna device of the eighth modified example of the antenna device of the sixth embodiment of the present invention (In FIG. 28, since the configurations are the same as explained in the modified example 7, same reference numbers as shown in the modified example 7 are assigned). In the antenna device of the eighth modified example, a conductor antenna 610 includes a conductor 611 placed on one end side of the conductor antenna 610, a conductor 612 on the other end side, a base body 620, a power feeding connector 631, an impedance matching circuit 632 made up of chip elements, and a conductor line 630, all of which are mounted on a sub-board 640. An end portion 611*a* of the conductor 611 on the one end side of the conductor antenna 610 is connected to a power feeding electrode 615' printed on the base body 620 and makes up a power feeding portion 615 through the base body 620. Another end portion of the conductor 611 is connected to the folded-back portion 614 and is further connected to the conductor 612 on the other end side via the through hole formed on the sub-board 640. On a rear 640B of the sub-board 640 is printed, as a conductive film, the conductor 612 on the other end side of the conductor antenna 610 and end portions 612*a* and 612*b* on the other end side operate as open end terminals. An entire profile of the electrode of the conductor antenna 610 is approximately U-shaped, which is formed by the conductor 611, folded-back portion 614, and conductor 612, with the sub-board 640 being interposed among these components and the end portion 612*b* of the conductor 612 extends from the folded-back portion 614 slightly up to the outside. The configurations of the conductor antenna 610 differ from those of others in that the conductor 611, after being folded toward an upper face of the board 640 so as to have a crank-shaped profile at a mid-point of the length of the conductor 611, is connected to the folded-back portion 614. That is, the conductors 611 and 612 are placed far from each other with the sub-board 640 being interposed between the conductors 611 and 612 and band-shaped space is formed between the conductors 611 and 612, which also shows an example in which the profile of this portion can be changed depending on a shape of surrounding components, case, or a like. Then, as in the cases described above, the conductor 610, when viewed from the sub-board 640, is placed (in a stood manner), in an arc-shaped form, in a position on a case side in an upper portion of the sub-board 640 and is connected via a through-hole 643 passing through a main face 640A of the sub-board 640 to the conductor 612 formed on a rear 640B. Power is fed from the power feeding connector 631 via a conductor line on the sub-board 640 and matching circuit 632 to the power feeding section 615 from which power is further fed to the conductor antenna 610.

Figure 29:
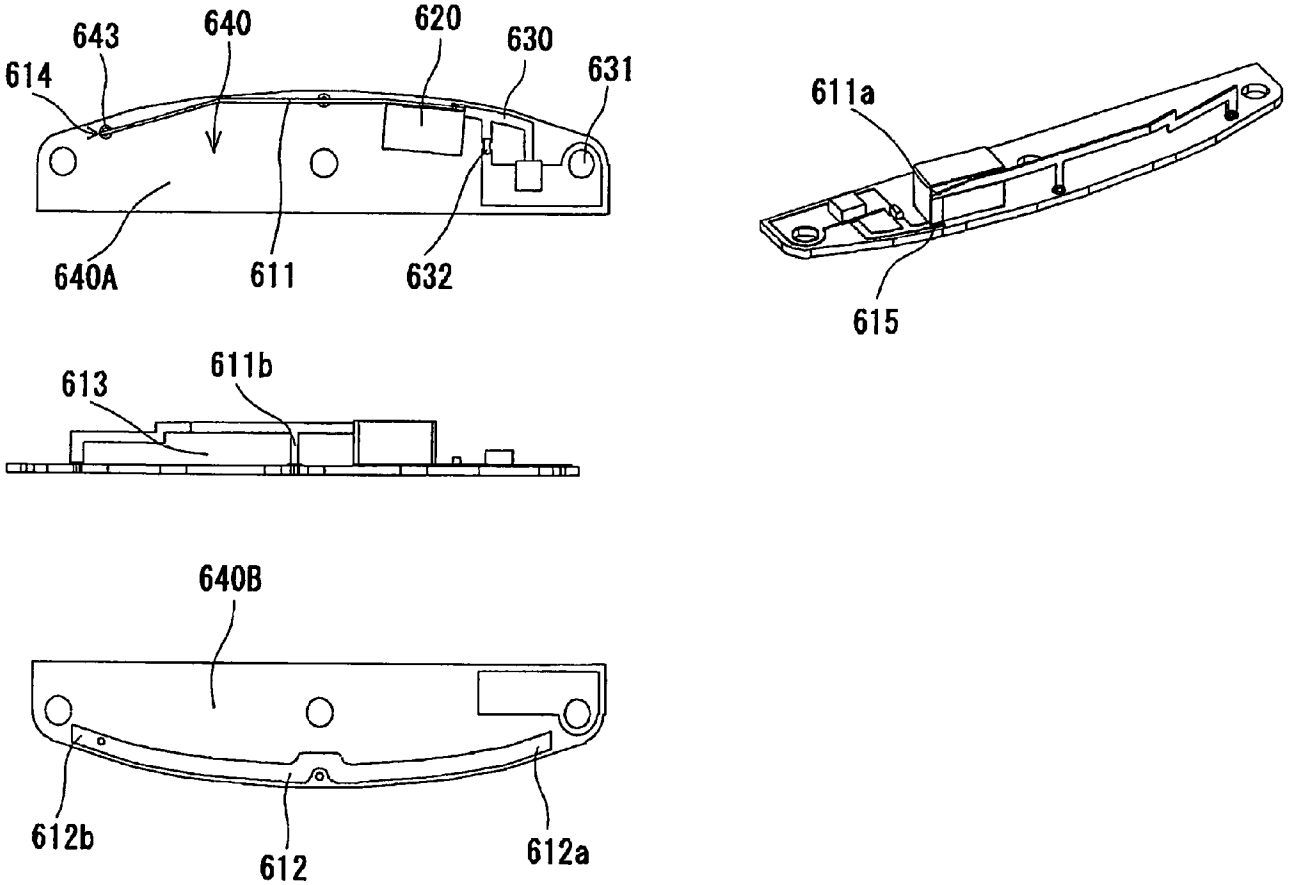
FIG. 29 is a diagram illustrating an antenna device of the ninth modified example of the antenna device of the sixth embodiment of the present invention.

FIG. 29 is a diagram illustrating an antenna device of the ninth modified example of the antenna device of the sixth embodiment of the present invention ((In FIG. 29, since the configurations are the same as explained in the modified example 7, same reference numbers as shown in the modified example 7 are assigned). In the antenna device of the ninth modified example, a conductor antenna 610 includes a conductor 611 on one end side of the conductor antenna 610, a conductor 612 on the other end side of the conductor antenna 610, a base body 620, a power feeding connector 631, an impedance matching circuit made up of chip elements, and a conductor line 630, all of which are mounted on a sub-board 640. An end portion 611*a* of the conductor 611 on the one end side of the conductor antenna 610 is connected to a power feeding electrode 615' formed on the board 620 by a printing method and makes up a power feeding portion. Another end portion of the base body 611 is connected to a folded-back portion 614 and is further connected to the conductor 612 on the other end side via a through-hole formed on the sub-board 640. On a rear 640B of the sub-board 640 is printed the conductor 612 on the other end side as a conductive film and end portions 612*a* and 612*b* on the other end side operate as open end terminals. An entire profile of the electrode of the conductor antenna 610 is approximately U-shaped, which is formed by the conductor 611, folded-back portion 614, and conductor 612, with the sub-board 640 being interposed among these components and the end portion 612*b* of the conductor 612 extends from the folded-back portion 614 slightly up to the outside. Configurations of the conductor antenna 610 differ from others in that a supporting portion 611*b* extends from a mid-point of the length of the conductor 611 toward an upper face of the sub-board 640 to support the conductor 611 and is placed on the sub-board 640 in a stood manner. That is, the conductors 611 and 612 are placed far from each other with the sub-board 640 being interposed between the conductors 611 and 612 and band-shaped space is formed between the conductors 611 and 612 which shows an example in which the strength of this portion can be increased by providing proper supporting members. As in the cases of others, the conductor 610, when viewed from the sub-board 640, is placed (in a stood manner), in an arc-shaped form, in a position on a case side in an upper portion of the sub-board 640 and is connected via a through-hole 643 passing through a main face 640A of the sub-board 640 to the conductor 612 formed on a rear 640B. Power is fed from the power feeding connector 631 via a conductor line on the sub-board 640 and matching circuit 632 to the power feeding section 615 from which power is further fed to the conductor antenna 610.

In the above configuration, by changing a length of the end portion 612*b*, the adjustment of resonant frequencies on a low band side is made possible. Under conditions that the resonant frequencies match with operations of the conductor 612, the longer the length of the end portion 612*b* is made, the more radiation efficiency on the low band side is improved. Also, by configuring the conductor 611 so as to be bendable in a crank-shaped form toward an upper face of the sub-board 640 at a mid-point of the length of the conductor 611, some distance between the conductor 611 and a metal portion such as a microphone can be kept and, therefore, capacitive components between the conductor 610 and the metal portion can be reduced, thereby achieving a wide-band and high-gain antenna device. Moreover, by configuring the supporting portion 611*b* so as to be placed in a stood manner on the sub-board 640 at a mid-point of the length of the conductor 611, the portion to support the conductor 611 is increased, which can achieve an antenna device with high mechanical strength and can increase convenience at a time of assembling the antenna device. Additionally, according to the configuration, the base body 620 is placed on the sub-board 640 and is coupled to the conductor 611. Since the sub-board 640 has a specified permittivity, in the case of a frequency band not requiring such a permittivity as the base body 620 has or in the case of having comparatively large antenna space, the use of the base body 620 is not necessary and, as a portion equivalent to the base body, the sub-board 640 or the main board 650 can be considered as an insulating material, that is, a dielectric material which enables reduction in component counts leading to low costs, thus further miniaturization of the antenna device.

Figure 30:
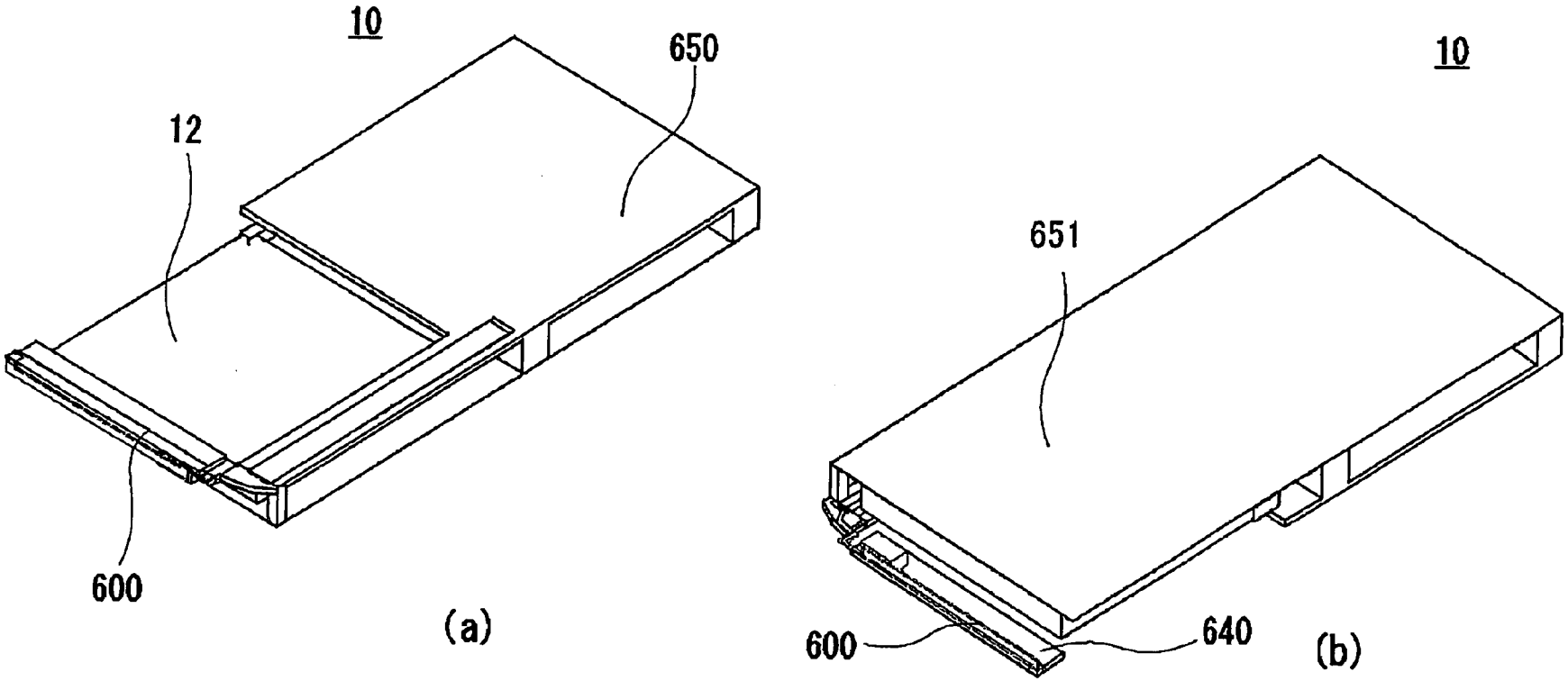
FIG. 30 is a diagram showing the antenna device of the sixth embodiment of the present invention applied to a mobile phone being one of multi-band wireless communication apparatuses and FIG. 30(*a*) is a perspective view illustrating a main board, battery, antenna device, or a like in a base of the mobile phone when viewed from a rear and FIG. 30(*b*) is a perspective view illustrating a flexible board, antenna device, or a like when viewed from a keypad side (front side)
Figure 31:
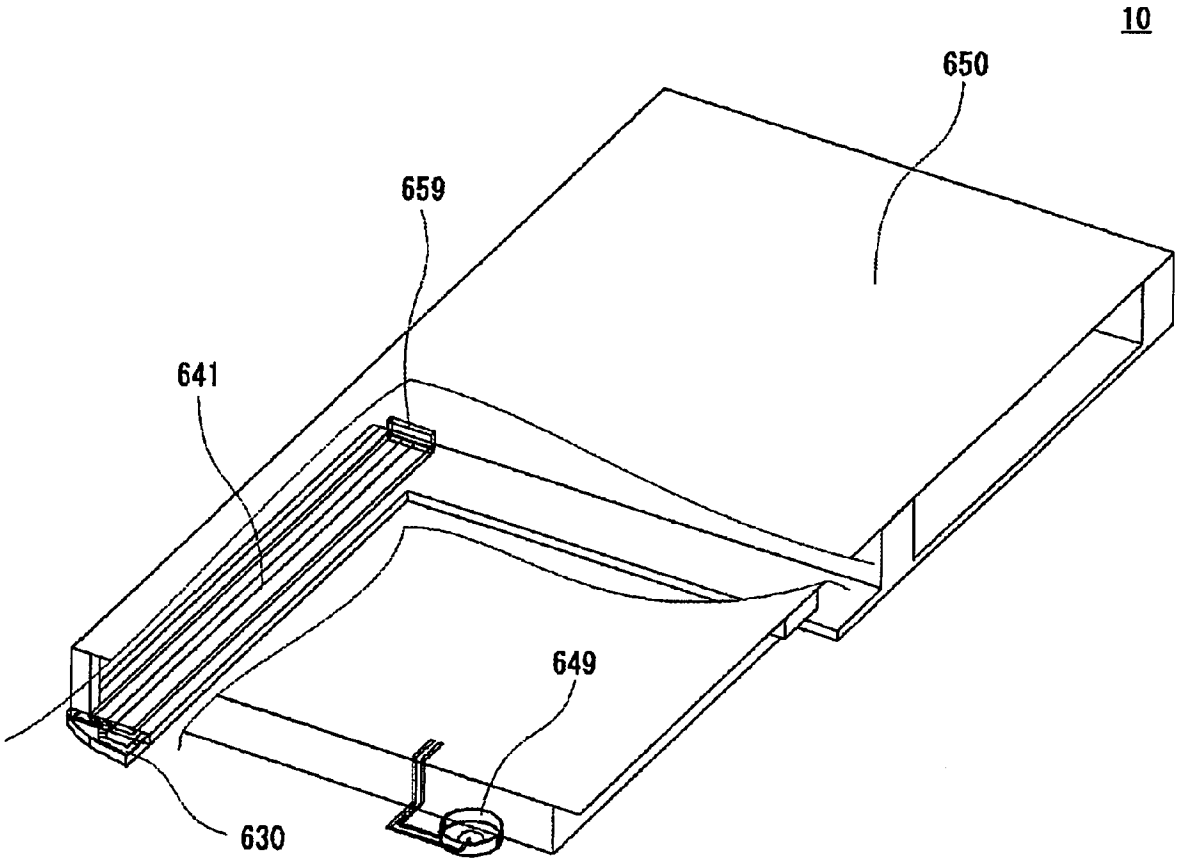
FIG. 31 is also a diagram showing the antenna device of the sixth embodiment of the present invention applied to a mobile phone being one of multi-band wireless communication apparatuses in which a power feeding route other than the antenna device, microphone, or a like in a mobile phone are shown in particular.

Next, other modes of the present invention in which the antenna device having the configurations explained above is embedded in a wireless communication apparatus are described FIGS. 30 and 31 are diagrams showing examples in which the antenna device of the sixth embodiment of the present invention is applied to a mobile phone being one of wireless communication apparatuses and FIG. 30(*a*) is a perspective view illustrating a main board, battery, antenna device, or a like in a base in the mobile phone when viewed from a rear side and FIG. 30(*b*) is a perspective view illustrating a flexible board, antenna device, or a like when viewed from a keypad side (front side). FIG. 31 is also a diagram showing an example in which the antenna device of the sixth embodiment is applied to a mobile phone in which the power feeding route other than the antenna device, microphone, or a like in the mobile phone are shown in particular. In a case 10 of the mobile phone is housed, a metal portion (not shown) on a case side, which is slightly smaller than the case 10. In the metal portion on the case side, as shown in FIG. 30(*a*), a main board 650 is placed in an upper half area in FIG. 30(*a*) viewed from a rear side of the mobile phone and the battery 12 is placed in a lower half area in FIG. 30(*a*) and the antenna device 600 or a like are placed in a lower end in FIG. 30(*a*). As shown in FIG. 31, power is fed from a power feeding port 659 mounted in a central portion on one end side of the main board 650 through a power feeding line 641 and conductor line 630 to a power feeding section 615 (see FIG. 19). Also, as shown in FIG. 30(*b*), a flexible board 651 for a number button of a mobile phone is placed in upper and lower areas in FIG. 30(*b*) viewed from a keypad side of the mobile phone and the antenna device 600, microphone 649 (see FIG. 31) or a like are placed in a lower end in FIG. 30(*b*) (see FIG. 31). By configuring as above, distance between the conductor antenna 610 and base body 620 and metal portions such as a battery 12, microphone 649, flexible board 651, or a like is kept physically and electrically (for example, no dielectric exists between the conductor antenna and the ground) and, therefore, capacitive components between the conductor antenna 610 and a ground of the flexible board 651 or a like are reduced, thereby making the conductor antenna 610 and base body 620 be a wide-band and high-gain antenna. That is, according to the embodiment, by placing the antenna device 600 far from the metal portions existing near to the antenna including the flexible board 651, battery 12, microphone 649, or a like, the high-gain of the antenna device is obtained.

Figure 32:
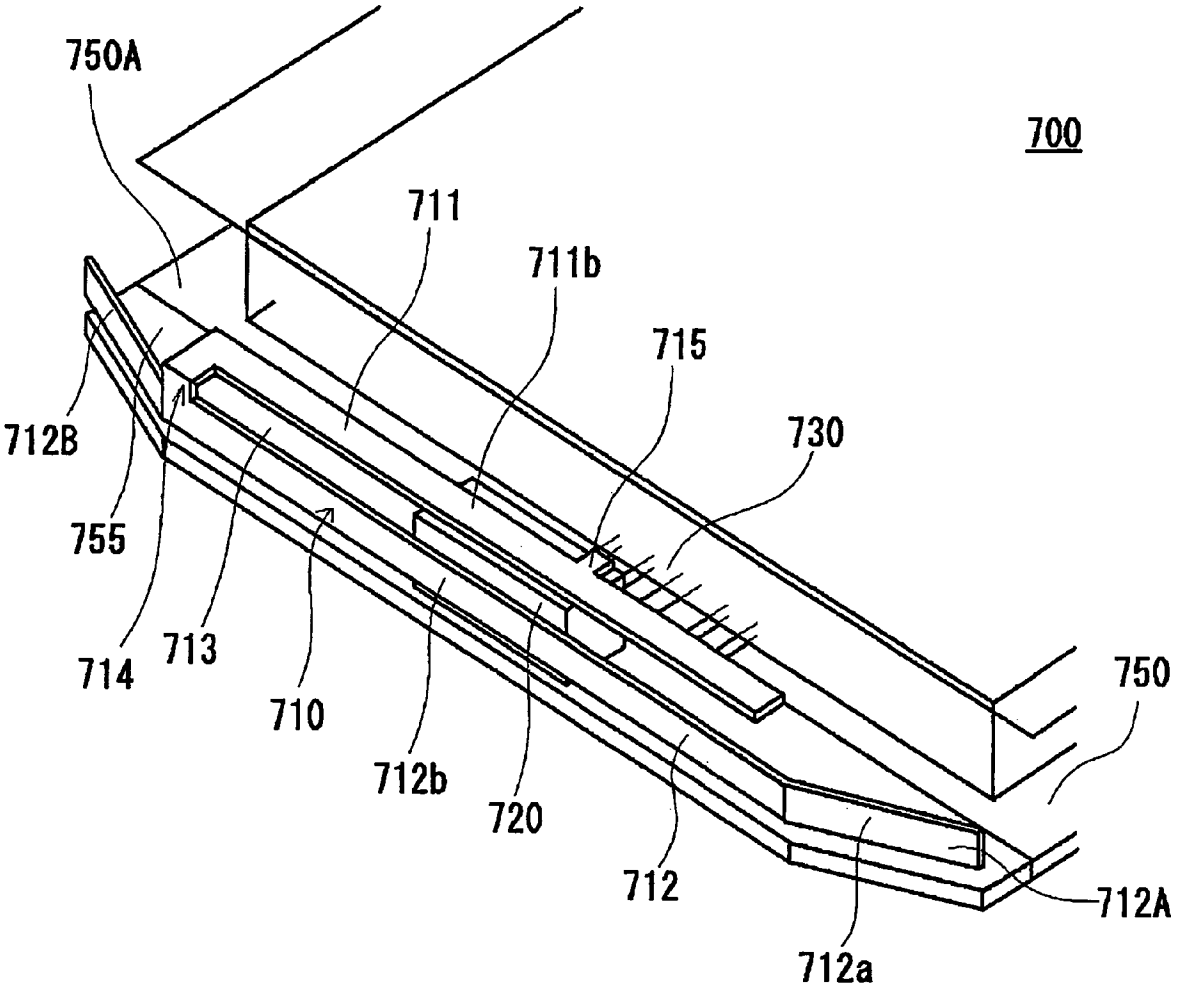
FIG. 32 is a diagram showing basic configurations of an antenna device according to the seventh embodiment of the present invention in which the antenna device together with part of the board is seen from a surface of the board.
Figure 33:
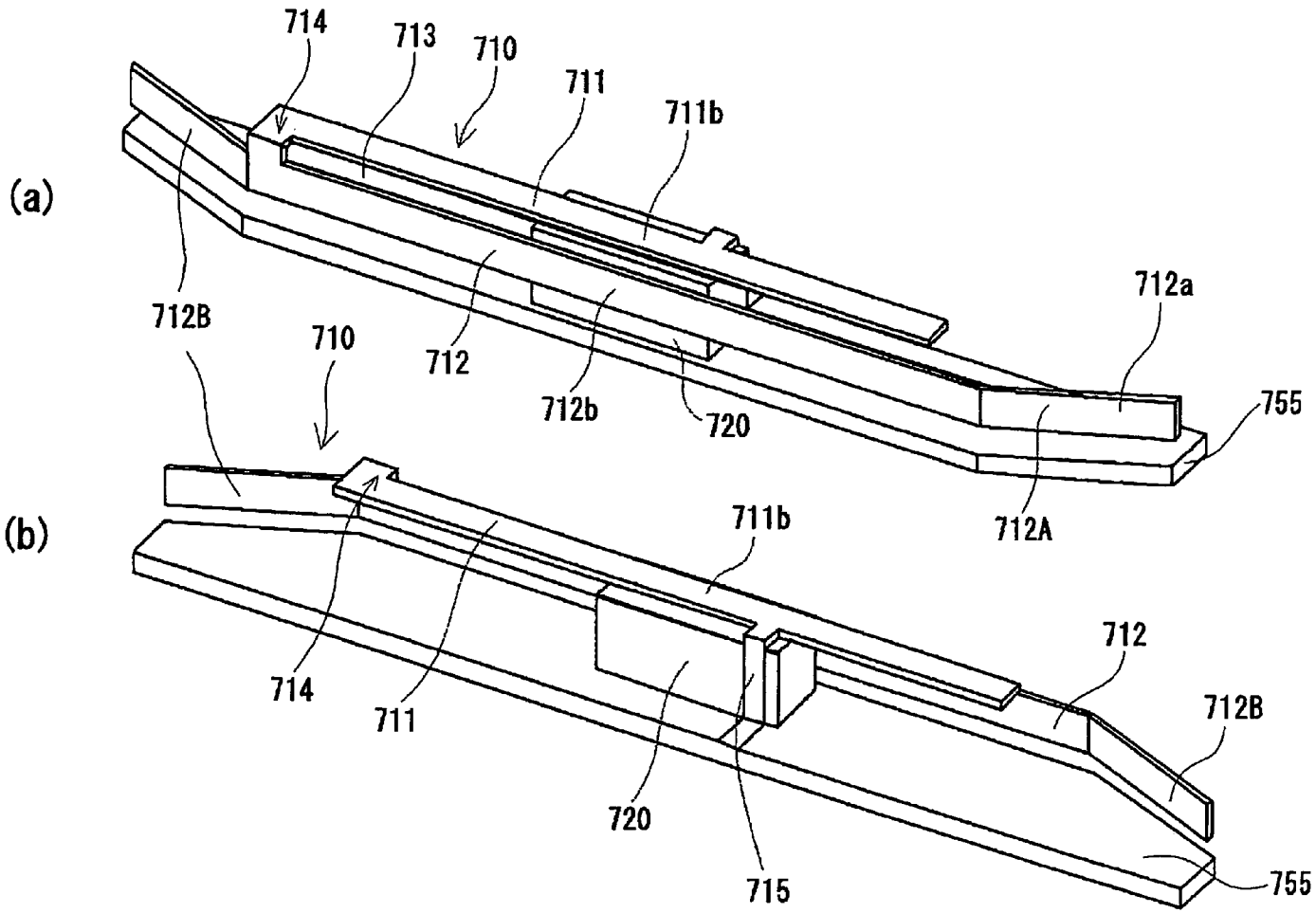
FIG. 33 is a diagram showing configurations of the antenna device of the seventh embodiment of the present invention and FIG. 33(*a*) is a perspective view when viewed from a front side (shown by an arrow in FIG. 29) and FIG. 33(*b*) is a perspective view when viewed from a rear side.

Next, an antenna device of the seventh embodiment of the present invention is described by FIGS. 32 to 38. FIG. 32 is a diagram showing basic configurations of the antenna device of the seventh embodiment of the present invention and is a perspective view in which the antenna device mounted on the board and part of the board are seen from a surface of the board. FIG. 33(*a*) is a perspective view of the antenna device shown in FIG. 32 seen from a front side. FIG. 33(*b*) is a diagram of the antenna device of the first modified example of the seventh embodiment in which a position of a folded-back portion of the conductor 710 shown in FIGS. 32 and 32(*a*) is changed so as to be reversed to each other, which is seen from a rear side of the board.

In the antenna device 700 shown in FIG. 32 and FIGS. 33(*a*) and 33(*b*), a pattern of the conductor antenna is not formed on a rear of a board and the configuration for power feeding differs from the antenna device 600 of the sixth embodiment. That is, the antenna device 700 has a conductor antenna 710, base body 720, and conductor line 730, all of which are mounted on a tip portion 755 on a main face (surface) of a main board 750. The conductor antenna 710 is formed so as to be approximately U-shaped in a folded-back portion so that a plane portion of the conductor 711 on one end side in an upper portion in FIG. 32 is approximately orthogonal to a plane portion of the conductor 712 on the other end side in a lower portion in FIG. 32 and, in the conductor 711 on the one end side is mounted a power feeding section 715 and an end portion 712*a* of the conductor 712 on the other end side operates as an open end terminal. That is, the conductors 711 and 712 are placed far from each other, and between the conductors 711 and 712 is formed band-shaped space.

The conductor 711 on one end side of the conductor antenna 710 and the conductor 712 on the other end side are fabricated by a metal plate (metal conductive plate) and, in order to decrease a resistance, to achieve high gain, and to reduce a loss, gold plating is given to their surfaces. More specifically, the conductor antenna 710 is constructed of a metal plate made of bronze phosphate so as to be approximately U-shaped and an approximately central portion of the conductor 711 on one end side of the conductor antenna 710 is coupled to an upper face of the base body 720 and an approximately central portion of the conductor 712 on the other end side is coupled to a side face of the base body 720 and is mounted in a tip portion 755 of the main face (surface) 750 on the main-board 750. An approximately central portion 711*b* of the conductor 711 on the one end side is placed on an upper face of the base body 720 and an approximately central portion 712*b* of the conductor 712 is coupled to a side face of the base body 720 by an adhesive. Moreover, though not shown, alternatively, by printing an electrode on a coupled face of the base body 720 by screen printing, the electrode may be coupled to the conductor antenna 710 by means of soldering (that is, approximately central portion between an approximately central portion of the conductor 711 on the one side and an approximately central portion of the conductor 712 on the other end side).

The base body 720 is made of a dielectric material and formed so as to have a cuboid shape and is surface-mounted in a central portion of the tip portion 755 of the main face (surface) 750A of the main board 750 in a width direction. The base body 720 is made of ceramic, that provides a low lose in high frequencies, such as alumina, silica, magnesium, or a like and is configured so as to be 5.5 mm×3 mm×2 mm in size. Thus, the base body 720 is made of at least either of a dielectric material or magnetic material and is formed to have a cuboid shape and is coupled to an approximately central portion 711*b* of the conductor 711 on the one end side of the conductor antenna 710 and to a central portion 712*b* of the conductor 712 on the other end side of the conductor antenna 710, that is, to the central portions 711*b* and central portion 712*a* of the conductors 711 and 712 both facing each other. Thus, according to the antenna device of the embodiment, the conductor 712 on the other end side of the conductor antenna 710 is capacitively coupled to the central portion 711*b* on the one end side of the conductor 711 with the base body 720 being interposed between the conductors 711 and 712.

Figure 38:
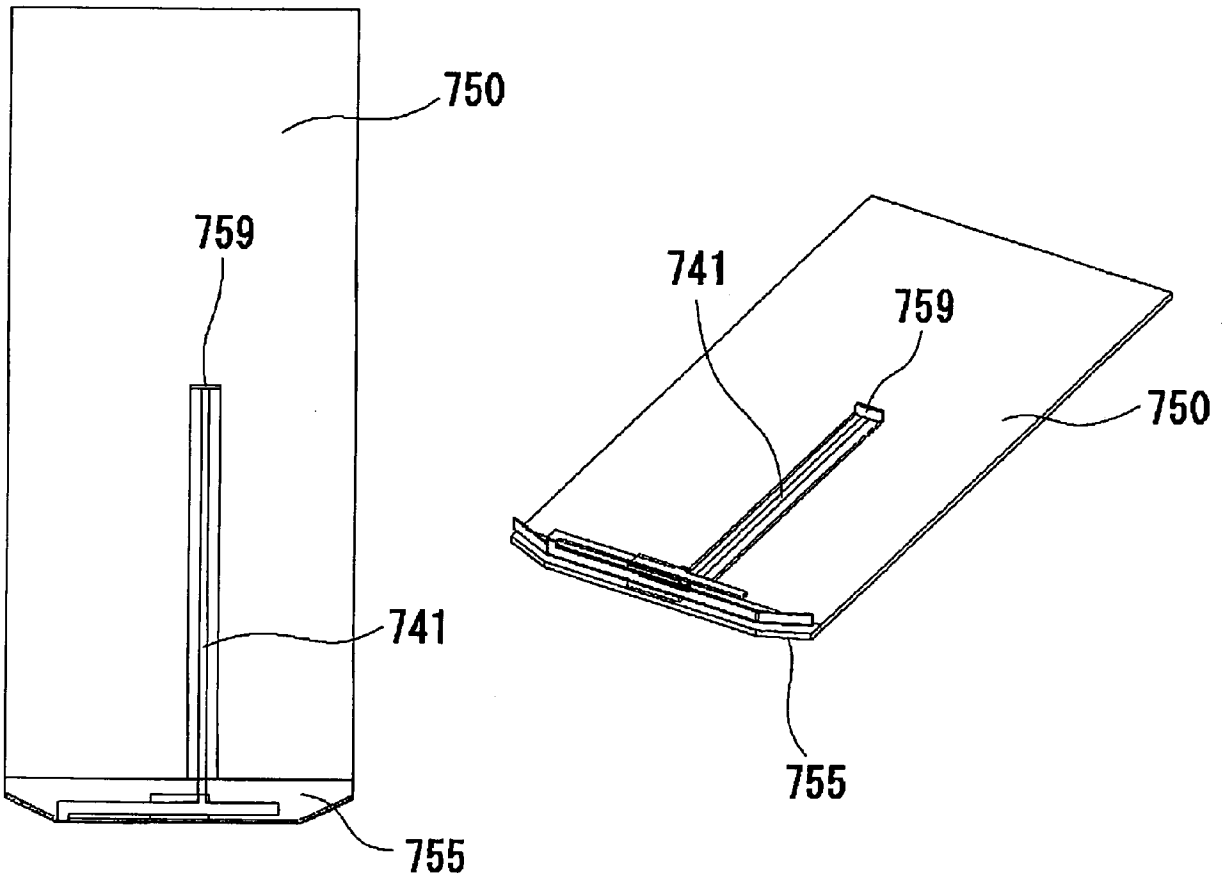
FIG. 38 is a diagram illustrating an entire main board of a mobile phone on which the antenna device of the seventh embodiment is mounted.

The approximately central portion 711*b* on the one end side of the conductor antenna 710 is connected through a conductor line 730 to a power feeding line 741 (see FIG. 38). Between the power feeding line 741 and conductor line 730 is mounted an impedance matching circuit (not shown) made up of a chip element or a like. The main board 750 is made of a glass epoxy resin or a like and serves as a PCB to be embedded in a mobile phone being one of the multi-band wireless communication apparatuses of the embodiment of the present invention described later.

FIG. 38 is a diagram illustrating an entire main board 750 of a mobile phone on which the antenna device 700 of the seventh embodiment is mounted. Power is fed from a transmitting/receiving circuit (not shown) mounted on the main board 750 through the power feeding line 741 to the conductor antenna 710 placed far from the transmitting/receiving circuit. The antenna device 700 is configured to be small-sized and to be three-dimensional with respect to a board surface and, therefore, can be made thin in a direction of the board surface and can be placed on a side far from a tip portion 755 of the main face (surface) 750A of the main board 760 and far from a ground of the main board 750. By configuring as above, some distance can be kept between the conductor antenna 710 and base body 720 (see FIGS. 34, 35, and 36) and the ground of the main board 750 and, therefore, capacitive components between the conductor antenna 710 and the main board 750 is reduced, which can make the conductor antenna 710 and base body 720 be a wide-band and high-gain antenna.

Moreover, a corner of the tip portion 755 of the main face (surface) 750A of the main board 750 is chamfered in a manner to match with a shape of a lower portion of a case of a mobile phone into which the antenna device 700 is embedded and, therefore, corresponding extended portions 712A and 712B of both ends of the conductor 712 on the other side of the conductor antenna 710 are bent so that the conductor 712 can match with the shape.

Figure 34:
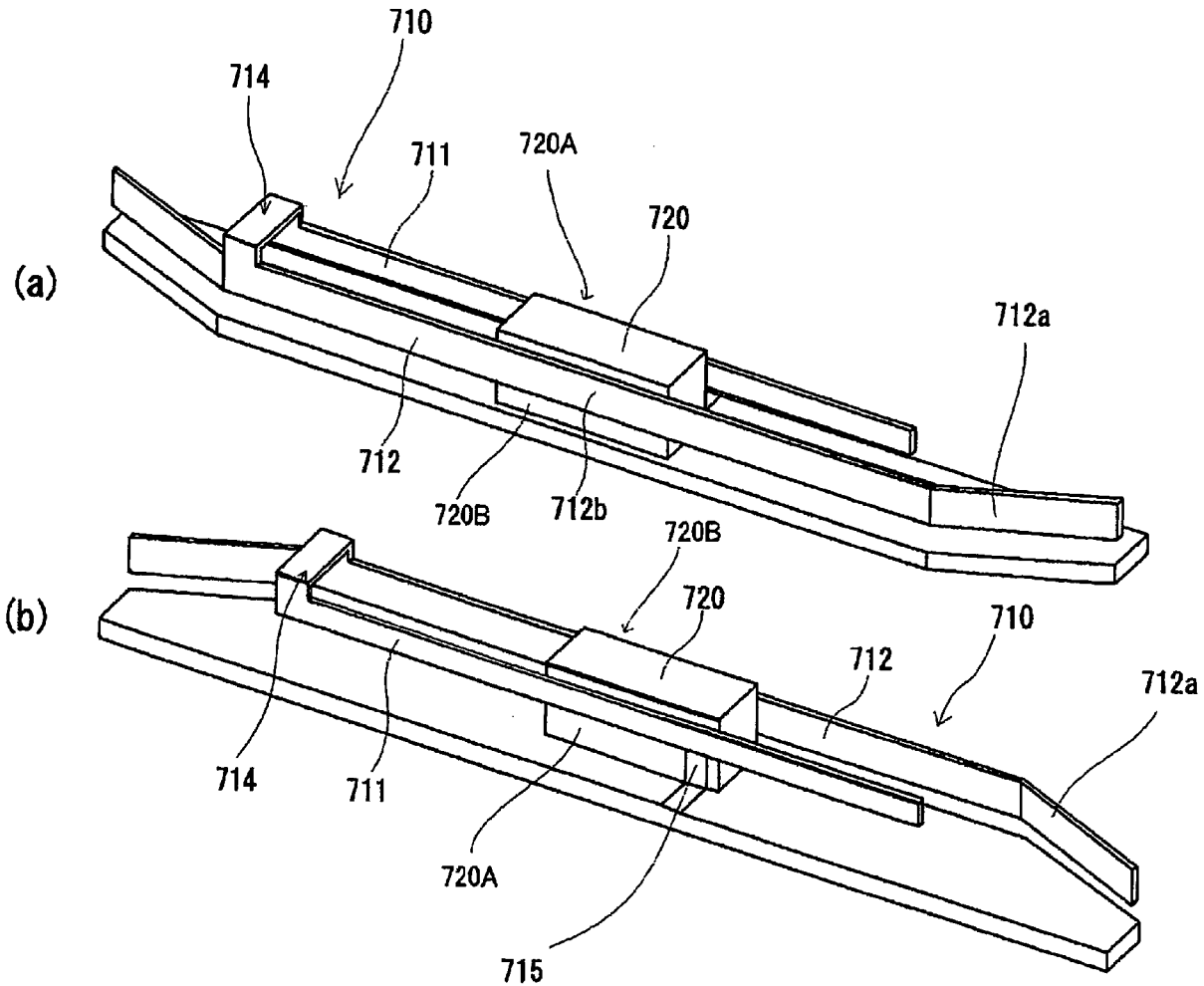
FIG. 34 is a diagram showing an antenna device of the first modified example of the seventh embodiment of the present invention and FIG. 34(*a*) is a perspective view when viewed from a front side (shown by an arrow in FIG. 32) and FIG. 34(*b*) is a perspective view when viewed from a rear side.
Figure 35:
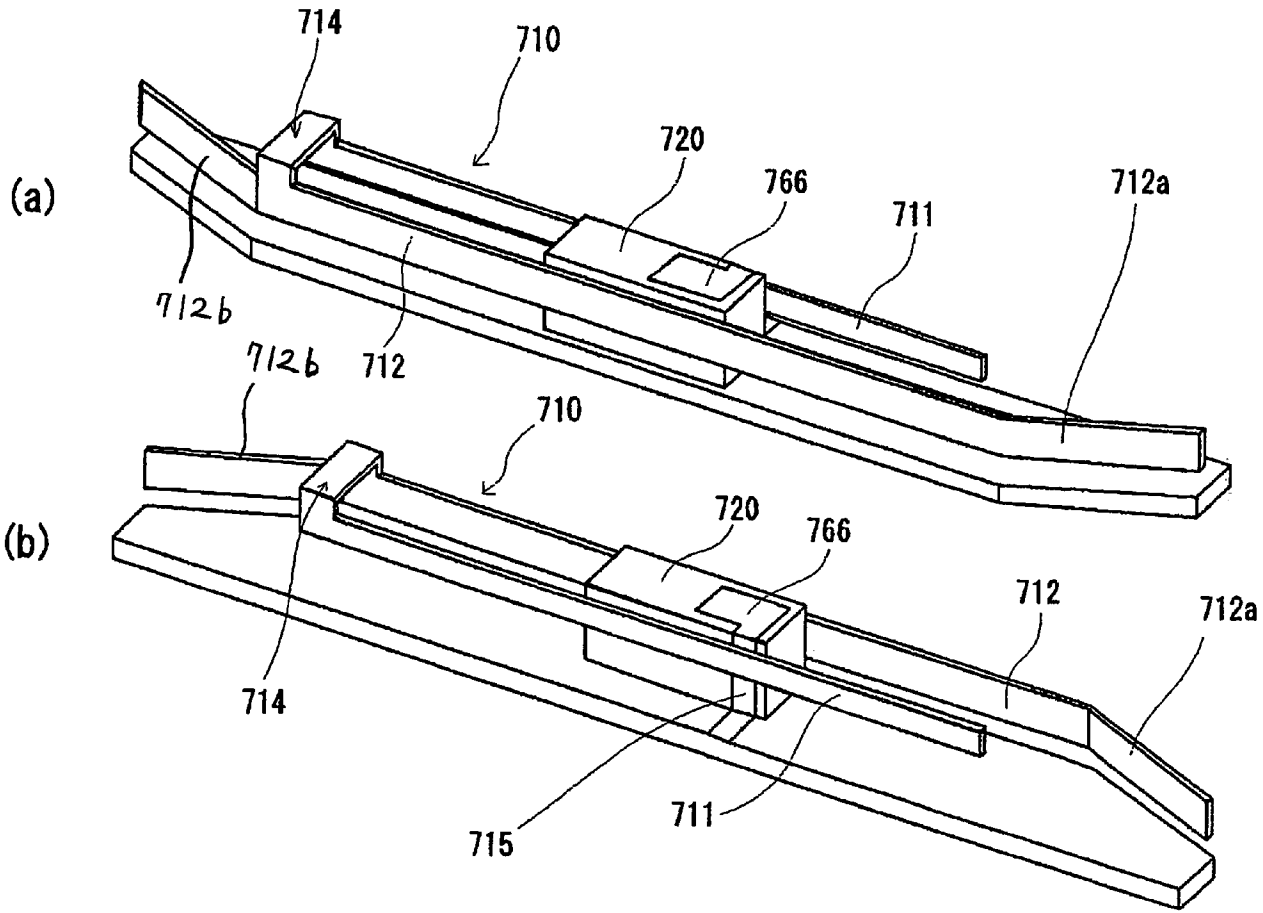
FIG. 35 is a diagram showing an antenna device of the second modified example of the seventh embodiment of the present invention and FIG. 35(*a*) is a perspective view when viewed from a front side (shown by an arrow in FIG. 31) and FIG. 35(*b*) is a perspective view when viewed from a rear side.

Now, the second modified examples of the seventh embodiment of the present invention are described by referring to FIGS. 34 to 35. FIG. 34(*a*) shows the antenna device of the second modified example of the seventh embodiment of the present invention and is a perspective view of the antenna device seen from a front side. Moreover, FIG. 34(*b*) shows the antenna device of FIG. 8 and is a perspective view in which a position of a folded-back portion of the conductor 710 shown in FIG. 34(*a*) is changed so as to be reversed to each other, which is seen from a rear side.

In the modified examples shown in FIGS. 32 and 33, as described above, the plane portion of the conductor 711 on one end side of the conductor antenna 710 in an upper portion in FIGS. 32 and 33 is approximately orthogonal to the plane of the conductor 712 on the other end side of the conductor antenna 710, however, in the antenna devices 700 of the second and third modified examples, as shown in FIGS. 34(*a*) and 34(*b*), a plane portion of the conductor 711 facing the conductor 712 on the one end side is parallel to a plane portion of the conductor 712 on the other end side with the base body 720 interposed between the conductors 711 and 712. That is, the conductor antenna 710 is configured so as to be approximately U-shaped and the plane portion of the conductor 711 on the one end side is parallel to the plane portion of the conductor 712 with the base body 720 being interposed between the conductors 711 and 712 and in the conductor 711 on the one end side is formed the power feeding section 715 and the end portion 712*a* of the conductor 712 on the other end side operates as an open end terminal. As a result, the conductors 711 and 712 are placed far from each other and between the conductors 711 and 712 is formed band-shaped space 713. Both the conductor 711 on one end side of the conductor antenna 710 and the conductor 712 on the other end side are fabricated by a metal plate (metal conductive plate) and, in order to decrease a resistance, to achieve high gain, and to reduce a loss, gold plating is given to their surfaces. More specifically, the conductor antenna 710 is constructed of a metal plate made of bronze phosphate being 0.3 mm in thickness so as to be approximately U-shaped and an approximately central portion of the conductor 711 on one end side of the conductor antenna 710 is coupled to a side face 720 on the other side and an approximately central portion of the conductor 712 on the other end side is coupled to a another side face 720B facing the side face 720A of the base body 720 and is placed on a tip portion 755 of the main face (surface) 750A of the main board 750. The approximately central portion 711*b* of the conductor 711 on the one end side is coupled to a side face 720A of the base body 720 on the other end side by using an adhesive and the approximately central portion is coupled to a side face 720B of the base body 720 by using the adhesive. Moreover, though not shown, as an alternate way, by printing an electrode on a coupled face of the base body 720 by screen printing, the electrode may be coupled to the conductor antenna 710 by means of soldering (that is, approximately central portion between an approximately central portion of the conductor 711 on the one side and an approximately central portion of the conductor 712 on the other end side).

Furthermore, as in the case shown in FIGS. 32 and 38, the conductor antenna 710 is connected to the power feeding line 741 through the conductor line 730. By configuring as above, power is fed from a transmitting/receiving circuit (not shown) mounted in the main board 750 through the power feeding line 741 to the conductor antenna 710. Though not shown, between the power feeding line 741 and the conductor line 730 is an impedance matching circuit made up of a chip element or a like.

FIG. 35(*a*) shows the antenna device of the fourth modified example of the seventh embodiment, which is a perspective view of the antenna device seen from a front side. FIG. 35(*a*) is a perspective view in which a position of a folded-back portion of the conductor 710 shown in FIG. 35(*a*) is changed so as to be reversed to each other, which is seen from a rear side.

In the antenna device 700 of the fourth and fifth modified example, as in the case of the antenna device in the second and third modified examples, the plane portion of the conductor 711 on the one end side of the conductor antenna 710 facing the conductor 720 is parallel to the plane of the conductor 712 on the other end side with the base body 720 being interposed between the two plane portions and, additionally, to the base body 720 is connected the conductor 711 on the one end side of the conductor antenna 710, which provides a conductor pattern 766 enabling the adjustment of transmitting/receiving frequency. That is, a conductor pattern 766 for adjusting the transmitting/receiving frequency is formed from an upper surface of the base body 720 toward one end side and by performing a machining process such as a process of shaving part of the conductor pattern 766 for adjusting the transmitting/receiving frequency or a like, it is made possible to adjust the transmitting/receiving frequency for the antenna device 710, particularly in the GSM band. Thus, according to the antenna device of the fourth and fifth modified example, by changing a size of the conductor antenna 766 for adjusting the transmitting/receiving frequency, capacitive components between the conductor antenna 710 and the conductor 712 on the other end side can be increased or decreased, thereby easily adjusting the transmitting/receiving frequency.

Figure 36:
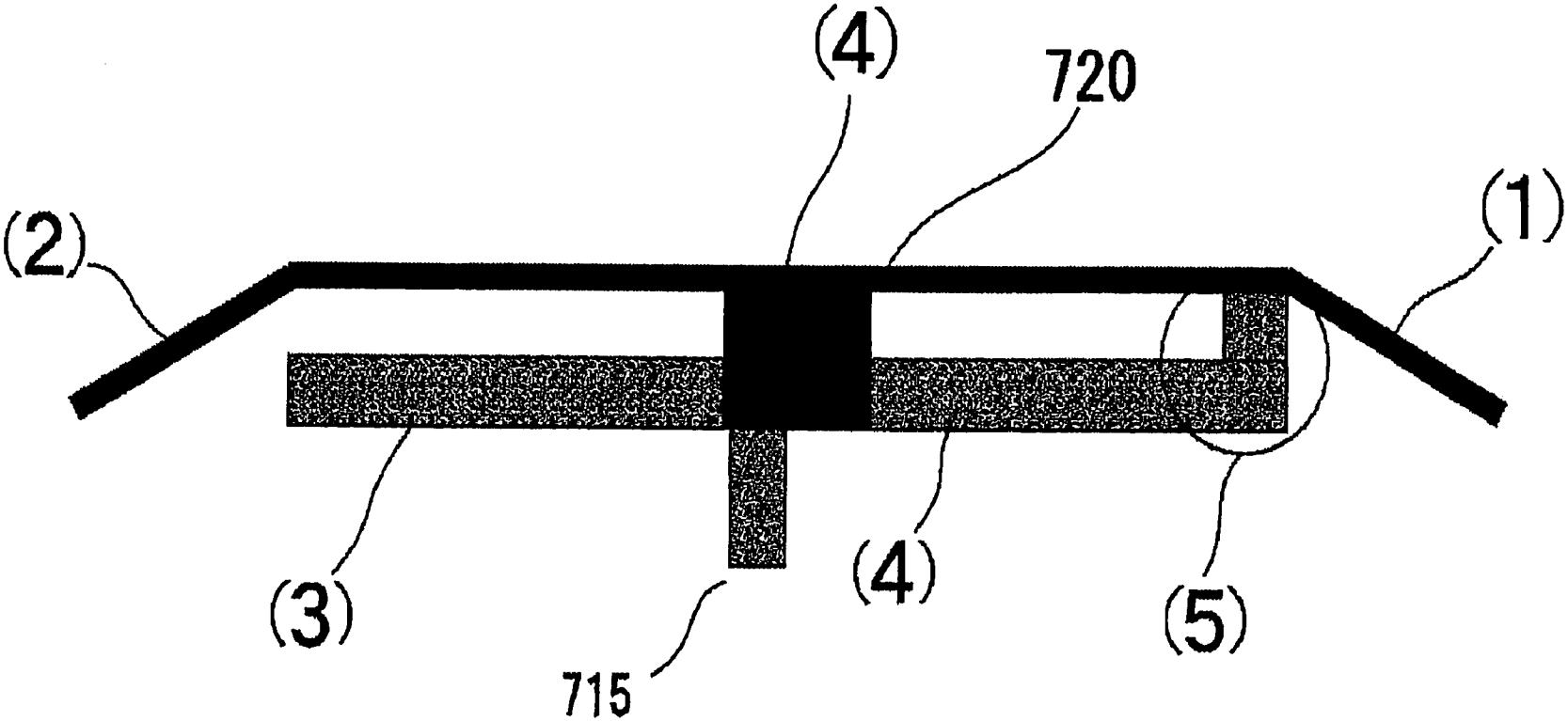
FIG. 36 is a diagram showing conceptual configurations of an antenna device according to the seventh embodiment of the present invention in which each portion is expressed by numerals (1) to (5)

FIG. 36 is a diagram showing conceptual configurations of an antenna according to the seventh embodiment of the present invention in which each portion is expressed by numerals (1) to (5). In FIG. 36, a reference number 720 shows a base body and 715 shows a central power feeding portion. In FIG. 36, the number (1) shows, as a parameter, a length of a bent portion of an extended portion 712A of the conductor 712 on the other end side, the number (2) shows a length of a bent portion of an extended portion 712B of the conductor 712 on the other end side, the number (3) shows a length of the conductor 711 on one end side, the number (4) shows, as a parameter, a width of the conductor 711 on the one end side, and the number (5) shows a position of a folded-back portion of the conductive antenna 710 formed so as to be approximately U-shaped.

Figure 37:
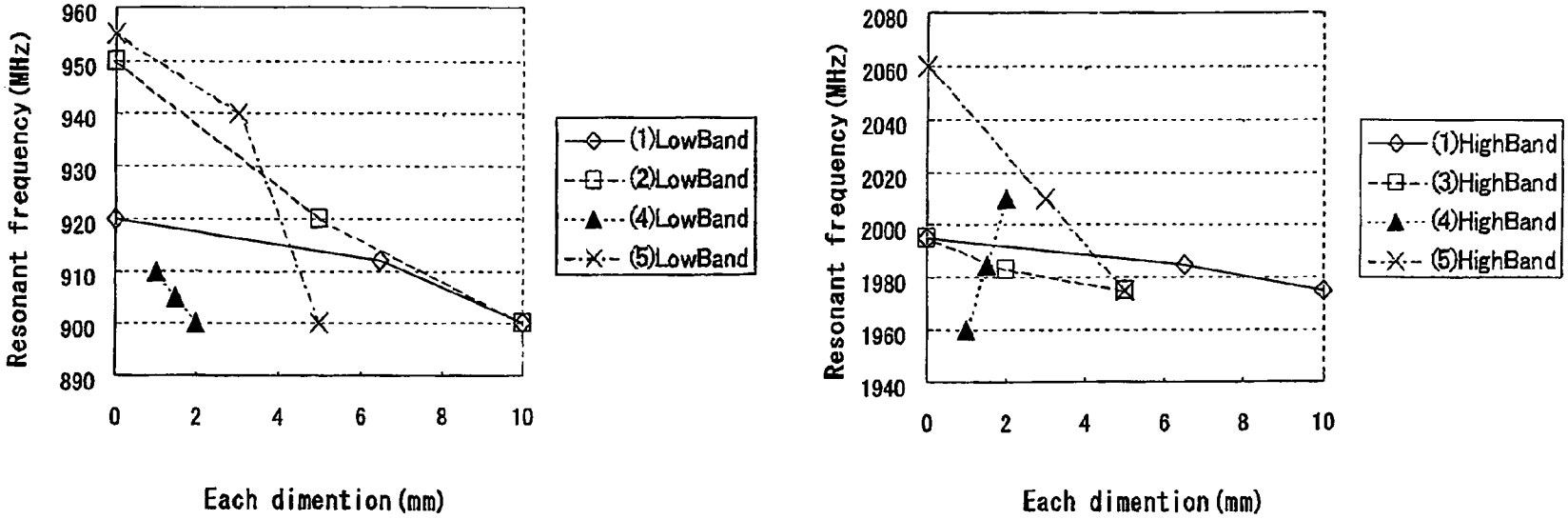
FIG. 37 is a graph in which a result from the measurement of how resonant frequency changes when each parameter (dimension of each component) is changed is plotted.

FIG. 37 is a graph in which a result from the measurement of how resonant frequency changes when each parameter (dimension of each component) shown in FIG. 36 is changed is plotted. FIG. 37(*a*) shows how the resonant frequency in a low band has changed by changing the dimension of the numbers (1), (2), (4), and (5) and FIG. 37(*b*) shows how the resonant frequency in a high band has changed by changing the dimension of the numbers (1), (3), (4), and (5). It was confirmed from the graph shown in FIG. 37 that, in the antenna device of the embodiment, when a length of a bent portion of the extended portion 712*b* of the conductor 712 on the other end side shown as (1) is made longer, the resonant frequency shifts toward a lower level both in the low and high bands. However, a change in a resonant frequency by adjusting the length is somewhat slow and, therefore, this can be used for fine adjustment. It was also confirmed from the graph shown in FIG. 37 that, in the antenna device of the embodiment, when a length of a bent portion of an extended portion 712*b* of the conductor 712 on the other end side shown as (2) is made longer, the resonant frequency shifts toward a lower level both in a low band. Therefore, this can be used as the method of adjusting the transmitting/receiving frequency in the GSM band. It was also confirmed from the graph shown in FIG. 37 that, in the antenna device of the embodiment, when a length of the conductor 711 on one end side shown as (3) is made longer, the resonant frequency shifts toward a lower level on the higher band side and, therefore, this can be used as the method of adjusting the transmitting/receiving frequency in the DCS/PCS/UMTS bands. It was further confirmed from the graph shown in FIG. 37 that, in the antenna device of the embodiment, when a width of the conductor 711 on the one end side shown as (4) is made wider, the resonant frequency shifts toward a lower level in the low band, however, on the contrary, the resonant frequency shifts toward a higher level in the high band. Therefore, this can be used as the method of adjusting the transmitting/receiving frequency in the GSM and UMTS bands. It was still further confirmed that, when a position of a folded-back portion of the conductive antenna 710 formed so as to be approximately U-shaped shown as (5) is made further, the resonant frequency shifts toward a lower level in both the low and high bands. Therefore, this can be used as the method of adjusting the transmitting/receiving frequency in the GSM and UMTS bands.

FIG. 38 is a diagram illustrating an entire main board of a mobile phone on which the antenna device of the seventh embodiment is mounted. In a central portion of the main board 750 is mounted the power feeding port 759 from which power is fed through the power feeding line 741 and conductor line 730 to the conductor antenna 710 and the base body 720. Moreover, alternatively, power may be fed by connecting a connector mounted on the main board 750 to a power feeding connector (not shown) mounted on the tip portion 755 of the main board 750 through a coaxial cable for power feeding.

Figure 39:
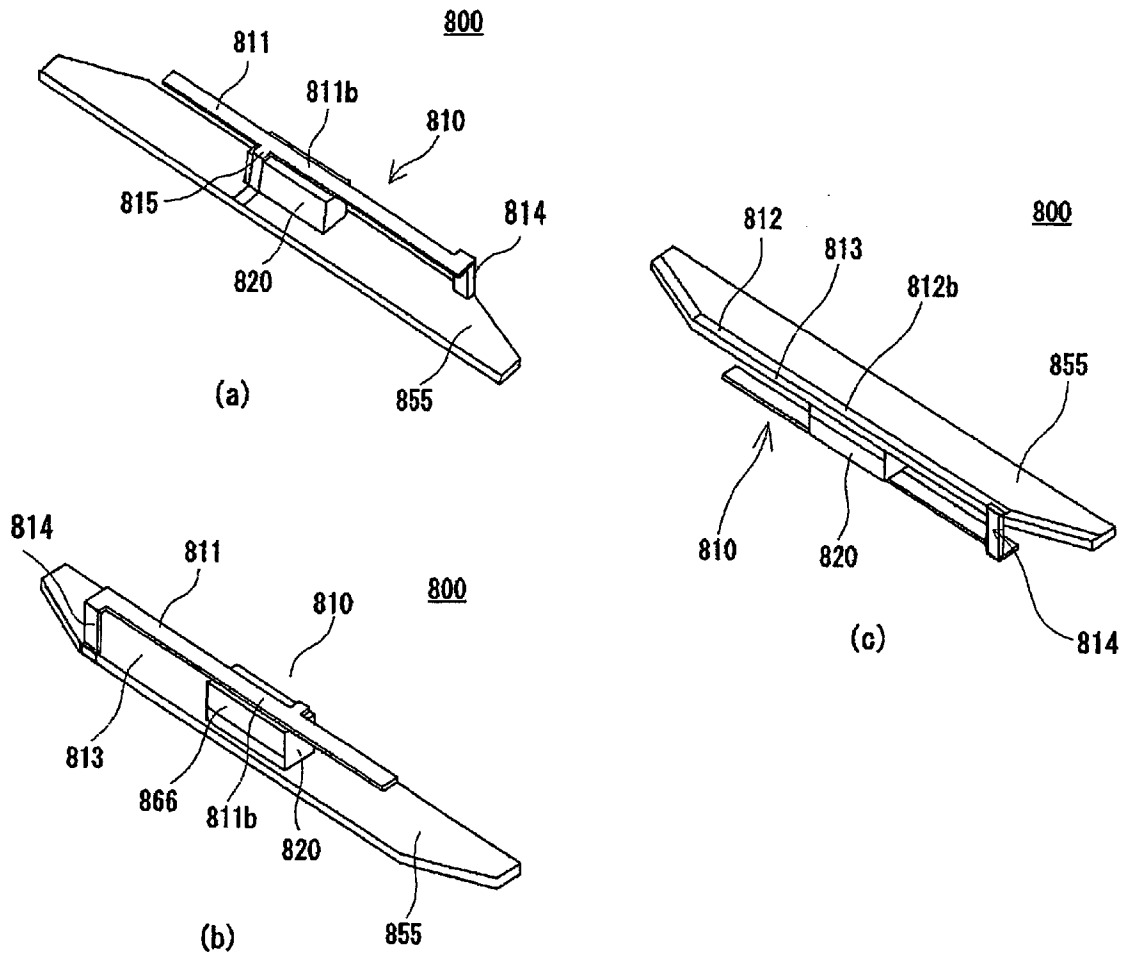
FIG. 39 is a diagram showing basic configurations of an antenna device of the eighth embodiment of the present invention and FIG. 39(*a*) is a perspective view of the first modified example, FIG. 39(*b*) is a perspective view of the second modified example, and FIG. 39(*c*) is a perspective view of the third modified example.
Figure 40:
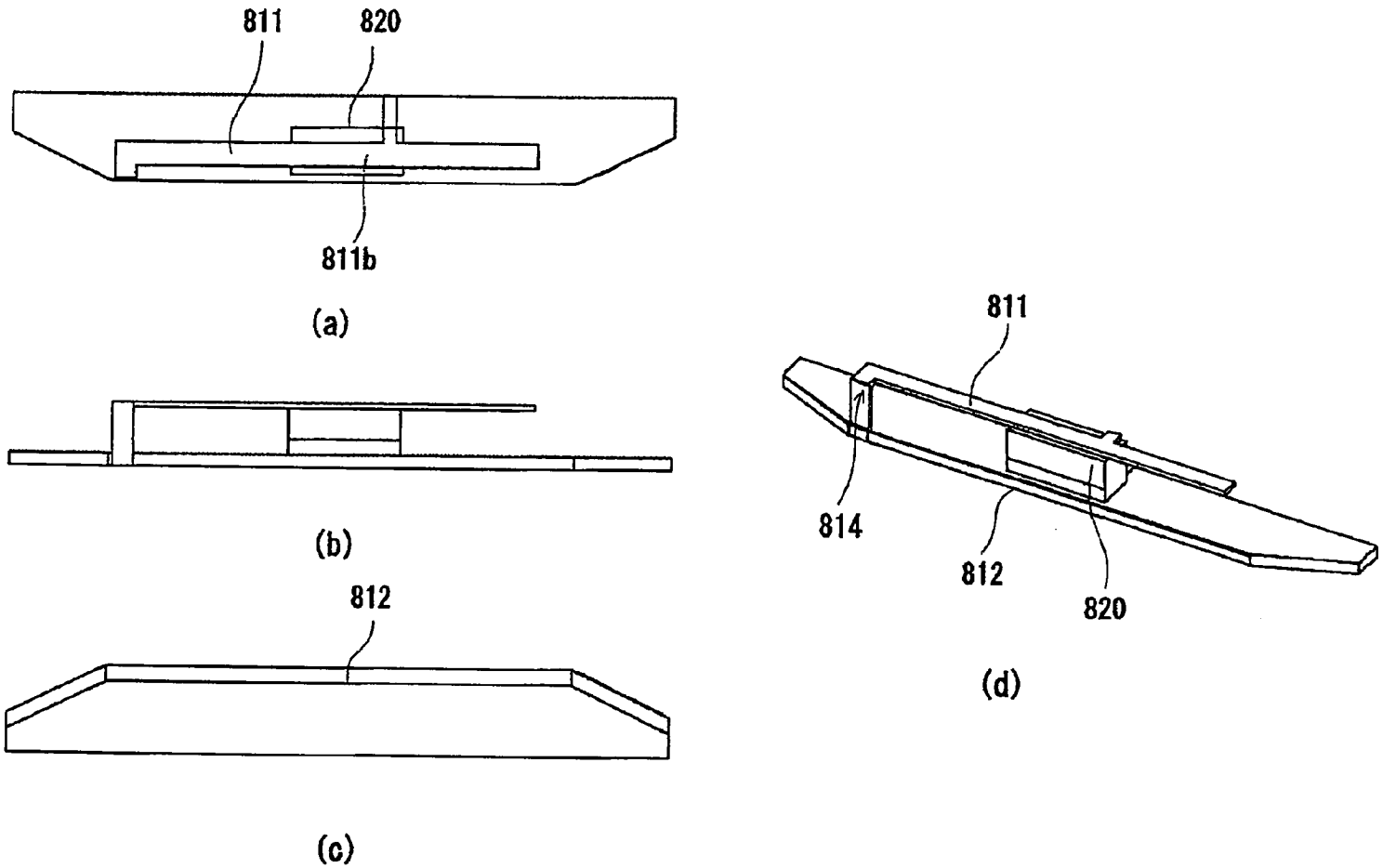
FIG. 40 is a diagram showing configurations of an antenna device of the eighth embodiment of first modified example of the present invention and FIG. 40(*a*) is its plan view, FIG. 40(*b*) is its side view, FIG. 40(*c*) is its bottom plan view, and FIG. 40(*d*) is its perspective view.
Figure 41:
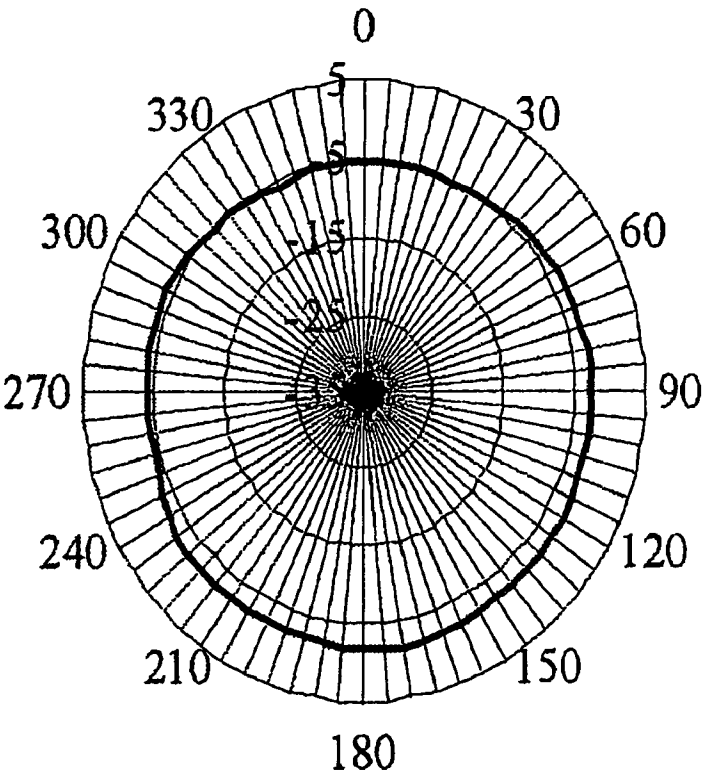
FIG. 41 is a graph showing results from measurement of antenna radiation patterns (gain directivity) obtained when power is fed from an end portion of antenna-mounted board and when power is fed from a central portion of the antenna-mounted board according to the embodiments of the present invention.
Figure 41:
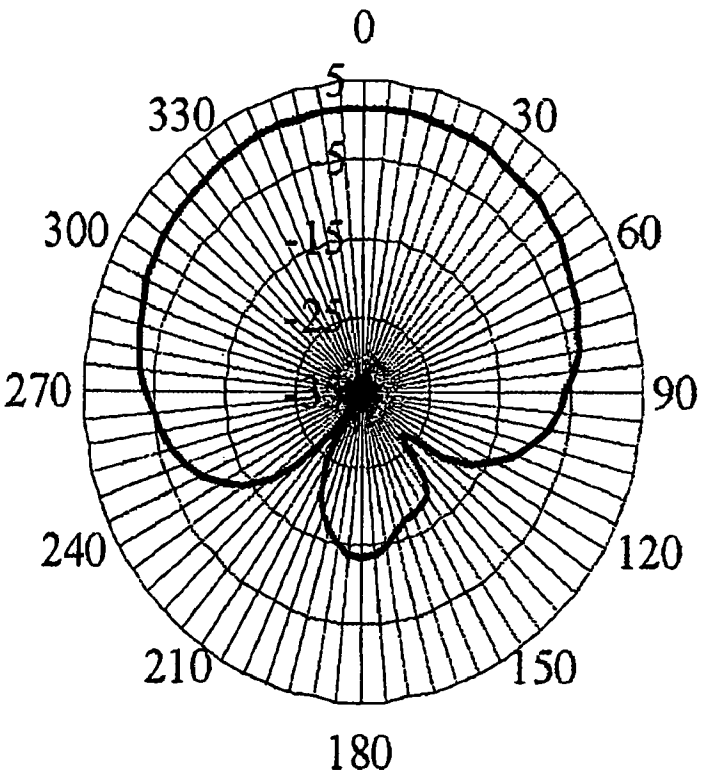

Next, an antenna device of the eighth embodiment of the present invention is described by referring to FIGS. 39 to 41. FIG. 39 is a diagram showing basic configurations of the antenna device of the eighth embodiment of the present invention and FIG. 39(*a*) is a perspective view of the first modified example, FIG. 39(*b*) is a perspective view of the second modified example, and FIG. 39(*c*) is a perspective view of the third modified example seen from a rear of a board. FIG. 40 is a diagram showing configurations of an antenna device of the first modified example and FIG. 40(*a*) is its plan view, FIG. 40(*b*) is its side view, FIG. 40(*c*) is its bottom plan view, and FIG. 40(*d*) is its perspective view;

The antenna device 800 of the eighth embodiment is the same as the antenna device 700 of the seventh embodiment in that power is fed from a central portion of the board, however, differs from that in that a conductor pattern made of a metal conductive foil is formed on a rear of the board and in that a plane portion of a conductor 811 on one end side faces a plane portion of a conductor 812 made of metal conductive foil on the other side with a base body made of a dielectric material and the board being interposed between the plane portion on the one end side and the plane portion on the other end side. That is, the antenna device 800 has a conductor 810, a base body 820, and a conductor line 830 (not shown), all of which are mounted on a tip portion of a main face (surface) of the main board. The conductor antenna 810 is configured so as to be approximately U-shaped and so that a plane portion of the conductor 811 on one end side of the conductor antenna 810 in an upper portion in FIG. 39 is in parallel to a plane portion of the conductor 812 facing the conductor 811 on the other end side in a lower portion in FIG. 39. A central portion 811*b* of the conductor 811 on the one end side of the conductor antenna 810 is coupled to an upper face of the conductor 820 and is connected through a folded-portion 814 to the conductor 812 on the other end side. The conductor 812 on the other end side is made of metal conductive foil on a rear of a tip portion 855 on the board. A power feeding section 815 is connected to the conductor 811 on the one end side and an end portion of the conductor 812 on the other end side operates as an open end terminal. That is, the conductors 811 and 812 are placed far from each other and band-shaped space 813 is interposed between the conductors 811 and 812. Thereby, the band-shaped space 813 is formed. The conductor 811 on one end side of the conductor antenna 810 is constructed of a metal plate (metal conductive plate) made of, for example, bronze phosphate with a thickness of 0.3 mm and, in order to reduce a resistance value to obtain a high antenna gain and to minimize a loss, gold plating or silver plating is given on a surface of the conductor 811.

The conductor 812 on the other end side of the conductor antenna 810 is mounted on a rear of the tip portion 855 of the board and more specifically the conductor 812 is made of copper foil having a specified width which extends along a chamfered outer edge on a rear of the tip portion 855 of the board. Moreover, in the eighth embodiment of the present invention, the conductor 812 on the other end side of the conductor antenna 810 is made of copper foil, however, alternatively, may be constructed of a metal plate made of bronze phosphate as in the case of the conductor 811 on the one end side of the conductor antenna 810. In this case, a plane portion of the metal plate may be adhered to a rear of the tip portion 855 of the board. Alternatively, the conductor 812 on the other end side of the conductor antenna 810 is made up of a metal plate and the conductor 811 on the one end side is made of other material such as a line material (metal conductive line) or a like. Preferably, at least either of the conductor on the one end side or on the other end side of the conductor antenna 810 is constructed of a metal plate (metal conductive line). Moreover, in that case, to be used as another conductor on the one end side or on the other end side of the conductor antenna, metal conductive foil mounted on the board as employed in the above embodiment such as copper foil may be printed or a metal conductive film may be formed on a surface of the board by screen printing, deposition, or a like.

Thus, according to the antenna device 800 of the eighth embodiment, on a rear of the tip portion 855 of the board, a central portion 812*b* of the conductor 812 on the other end side of the conductor antenna 810 extends over a bottom face portion of the base body 820 and, as a result, the central portion 812*b* of the conductor 812 on the other end side is coupled to a bottom face of the base body 820 with a distance corresponding to a thickness of the tip portion 855 of the board being interposed between the central portion 812 and the bottom face of the base body 820 and is capacitively coupled to a central portion 811*b* of the conductor 811 on the one end side with the base body 820 interposed between the central portion 812*b* and the central portion 811*b*.

In the modified example of the eighth embodiment, as shown in FIG. 39(*b*), a conductor pattern 866 to be used for adjusting capacitive coupling to the conductor 811 on the other end side of the conductor antenna 810 is formed on the base body 820. That is, over a side face through a bottom face of the conductor 820, the conductor pattern 866 for adjusting capacitive coupling is formed and, by performing a machining process such as a process of shaving part of the conductor pattern 866, a degree of the capacitive coupling to the conductor 811 can be changed, which enables the adjustment of transmitting/receiving frequency in the GSM band in the antenna device 800.

Alternatively, by forming a through hole (not shown) on the tip portion 855 on the main board 850 and using the through hole, the conductor 812 (foil or a like) on the other end side on the rear of the main board 850 may be connected to the conductor 812 (foil or a like) on the one end side and the conductor 811 (metal plate) on the other side.

FIG. 41 shows results of measurement of an antenna radiation pattern (gain directivity) obtained when power is fed from an end portion of the board on which the antenna is mounted and when power is fed from a central portion of the board on which the antenna is mounted. FIG. 41(*a*) shows the antenna radiation pattern observed when power was fed from the end portion of the antenna-mounted board FIG. 41(*b*) shows the antenna radiation pattern observed when power is fed from the central portion of the antenna-mounted board. Numeric values of 5, −5, −15, −25, and −35 represent gains [dBi] and numeric values of 0, 30, 60, . . . , 330 represent azimuth angles. The measurement was made at frequencies of 1.91 GHz. As shown in FIGS. 41(*a*) and 41(*b*), it was confirmed that, when power is fed from the central portion of the antenna-mounted board, the antenna radiation pattern (gain directivity) shows a characteristic of being a uniform circle, which can provide uniform directivity, that is, an excellent gain.

Figure 42:
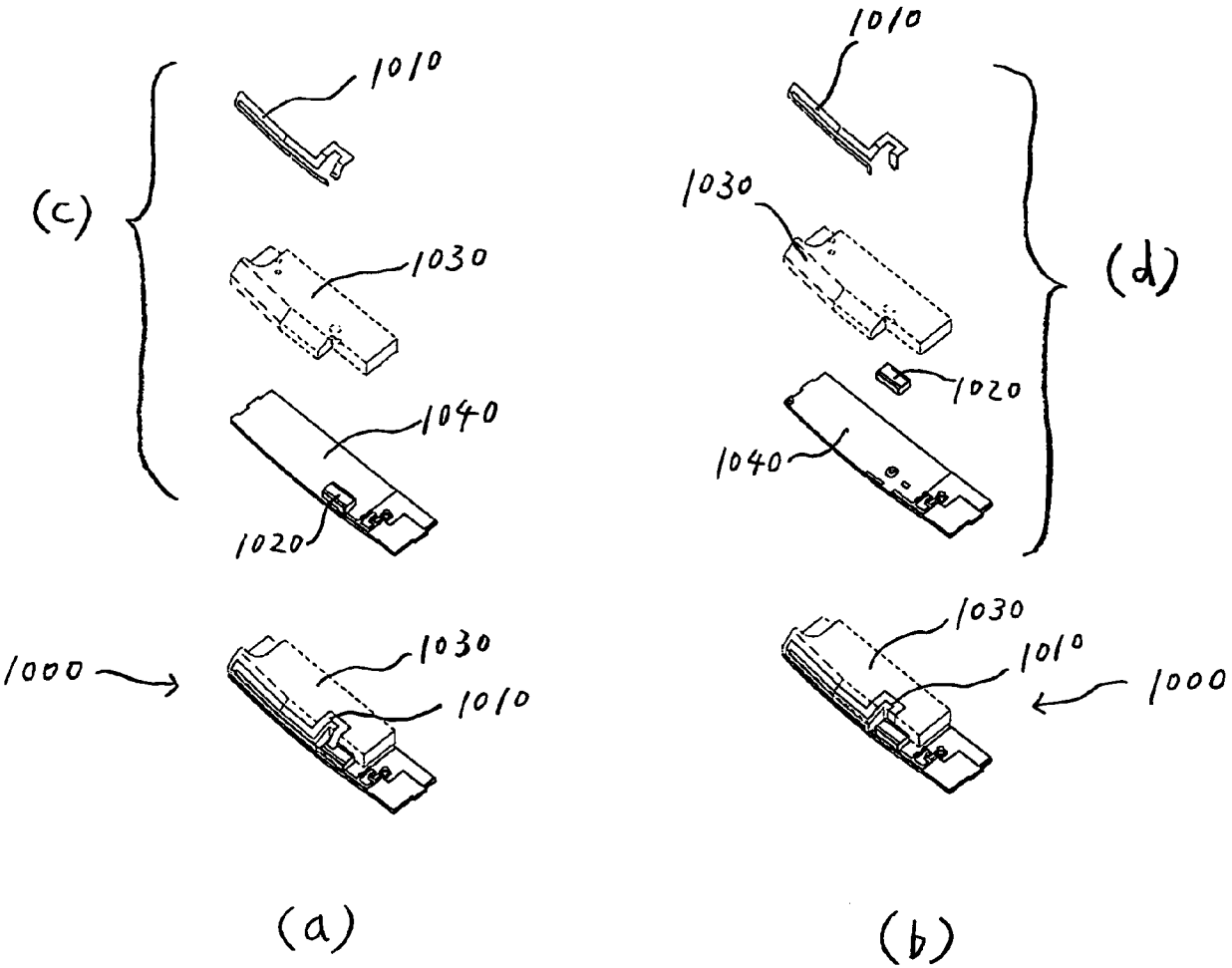
FIG. 42 is a diagram showing configurations of an antenna device of the ninth embodiment of the present invention.

FIG. 42 is a diagram showing configurations of an antenna device of the ninth embodiment of the present invention. The antenna device 1000 of the ninth embodiment, as shown in FIGS. 42(*a*) and 42(*b*), is so configured that an conductor antenna 1010 is mounted with a plastic supporting body (carrier) being interposed. The plastic supporting body 1030 is made of a resin such as a plastic formed in a manner to correspond to a shape of a case of a mobile phone on which the antenna device 1000 is mounted. The conductor antenna 1010 is made of a metal conductive plate, metal conductive line, metal conductive film, or metal conductive foil. When the metal conductive plate or metal conductive line is used for the conductor antenna 1010, as shown in FIG. 42(*c*), a base body 1020 is fixed on a sub-board 1040 and the plastic supporting body 1030 is directly stuck thereto using an adhesive or after inserting a boss into the board to be secured, the metal conductive plate or metal conductive line machined in advance so as to match with a surface shape of the plastic supporting body is affixed thereon. The connection to a pattern electrode of the base body 1020 is achieved by directly soldering an end portion of the conductor antenna 1010 to a pattern electrode on a surface of the base body 1020. When the metal conductive film or metal conductive foil is used for the conductive antenna 1010, as shown in FIG. 42(*d*), the base body 1020 is fixed on the sub-board 1040 and the plastic supporting body 1030 formed in advance by affixing the metal conductive film or metal conductive foil to a surface of the plastic supporting body 1030 is directly stuck by using the adhesive thereto or the plastic supporting body 1030 is secured by inserting a boss into the board. The connection to a pattern electrode of the base body 1020 is achieved by directly soldering an end portion of the metal conductive film or metal conductive foil formed on a surface of the plastic supporting body 1030 to a pattern electrode on a surface of the base body 1020. The conductor antenna 1010 may have a line-shaped portion, crank-shaped portion, meanderingly-shaped portion, or helically shaped portion in a manner to correspond to a shape of the plastic supporting body 1030 and can be of approximately U-shaped as a whole. By configuring the conductor antenna 1010 so as to be supported by the plastic supporting body 1030, it is made possible to increase its shock resistance and/or drop resistance without decreasing a gain and sensitivity. Additionally, by coating the conductor antenna 1010 and plastic supporting body 1030 with a resin to integrate and solidify both, further increased shock resistance and/or drop resistance can be obtained.

As described above, according to the antenna device of the above embodiments, it is made possible to achieve a space-saving embedded-type antenna circuit and which is capable of operating in wide bands (for example, quad band) including the GSM band, DCS/PCS bands, and UMTS band and of achieving excellent gain in each band and maintaining non-directivity of vertically polarized waves. Moreover, each of the antenna devices of the embodiments has a structural characteristic in which the antenna device is configured to be small-sized and can provide a degree of freedom of design by adding the base body made of a dielectric or a magnetic substance being an insulating material to the conductor antenna constructed of, for example, a metal plate being approximately U-shaped. Furthermore, according to the antenna device of the embodiment, simply by adding the base body made of one piece of a dielectric substance or one piece of a magnetic substance to one piece of the conductor antenna made of a metal plate, the antenna device can operate in a plurality of bands and it is not necessary to attach an antenna in every different band. Unlike the known dielectric chip on which a radiation pattern is formed, according to the embodiments of the present invention, attachment of the radiation electrode to ceramic dielectric or ceramic magnetic substance is not required and, therefore, manufacturing processes can be reduced, thus achieving cost-reduction.

Also, the base body made of the dielectric or magnetic substance is added not between the radiation electrode and grounding conductor but at a position in which electric field strength increases between conductor antenna electrodes (that is, over an end portion being a tip side on one end side of the conductor antenna having a folded-back portion and being approximately U-shaped and an end portion being near to the power feeding section on the other end side) and, therefore, an electromagnetic distance between the one end and the other end of the conductor antenna becomes short to a degree to which electrostatic coupling occurs, which allows a resonant point to be easily obtained and, therefore, the antenna can be miniaturized by a wavelength shortening effect of the dielectric or magnetic material being the insulating material. Therefore, the small-sized antenna device is allowed to operate in wide bands. Also, in the conductor antenna having an approximately U-shaped profile is so configured as to be vertical with respect to grounding conductors or to have more portions being vertical with respect to the grounding conductors which reduces electrostatic capacity between grounding conductors, thereby achieving improved radiation efficiency and operations in a wide band. By configuring the antenna device so that the antenna is placed far from a ground, microphone, speaker, or a like, a mirror-image current of opposite phase that cancels a resonant current occurring in the conductor portion in the antenna can be reduced, which can improve radiation efficiency and an S/N (signal-to-noise) ratio. The antenna devices of the embodiments have a functional characteristic in which a bandwidth being two-fold larger than that of the antenna made of only the dielectric base body is ensured, thereby improving antenna gain. By adding the base body made of the dielectric or magnetic substance to the antenna device, effects by shortening a wavelength can be obtained, which enables miniaturization of the entire antenna device.

Particularly, by using the ceramic dielectric to increase permittivity, influences induced by other bands can be minimized and the fluctuation of directivity and degradation in VSWR can be prevented. Also, by increasing permittivity to miniaturize the ceramic dielectric, effective electrostatic capacity between the approximately U-shaped conductor antenna and grounding terminals can be decreased and radiation efficiency can be improved and operations in a wide band (in a multi-band) is made possible. Effective distance is put between the approximately U-shaped conductive antenna and noise source and, therefore, an S/N ratio is improved. Mounting of the approximately U-shaped conductor antenna with a sufficient thickness and width serves to improve the radiation efficiency of radio waves. By changing a length of the approximately U-shaped conductor antenna, permittivity of the ceramic dielectric and a position of placement of the antenna device, a plurality of resonant frequencies can be controlled, which enables operations in wider bands (in a multi-band). Even if not the metal plate but the line material is used as the material for the approximately U-shaped antenna, the same effect can be obtained, however, the use of the metal plate allows the manufacturing of the antenna device with a comparatively large degree of freedom of designing the shape of the antenna device with its strength being maintained and its production at low costs.

Additionally, the antenna device of the present invention can be widely applied not only to a mobile phone but also various multi-band wireless communication apparatuses including a GPS (Global Positioning System), wireless LAN, or a like.

It is apparent that the present invention is not limited to the above embodiments but may be changed and modified without departing from the scope and spirit of the invention.

What is claimed is:

1. An antenna devices comprising:

an approximately U-shaped conductor antenna, on one end-side of which a power feeding portion is provided and on an other end-side of which an end portion is provided as an open end terminal; and a base body comprising an insulating material;

wherein one end of said conductor antenna and an other end of said conductor antenna are placed so as to come near to each other with said base body interposed between said one end of said conductor and said other end of said conductor antenna, wherein said base body is coupled to one of said one end-side of said conductor and said other end-side of said conductor antenna, and wherein said approximately U-shaped conductor antenna is formed so that said both ends of said conductor antenna are electro-static capacitively coupled to each other.

2. The antenna device according to claim 1, wherein said base body is mounted between conductors comprising said approximately U-shaped conductor antenna, said both conductors being opposite to each other and wherein a space is defined in a partial portion between said both conductors.

3. The antenna device according to claim 1, wherein said base body is placed between in a portion near to said end portion on one end-side of said conductor antenna and in a portion near to said end portion on said other end-side of said conductor antenna.

4. The antenna device according to claim 1, wherein said base body is placed between in a portion near to a central portion on said one end-side of said conductor antenna and in a portion near to a central portion on said other end-side of said conductor antenna.

5. The antenna device according to claim 1, wherein said conductor antenna comprises a conductor pattern comprising one of a metal conductive foil and a metal conductive film placed on said base body.

6. The antenna device according to claim 1, wherein said conductor antenna comprises a plate-shaped conductor, and wherein a plane portion of said conductor on said one end-side of said conductor antenna, which is opposite to said other end-side, is approximately orthogonal to a plane portion of said conductor on said other end-side of said conductor antenna.

7. The antenna device according to claim 1, wherein, to said base body is connected a portion on said one end of said conductor antenna and a conductor pattern that enables adjustment of transmitting and receiving frequencies.

8. A multi-band type wireless communication into which the antenna device stated in claim 1, is embedded.

9. The antenna device according to claim 1, wherein only one said approximately U-shaped conductor antenna is provided.

10. The antenna device according to claim 1, wherein said approximately U-shaped conductor antenna is disposed so that said power feed portion and said end portion are placed so as to come near to each other.

11. An antenna devices comprising:

an approximately U-shaped conductor antenna, on one end-side of which a power feeding portion is provided and on an other end-side of which an end portion is provided as an open end terminal;

a base body comprising an insulating material; and a board on which said base body and said conductor antenna are mounted, wherein one end of said conductor antenna and an other end of said conductor antenna are placed so as to come near to each other with said base body interposed between said one end of said conductor and said other end of said conductor antenna, wherein said base body is coupled to one of said one end of said conductor and said other end of said conductor antenna, and wherein said approximately U-shaped conductor antenna is formed so that said both ends of said conductor antenna are electro-static capacitively coupled to each other.

12. The antenna device according to claim 11, wherein said base body and one of one portion on one end-side of said conductor antenna one portion on the other end-side of said conductor antenna are mounted on a main face of said board and another portion on one of one end-side of said conductor antenna and another portion on the other end of said conductor antenna is formed on a rear of said main face of said board.

13. The antenna device according to claim 12, wherein a conductor on said one end-side of said conductor antenna and another conductor on said other end-side of said conductor are coupled to each other in a place near to an approximately U-shaped folded-back portion via one of a through-hole and a side electrode formed on said board.

14. The antenna device according to claim 11, wherein planes on said one end-side and on said other end-side of said conductor antenna, both end-sides being opposite to each other, are configured to be approximately vertical to one another.

15. The antenna device according to claim 11, wherein a portion on other end-side of said conductor antenna is configured as one of an L-shaped route and a "⊃" shaped route on a rear of said board.

16. The antenna device according to claim 11, wherein only one said approximately U-shaped conductor antenna is provided.

17. The antenna device according to claim 11, wherein a folded-back portion of said approximately U-shaped conductor antenna is folded in a thickness direction of said board.

18. The antenna device according to claim 16, wherein said approximately U-shaped conductor antenna is disposed at the side of a side plane of said board.

19. The antenna device according to claim 16, further comprising a sub-board between said base body and said approximately U-shaped conductor antenna.

20. The antenna device according to claim 11, wherein a mounting hardware configured to attach said antenna device to an apparatus into which said antenna device is embedded is attached to said board.

21. The antenna device according to claim 11, wherein each of a portion on one end-side of said approximately U-shaped conductor antenna and a folded-back portion is coupled to said board.

22. An antenna device, comprising:

an approximately U-shaped conductor antenna, in an approximately central portion on one end-side of which a power feeding portion is provided and on an other end-side of which an end portion is provided as an open terminal;

a base body comprising an insulating material; and a board on which said base body and said conductor antenna are mounted, wherein one end of said conductor antenna and an other end of said conductor antenna are placed so as to come near to each other with said base body interposed between said one end of said conductor and said other end of said conductor antenna, wherein said base body is coupled to one of said one end-side of said conductor and said other end-side of said conductor antenna, and wherein said approximately U-shaped conductor antenna is formed so that said both ends of said conductor antenna are electro-static capacitively coupled to each other.

23. The antenna device according to claim 22, wherein said conductor antenna and said base body are mounted on a main face of said board.

24. The antenna device according to claim 22, wherein portions on at least one of said one end-side and on said other end-side of said conductor antenna comprise at least one of a metal conductive plate and metal conductive line.

25. The antenna device according to claim 22, wherein a portion on one said end-side of said conductor antenna is coupled to an upper face of said base body and a portion on said other end-side of said conductor antenna is coupled to a side face of said base body.

26. The antenna device according to claim 22, wherein a portion on said one end of said conductor antenna is coupled to a side face of said base body and a portion on said other end-side of said conductor antenna is coupled to another side facing the side face of said conductor antenna.

27. The antenna device according to claim 22, wherein a portion on said one side of said conductor antenna is coupled to an upper face of said base body and a portion on said other side of said conductor antenna is coupled to a rear of said board.

28. The antenna device according to claim 22, wherein a folded-back portion of said approximately U-shaped conductor antenna is folded in a thickness direction of said board.

29. The antenna device according to claim 22, wherein said approximately U-shaped conductor antenna is disposed separately from said base body.

* * * * *